US012152296B2

(12) United States Patent
Dunand et al.

(10) Patent No.: US 12,152,296 B2
(45) Date of Patent: Nov. 26, 2024

(54) COBALT-BASED SUPERALLOYS WITH STABLE GAMMA-PRIME PRECIPITATES, METHOD OF PRODUCING SAME

(71) Applicant: NORTHWESTERN UNIVERSITY, Evanston, IL (US)

(72) Inventors: David C. Dunand, Evanston, IL (US); Fernando Reyes Tirado, Evanston, IL (US)

(73) Assignee: NORTHWESTERN UNIVERSITY, Evanston, IL (US)

( * ) Notice: Subject to any disclaimer, the term of this patent is extended or adjusted under 35 U.S.C. 154(b) by 931 days.

(21) Appl. No.: 17/056,519

(22) PCT Filed: May 22, 2019

(86) PCT No.: PCT/US2019/033450
§ 371 (c)(1),
(2) Date: Nov. 18, 2020

(87) PCT Pub. No.: WO2019/226731
PCT Pub. Date: Nov. 28, 2019

(65) Prior Publication Data

US 2021/0207255 A1 Jul. 8, 2021

Related U.S. Application Data

(60) Provisional application No. 62/674,780, filed on May 22, 2018.

(51) Int. Cl.
*C22F 1/10* (2006.01)
*C22C 19/07* (2006.01)

(52) U.S. Cl.
CPC ..... *C22F 1/10* (2013.01); *C22C 19/07* (2013.01)

(58) Field of Classification Search
CPC ..... C22F 1/10; C22C 19/07
See application file for complete search history.

(56) References Cited

U.S. PATENT DOCUMENTS

| | | | |
|---|---|---|---|
| 2012/0312426 | A1 | 12/2012 | Suzuki et al. |
| 2015/0354031 | A1 | 12/2015 | Gehrmann et al. |
| 2017/0037498 | A1 | 2/2017 | Makineni et al. |

FOREIGN PATENT DOCUMENTS

| | | | |
|---|---|---|---|
| CN | 104630569 | A | 5/2015 |
| JP | 5144270 | B2 | 2/2013 |

OTHER PUBLICATIONS

J.R. Davis, Nickel, Cobalt, and Their Alloys, ASM International, 2000.

H. Chinen, J. Sato, T. Omori, K. Oikawa, I. Ohnuma, R. Kainuma, K. Ishida, New ternary compound Co3(Ge, W) with L12 structure, Scr. Mater. 56 (2007) 141-143.

(Continued)

*Primary Examiner* — Anthony M Liang
*Assistant Examiner* — Danny N Kang
(74) *Attorney, Agent, or Firm* — Locke Lord LLP; Tim Tingkang Xia, Esq.

(57) ABSTRACT

A cobalt based superalloy and a method of producing the same. The superalloy includes a nominal composition comprising at least cobalt, aluminum, Z and vanadium, Z being at least one of tantalum and niobium, processed such that the superalloy comprises gamma and gamma-prime phases with stable gamma+gamma-prime microstructures.

9 Claims, 45 Drawing Sheets

(56) References Cited

OTHER PUBLICATIONS

K. Shinagawa, T. Omori, J. Sato, K. Oikawa, I. Ohnuma, R. Kainuma, K. Ishida, Phase Equilibria and Microstructure on γ' Phase in Co—Ni—Al—W System, Mater. Trans. 49 (2008) 1474-1479.
L. Zhu, C. Wei, hours. Qi, L. Jiang, Z. Jin, J.C. Zhao, Experimental investigation of phase equilibria in the Co-rich part of the Co—Al—X (X=W, Mo, Nb, Ni, Ta) ternary systems using diffusion multiples, J. Alloys Compd. 691 (2017) 110-118.
A. Suzuki, hours. Inui, T.M. Pollock, L12-Strengthened Cobalt-Base Superalloys, Annu. Rev. Mater. Res. 45 (2015) 345-368.
J.J. Ruan, X.J. Liu, S.Y. Yang, W.W. Xu, T. Omori, T. Yang, B. Deng, hours.X. Jiang, C.P. Wang, R. Kainuma, K. Ishida, Novel Co—Ti—V-base superalloys reinforced by L12-ordered γ' phase, Intermetallics. 92 (2018) 126-132.
P.J. Bocchini, C.K. Sudbrack, D.J. Sauza, R.D. Noebe, D.N. Seidman, D.C. Dunand, Effect of tungsten concentration on microstructures of Co—10Ni—6Al—(0,2,4,6)W—6Ti (at%) cobalt-based superalloys, Mater. Sci. Eng. A. 700 (2017) 481-486.
P.J. Bocchini, C.K. Sudbrack, R.D. Noebe, D.C. Dunand, D.N. Seidman, Microstructural and creep properties of boron- and zirconium-containing cobalt-based superalloys, Mater. Sci. Eng. A. 682 (2017) 260-269.
P.J. Bocchini, C.K. Sudbrack, R.D. Noebe, D.C. Dunand, D.N. Seidman, Effects of titanium substitutions for aluminum and tungsten in Co—10Ni—9Al—9W (at%) superalloys, Mater. Sci. Eng. A. 705 (2017) 122-132.
J. Sato, Cobalt-Base High-Temperature Alloys, Science (80-). 312 (2006) 90-91.
P.J. Bocchini, E.A. Lass, K.W. Moon, M.E. Williams, C.E. Campbell, U.R. Kattner, D.C. Dunand, D.N. Seidman, Atom-probe tomographic study of γ/γ' interfaces and compositions in an aged Co—Al—W superalloy, Scr. Mater. 68 (2013) 563-566.
J.E. Saal, C. Wolverton, Thermodynamic stability of Co—AL—W L12 γ', Acta Mater. 61 (2013) 2330-2338.
M. Ooshima, K. Tanaka, N.L. Okamoto, K. Kishida, hours. Inui, Effects of quaternary alloying elements on the γ' solvus temperature of Co—Al—W based alloys with fcc/L12 two-phase microstructures, J. Alloys Compd. 508 (2010) 71-78.
T. Omori, K. Oikawa, J. Sato, I. Ohnuma, U.R. Kattner, R. Kainuma, K. Ishida, Partition behavior of alloying elements and phase transformation temperatures in Co—Al—W-base quaternary systems, Intermetallics. 32 (2013) 274-283.
D.J. Sauza, P.J. Bocchini, D.C. Dunand, D.N. Seidman, Influence of ruthenium on microstructural evolution in a model Co—Al—W superalloy, Acta Mater. 117 (2016) 135-145.
S.K. Makineni, B. Nithin, K. Chattopadhyay, A new tungsten-free γ-γ' Co—Al—Mo—Nb-based superalloy, Scr. Mater. 98 (2015) 36-39.
S.K. Makineni, B. Nithin, D. Palanisamy, K. Chattopadhyay, Phase evolution and crystallography of precipitates during decomposition of new "tungsten-free" Co(Ni)—Mo—Al—Nb γ-γ' superalloys at elevated temperatures, J. Mater. Sci. 51 (2016) 7843-7860.
S.K. Makineni, A. Samanta, T. Rojhirunsakool, T. Alam, B. Nithin, A.K. Singh, R. Banerjee, K. Chattopadhyay, A new class of high strength high temperature Cobalt based γ-γ' Co—Mo—Al alloys stabilized with Ta addition, Acta Mater. 97 (2015) 29-40.
S.K. Makineni, B. Nithin, K. Chattopadhyay, Synthesis of a new tungsten-free γ-γ' Cobalt-based superalloy by tuning alloying additions, Acta Mater. 85 (2015) 85-94.
C.H. Zenk, I. Povstugar, R. Li, F. Rinaldi, S. Neumeier, D. Raabe, M. Göken, A novel type of Co—Ti—Cr-base γ/γ' superalloys with low mass density, Acta Mater. 135 (2017) 244-251.
J.J. Ruan, C.P. Wang, C.C. Zhao, S.Y. Yang, T. Yang, X.J. Liu, Experimental investigation of phase equilibria and microstructure in the Co—Ti—V ternary system, Intermetallics. 49 (2014) 121-131.
S. Kirklin, J.E. Saal, V.I. Hegde, C. Wolverton, High-throughput computational search for strengthening precipitates in alloys, Acta Mater. 102 (2016) 125-135.
C. Nyshadham, C. Oses, J.E. Hansen, I. Takeuchi, S. Curtarolo, G.L.W. Hart, A computational high-throughput search for new ternary superalloys, Acta Mater. 122 (2017) 438-447.
B. Nithin, A. Samanta, S.K. Makineni, T. Alam, P. Pandey, A.K. Singh, R. Banerjee, K. Chattopadhyay, Effect of Cr addition on γ-γ' cobalt-based Co—Mo—Al—Ta class of superalloys: a combined experimental and computational study, J. Mater. Sci. 52 (2017) 11036-11047.
J.J. Ruan, C.P. Wang, S.Y. Yang, T. Omori, T. Yang, Y. Kimura, X.J. Liu, R. Kainuma, K. Ishida, Experimental Investigations of microstructures and phase equilibria in the Co—V—Ta ternary system, J. Alloys Compd. 664 (2016) 141-148.
C.P. Wang, S. Yang, S.Y. Yang, D. Wang, J.J. Ruan, J. Li, X.J. Liu, Experimental Investigation of the Phase Equilibria in the Co—Nb—V Ternary System, J. Phase Equilibria Diffus. 36 (2015) 592-598.
K. Shinagawa, hours. Chinen, T. Omori, K. Oikawa, I. Ohnuma, K. Ishida, R. Kainuma, Phase equilibria and thermodynamic calculation of the Co—Ta binary system, Intermetallics. 49 (2014) 87-97.
P.A. Carvalho, P.M. Bronsveld, B.J. Kooi, J.T.M. De Hosson, On the fcc → D0 19 transformation in Co—W alloys, Acta Mater. 50 (2002) 4511-4526.
D.J. Sauza, P.J. Bocchini, D.C. Dunand, D.N. Seidman, Influence of ruthenium on microstructural evolution in a model [Formula presented] superalloy, Acta Mater. 117 (2016) 135-145.
S. Meher, L.J. Carroll, T.M. Pollock, M.C. Carroll, Solute partitioning in multi-component γ/γ' Co—Ni-base superalloys with near-zero lattice misfit, Scr. Mater. 113 (2016) 185-189.
L.. Nagel, B. Fultz, Phase Equilibria of Co3V, J. Phase Equilibria. 18 (1997) 21-23.
E.A. Lass, M.E. Williams, C.E. Campbell, K.-W. Moon, U.R. Kattner, γ' Phase Stability and Phase Equilibrium in Ternary Co—Al—W at 900° C., J. Phase Equilibria Diffus. 35 (2014) 711-723.
S. Lee, K. Lee, T. Chuang, Discontinuous coarsening of discontinuous precipitates in a Co-6 at.% Mo alloy, Mater. Sci. Eng. A. 251 (1998) 135-141.
V. Ramaswamy, E.P. Butler, P.R. Swann, Direct observation of discontinuous precipitation in Al-28at%Zn, J. Microsc. 97 (1973) 259-268.
E.P. Butler, V. Ramaswamy, P.R. Swann, In Situ Observation of Cellular Precipitation in an Al-28 at % Zn Alloy by High Voltage Electron Microscopy, Acta Metall. 21 (1973) 517-524.
K.N. Braszczyńska-Malik, Discontinuous and continuous precipitation in magnesium-aluminium type alloys, J. Alloys Compd. 477 (2009) 870-876.
A. Bauer, S. Neumeier, F. Pyczak, M. Goken, Creep Strength and Microstructure of Polycrystalline Gamma Prime-Strengthened Cobalt-Base Superalloys, Superalloys 2012. (2012) 695-703.
H.Y. Yan, V.A. Vorontsov, D. Dye, Alloying effects in polycrystalline γ' strengthened Co—Al—W base alloys, Intermetallics. 48 (2014) 44-53.
J.D. Nystrom, T.M. Pollock, W.H. Murphy, A. Garg, Discontinuous cellular precipitation in a high-refractory nickel-base superalloy, Metall. Mater. Trans. A. 28 (1997) 2443-2452.
D. Turnbull, Theory of cellular precipitation, Acta Metall. 3 (1955) 55-63. doi:10.1016/0001-6160(55)90012-2.
F. Stein, D. Jiang, M. Palm, G. Sauthoff, D. Grüner, G. Kreiner, Experimental reinvestigation of the Co—Nb phase diagram, Intermetallics. 16 (2008) 785-792.
S. Kobayashi, Y. Tsukamoto, T. Takasugi, hours. Chinen, T. Omori, K. Ishida, S. Zaefferer, Determination of phase equilibria in the Co-rich Co—Al—W ternary system with a diffusion-couple technique, Intermetallics. 17 (2009) 1085-1089.
W. Huang, Y.A. Chang, A thermodynamic analysis of the Ni 瑕Al system, Intermetallics. 6 (1998) 487-498.
P.J. Bocchini, C.K. Sudbrack, R.D. Noebe, D.N. Seidman, Temporal Evolution of a Model Co—Al—W Superalloy Aged at 650° C. and 750° C., Acta Mater. 159 (2018) 197-208.

(56) References Cited

OTHER PUBLICATIONS

T.M. Pollock, S. Tin, Nickel-Based Superalloys for Advanced Turbine Engines: Chemistry, Microstructure and Properties, J. Propuls. Power. 22 (2006) 361-374.
K.E. Yoon, R.D. Noebe, D.N. Seidman, Effects of rhenium addition on the temporal evolution of the nanostructure and chemistry of a model Ni—Cr—Al superalloy . I: Experimental observations, Acta Mater. 55 (2007) 1145-1157.
P. Pandey, S.K. Makineni, A. Samanta, A. Sharma, S.M. Das, B. Nithin, C. Srivastava, A.K. Singh, D. Raabe, B. Gault, K. Chattopadhyay, Elemental site occupancy in the L12 A3B ordered intermetallic phase in Co-based superalloys and its influence on the microstructure, Acta Mater. (2018).
A. Tomaszewska, T. Mikuszewski, G. Moskal, D. Migas, Primary microstructure, microsegregation and precipitates characterization of an as-cast new type γ-γ' Co—Al—Mo—Nb cobalt-based superalloy, J. Alloys Compd. 750 (2018) 741-749.
E.A. Lass, D.J. Sauza, D.C. Dunand, D.N. Seidman, Multicomponent γ'-strengthened Co-based superalloys with increased solvus temperatures and reduced mass densities, Acta Mater. 147 (2018) 284-295.
H.J. Im, S.K. Makineni, B. Gault, F. Stein, D. Raabe, P.P. Choi, Elemental partitioning and site-occupancy in γ/γ' forming Co—Ti—Mo and Co—Ti—Cr alloys, Scr. Mater. 154 (2018) 159-162.
KIPO (ISR/KR), "International Search Report for PCT/US2019/033450", Korea, Aug. 23, 2019.
X.P. Tan, J.L. Liu, T. Jin, X.F. Sun, Z.Q. Hu, Influence of Cr addition on microstructure of a 5% Re-containing single crystal nickel-based superalloy, Trans. Nonferrous Met. Soc. China (English Ed. 21 (2011) 1004-1008.
N.S. Patel, V. Pavlík, M. Boča, High-Temperature Corrosion Behavior of Superalloys in Molten Salts—A Review, Crit. Rev. Solid State Mater. Sci. 42 (2017) 83-97.
W.W. Xu, S.L. Shang, C.P. Wang, T.Q. Gang, Y.F. Huang, L.J. Chen, X.J. Liu, Z.K. Liu, Accelerating exploitation of Co—Al-based superalloys from theoretical study, Mater. Des. 142 (2018) 139-148.
W.Y. Wang, F. Xue, Y. Zhang, S.L. Shang, Y. Wang, K.A. Darling, L.J. Kecskes, J. Li, X. Hui, Q. Feng, Z.K. Liu, Atomic and electronic basis for solutes strengthened (010) anti-phase boundary of L12Co3(Al, Tm): A comprehensive first-principles study, Acta Mater. 145 (2018) 30-40.
F.L. Reyes Tirado, J. Perrin Toinin, D.C. Dunand, γ+γ' microstructures in the Co—Ta—V and Co—Nb—V ternary systems, Acta Mater. 151 (2018) 137-148.
L. Wang, M. Oehring, Y. Liu, U. Lorenz, F. Pyczak, Site occupancy of alloying elements in the L12 structure determined by channeling enhanced microanalysis in γ/γ' Co—9Al—9W—2X alloys, Acta Mater. 162 (2019) 176-188.
I. Povstugar, P.-P. Choi, S. Neumeier, A. Bauer, C.H. Zenk, M. Göken, D. Raabe, Elemental partitioning and mechanical properties of Ti- and Ta-containing Co—Al—W-base superalloys studied by atom probe tomography and nanoindentation, Acta Mater. 78 (2014) 78-85.
F. Xue, hours.J. Zhou, X.F. Ding, M.L. Wang, Q. Feng, Improved high temperature γ' stability of Co—Al—W-base alloys containing Ti and Ta, Mater. Lett. 112 (2013) 215-218.
C.H. Zenk, S. Neumeier, hours.J. Stone, M. Göken, Mechanical properties and lattice misfit of γ/γ' strengthened Co-base superalloys in the Co—W—Al—Ti quaternary system, Intermetallics. 55 (2014) 28-39. doi:10.1016/J.INTERMET.2014.07.006.
S. Meher, hours.-Y. Yan, S. Nag, D. Dye, R. Banerjee, Solute partitioning and site preference in γ/γ' cobalt-base alloys, Scr. Mater. 67 (2012) 850-853.
M. Kolb, L.P. Freund, F. Fischer, I. Povstugar, S.K. Makineni, B. Gault, D. Raabe, J. Müller, E. Spiecker, S. Neumeier, M. Göken, On the grain boundary strengthening effect of boron in γ/γ' Cobalt-base superalloys, Acta Mater. 145 (2018) 247-254.
M. Jin, N. Miao, W. Zhao, J. Zhou, Q. Du, Z. Sun, Structural stability and mechanical properties of Co3(Al, M) (M=Ti, V, Cr, Zr, Nb, Mo, Hf, Ta, W) compounds, Comput. Mater. Sci. 148 (2018) 27-37. doi:10.1016/J.COMMATSCI.2018.02.015.
I. Povstugar, C.H. Zenk, R. Li, P.-P. Choi, S. Neumeier, O. Dolotko, M. Hoelzel, M. Göken, D. Raabe, Elemental partitioning, lattice misfit and creep behaviour of Cr containing γ ' strengthened Co base superalloys, Mater. Sci. Technol. 32 (2016) 220-225.
M. Kolb, C.H. Zenk, A. Kirzinger, I. Povstugar, D. Raabe, S. Neumeier, M. Göken, Influence of rhenium on c9-strengthened cobalt-base superalloys, (2018).
Q. Liu, J. Coakley, D.N. Seidman, D.C. Dunand, Precipitate Evolution and Creep Behavior of a W-Free Co-based Superalloy, Metall. Mater. Trans. A. 47 (2016) 6090-6096.
Y. Li, F. Pyczak, J. Paul, M. Oehring, U. Lorenz, Z. Yao, Y. Ning, Rafting of γ' precipitates in a Co—9Al—9W superalloy during compressive creep, Mater. Sci. Eng. A. 719 (2018) 43-48.
F. Pyczak, A. Bauer, M. Göken, S. Neumeier, U. Lorenz, M. Oehring, N. Schell, A. Schreyer, A. Stark, F. Symanzik, Plastic deformation mechanisms in a crept L12 hardened Co-base superalloy, Mater. Sci. Eng. A. 571 (2013) 13-18.
Y. Li, F. Pyczak, J. Paul, M. Oehring, U. Lorenz, Z. Yao, Microstructure evolution in L12 hardened Co-base superalloys during creep, J. Mater. Res. 32 (2017) 4522-4530.
T. Murakumo, T. Kobayashi, Y. Koizumi, hours. Harada, Creep behaviour of Ni-base single-crystal superalloys with various γ' volume fraction, Acta Mater. 52 (2004) 3737-3744.

Co-10Ni-8Cr-5Al-3Nb-3V-2Ti-0.04B
Co-10Ni-4Cr-5Al-3Nb-3V-2Ti-0.04B
Co-10Ni-5Al-3Nb-3V-2Ti-0.04B
Co-10Ni-5Al-3Ta-3V-2Ti-0.04B
Co-10Ni-4Cr-5Al-3Ta-3V-2Ti-0.04B
977
1008
953
965
965
8.07
8.14
8.21
8.59
8.52
850
900
950
1000
1050
Solvus Temperature (°C)
7.00
8.00
9.00
10.00
Theoretical Density(g/cm3)

FIG. 40A
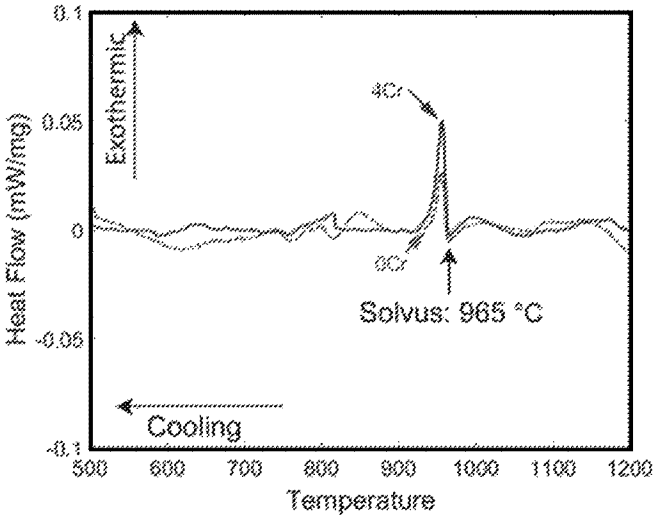
FIG. 40B
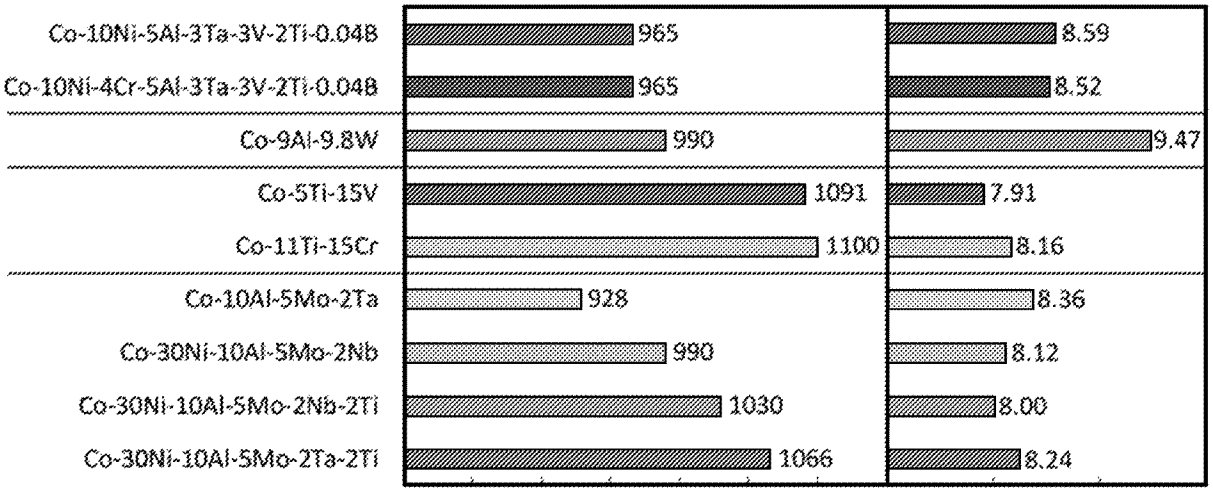
FIG. 40C

COBALT-BASED SUPERALLOYS WITH STABLE GAMMA-PRIME PRECIPITATES, METHOD OF PRODUCING SAME

CROSS-REFERENCE TO RELATED PATENT APPLICATION

This application claims priority to and the benefit of, pursuant to 35 U.S.C. § 119(e), of U.S. Provisional Patent Application Ser. No. 62/674,780, filed May 22, 2018, entitled "TUNGSTEN-FREE, LOW-DENSITY COBALT-BASED SUPERALLOYS WITH GAMMA PRIME PRECIPITATES, BASED ON CO—TA—V—AL AND CO—NB—V—AL SYSTEMS", by David C. Dunand and Fernando L. Reyes Tirado, which is incorporated herein by reference in its entirety.

Some references, which may include patents, patent applications and various publications, are cited in a reference list and discussed in the description of this invention. The citation and/or discussion of such references is provided merely to clarify the description of the invention and is not an admission that any such reference is "prior art" to the invention described herein. All references cited and discussed in this specification are incorporated herein by reference in their entireties and to the same extent as if each reference was individually incorporated by reference. In terms of notation, hereinafter, "[n]" represents the nth reference cited in the reference list. For example, [61] represents the 61th reference cited in the reference list, namely, F. L. Reyes Tirado, J. Perrin Toinin, D. C. Dunand, γ+γ' microstructures in the Co—Ta—V and Co—Nb—V ternary systems, Acta Mater. 151 (2018) 137-148.

STATEMENT AS TO RIGHTS UNDER FEDERALLY-SPONSORED RESEARCH

This invention was made with government support under 70NANB14H012 awarded by the National Institute of Standards and Technology. The government has certain rights in the invention.

FIELD OF THE INVENTION

The invention relates generally to Materials science and engineering, metallurgy, and more particularly, to tungsten-free, low-density cobalt-based superalloys with stable γ' (gamma-prime) precipitates, based on Co—Ta—V—Al and Co—Nb—V—Al systems, and method of producing the same.

BACKGROUND OF THE INVENTION

The background description provided herein is for the purpose of generally presenting the context of the invention. The subject matter discussed in the background of the invention section should not be assumed to be prior art merely as a result of its mention in the background of the invention section. Similarly, a problem mentioned in the background of the invention section or associated with the subject matter of the background of the invention section should not be assumed to have been previously recognized in the prior art. The subject matter in the background of the invention section merely represents different approaches, which in and of themselves may also be inventions. Work of the presently named inventors, to the extent it is described in the background of the invention section, as well as aspects of the description that may not otherwise qualify as prior art at the time of filing, are neither expressly nor impliedly admitted as prior art against the invention.

To date, Ni-based superalloys based on the Ni—Al—Cr system are the preferred material for high-stress and high-temperature applications, such as turbine blades or disks, in both jet- and land-based turbines [44-46]. The high strength and creep resistance exhibited by these alloys stems from their γ+γ' (gamma+gamma-prime) microstructure where the fcc-γ Ni matrix is strengthened with $L1_2$-ordered γ' $Ni_3(Al, Ti)$ precipitates which are typically submicron to micron in size. State-of-the-art Ni-based superalloys contain upwards of ten additional alloying elements [44, 47, 48] which provide a variety of benefits: higher melting temperatures, solid-solution strengthening in both γ and γ' phases, grain-boundary strengthening, γ'-coarsening resistance, as well as oxidation and corrosion resistance. In particular, much research has focused on the addition of refractory elements to provide solid-solution strengthening of the γ-matrix and γ'-precipitates (thus increasing resistance against dislocation slip in both phases) and to reduce diffusion-controlled process (thus slowing precipitate coarsening and dislocation climb in both phases). However, when added in excess, these elements form additional intermetallic phases which are detrimental to mechanical properties [1, 4, 6, 7]. An alternative to Ni-based superalloys, to achieve higher operating temperatures, are cobalt-based alloys which rely on the higher melting point of Co as compared to Ni (1495 vs. 1455° C.). Co-based alloy strengthened via carbide precipitation are widely used in low-stress, corrosive environments at elevated temperature. These alloys do not exhibit γ' precipitates and are thus less strong and creep-resistant than γ+γ' Ni-based superalloys [5-8]. However, Sato et al. [10] in 2006 discovered a new family of Co-base superalloys with a γ+γ' microstructure analogous to that of Ni-based superalloy. These new superalloys, based on the Co—Al—W ternary system and containing coherent γ'-$Co_3(Al,W)$ precipitates, have high potential to surpass the performance of Ni-based superalloys. Some of the best Co—Al—W-based superalloys, with multiple alloying additions on par with commercial Ni-base superalloys, show high solidus and liquidus temperatures (50-150° C. greater than those of Ni-based superalloys) [7, 9], as well as high γ' volume fractions (up to about 80%) and creep resistance comparable to Ni-based superalloys. However, some weaknesses of the Co—Al—W system that limit their potential are: (i) low solvus temperature of the γ'-phase (about 980° C.) [10, 13], and (ii) a high density (more than 9.0 g $cm^{-3}$) due to their high W content [9]. Given the high density of Co—Al—W-based superalloys, there is strong interest in developing W-free Co-based superalloys. In 2015, Makineni et al. [16-19] demonstrated that Co-10Al-5Mo-2X (X=Nb and Ta) alloys show γ+γ' structure, with a γ' composition of $Co_3(Al, Mo,Nb)$ [16, 19] and $Co_3(Al,Mo,Nb)$ [18], markedly different from $Co_3(Al,W)$ in the previous alloys. These authors demonstrated that up to 30 at. % Ni can be added to replace Co. raising the solvus temperature from about 860 to about 950° C. in the Co(—Ni)—Al—Mo—Nb alloys. In modified alloys containing Ta, the solvus temperatures are about 920° C. and increase to about 1070° C. with Ni and Ti additions [18]. Initial studies suggested that the γ' phase is stable at 800-900° C. for short aging times [19], however, after longer aging times, cellular and needle-like precipitation of the $D0_{19}$ phase are seen in these Co(—Ni)—Al—Mo—Nb alloys after 35 hours of aging at 800-950° C. The only alloy that did not seem to precipitate any Topologically Close Packed (TCP) phases after 100 hours of aging at 950° C. contains Ti, i.e., Co-30Ni-10Al-5Mo-2Nb-2Ti [17]. Since their discovery in 2015, these Co-based W-free superalloys have been the object of numerous investigation, since they could serve as a low-density alternative to W-bearing Co—Al—W-based superalloys [24, 51-53].

Other ternary Co-based systems have been recently identified to exhibit $L1_2$-ordered γ' precipitates, e.g., Co—G—W [2], Co—Ti—Cr [20, 54], Co—Ti—Mo and Co—Ti—V [6, 21]. Co—Ge—W is a derivative from Co—Al—W (where Al is replaced by Ge) while the other three ternary systems are derivatives from the Co—Ti binary alloy that displays stable $L1_2$-ordered γ' precipitates [54], where Ti is partially replaced by Cr, Mo or V, respectively. However, these alloys do not contain Al or (for the last two alloys) Cr, which are crucial for corrosion and oxidation resistance [44, 47, 49] and may also stabilize the γ' phase [17, 20, 24, 51, 55]. Also, the last alloy system, Co—Ti—V, contains very high amount of V, which could be compromise hot corrosion resistance [56].

In the quest for new Co-based superalloy systems, computational studies implementing density functional theory (DFT) calculations and ThermoCalc/CALPHAD, coupled with experimental studies, are becoming increasingly capable to accelerate the discovery of new ternary systems and improve current alloys [12, 18, 19, 24, 22, 23, 57, 58]. Recently, Nyshadham et al. predicted the formation of stable γ'-$L1_2$ $Co_3(Nb_{0.5}V_{0.5})$ and $Co_3(Ta_{0.5}V_{0.5})$ precipitates in equilibrium with a γ-fcc Co—Nb—V/Ta matrix. These γ'-phases were not previously reported in the literature existing for the Co—Ta—V and Co—Nb—V systems. These two systems were studied by Ruan et al. and Wang et al. [60], respectively, who do not report the presence of a γ'-phase.

We experimentally explored alloys in the Co-rich corner of the ternary Co—Ta—V and Co—Nb—V systems [61]. We observed fine γ' cuboidal precipitates with $Co_3(Ta_{0.76}V_{0.24})$ and $Co_3(Nb_{0.81}V_{0.19})$ composition in both systems which however were metastable, decomposing to: (i) C36 in the Co—Ta—V system and (ii) needle-like $D0_{19}$ in the Co—Nb—V system [61]. This metastability explains why Ruan et al. and Wang et al. did not observe these γ'-phases, since they used very long aging times to study equilibrium phases. This shows that these ternary γ' phases are metastable and points to the need for their stabilization via additional alloying elements.

Therefore, a heretofore unaddressed need exists in the art to address the aforementioned deficiencies and inadequacies.

SUMMARY OF THE INVENTION

In one aspect, the invention relates to a cobalt based superalloy. In one embodiment, the superalloy includes a nominal composition comprising at least cobalt (Co), aluminum (Al), Z and vanadium (V), Z being at least one of tantalum (Ta) and niobium (Nb), which is processed such that the superalloy comprises γ and γ' phases with stable γ+γ' microstructures.

In certain embodiments, the nominal composition comprises one of

Co-$a_1$Ni-$b_1$Al-$c_1$Ti-$d_1$Ta-$f_1$V-$g_1$B-$h_1$Cr, wherein $a_1$ is in a range of about 040 at. %, $b_1$ is in a range of about 2.5-10 at. %, $c_1$ is in a range of about 0-4 at. %, $d_1$ is in a range of about 2-4 at. %, $f_1$ is in a range of about 1.5-6 at. %, $g_1$ is in a range of about 0-1 at. %, $h_1$ is in a range of about 0-20 at. %, and Co is in balance;

Co-$a_2$Ni-$b_2$Al-$c_2$Ti-$e_2$Nb-$f_2$V-$g_2$B-$h_2$Cr, wherein $a_2$ is in a range of about 0-40 at. %, $b_2$ is in a range of about 2.5-10 at. %, $c_2$ is in a range of about 0-4 at. %, $e_2$ is in a range of about 2-4 at. %, $f_2$ is in a range of about 1.5-6 at. %, $g_2$ is in a range of about 0-1 at. %, $h_2$ is in a range of about 0-20 at. %, and Co is in balance; and Co-$a_3$Ni-$b_3$Al-$c_3$Ti-$d_3$Ta-$e_3$Nb-$f_3$V-$g_3$B-$h_3$Cr, wherein $a_3$ is in a range of about 0-40 at. %, $b_3$ is in a range of about 2.5-10 at. %, $c_3$ is in a range of about 0-4 at. %, $d_3$ is in a range of about 2-4 at. %, $e_3$ is in a range of about 2-4 at. %, $f_3$ is in a range of about 1.5-6 at. %, $g_3$ is in a range of about 0-1 at. %, $h_3$ is in a range of about 0-20 at. %, and Co is in balance.

In certain embodiments, the nominal composition comprises one of Co-5Al-1Ti-3Ta-3V; Co-6Al-3Ta-3V; Co-2.5Ni-5Al-1Ti-3Ta-3V; Co-2.5Ni-6Al-3Ta-3V; Co-10Ni-5Al-2Ti-3Ta-3V-0.04B; Co-10Ni-5Al-2Ti-3Ta-3V-0.04B-5Cr; Co-6Al-3Nb-3V; Co-5Al-1Ti-3Nb-3V; Co-10Ni-5Al-2Ti-3Nb-3V-0.04B; Co-10Ni-5Al-2Ti-3Nb-3V-0.04B-4Cr; Co-10Ni-5Al-2Ti-3Nb-3V-0.04B-8Cr; Co-10Ni-5Al-2Ti-3Nb-3V-0.04B-10Cr; Co-10Ni-7.5Al-3Ti-4.5Nb-4.5V-0.04B-4Cr; Co-10Ni-5Al-2Ti-1.5Ta-1.5Nb-3V-0.04B-4Cr; and Co-20Ni-5Al-2Ti-1.5Ta-1.5Nb-3V-0.04B-4Cr.

In certain embodiments, the nominal composition comprises Co-10Ni-5Al-2Ti-3Ta-3V-0.04B, and the γ'-nanoprecipitates have a composition of $(Co_{0.83}Ni_{0.17})_3(Ta_{0.42}Al_{0.23}Ti_{0.19}V_{0.15}B_{0.01})$.

In certain embodiments, the nominal composition further comprises less than 2 at. % of Mo and/or W.

In certain embodiments, the nominal composition further comprises one or more of C, O, Mn, Y, Fe, Si, B, Zr, Hf, Ru and Re.

In certain embodiments, the γ+γ' microstructures are stable up to 1500 hours at a temperature of about 600-1100° C.

In certain embodiments, the γ' phase is presented near grain boundaries with or without carbide and/or borides phases, beneficial for creep resistance.

In certain embodiments, less than 5 vol. % of other deleterious phases or no other deleterious phases other than the γ, γ' carbide and/or borides phases are formed in the superalloy.

In certain embodiments, the superalloy is a tungsten-free and/or molybdenum-free cobalt based superalloy.

In another aspect, the invention relates to a method for producing a cobalt based superalloy. In one embodiment, the method includes providing a nominal composition comprising at least cobalt (Co), aluminum (Al), Z and vanadium (V), Z being at least one of tantalum (Ta) and niobium (Nb); and arc-melting the nominal composition under a partial Ar atmosphere to obtain an ingot; homogenizing the ingot at a first temperature for a first period of time, followed by water quenching; and performing aging heat treatment of the homogenized ingot at a second temperature for a second period of time, followed by water quenching, to form the cobalt-based superalloy that comprises γ and γ' phases with stable γ+γ' microstructures.

In certain embodiments, the ingots is melted a number of times under the partial Ar atmosphere and flipped between each melting cycle to improve homogeneity.

In certain embodiments, the method, prior to homogenizing the ingot, further comprises vacuum-encapsulating the ingot in a quartz ampoule.

In certain embodiments, the method, prior to performing aging heat treatment, further comprises vacuum-encapsulating the homogenized ingot in a quartz ampoule.

In certain embodiments, the first temperature is in a range of 900-1500° C., and the first period of time is in a range of 1-60 hours.

In certain embodiments, the second temperature is in a range of 600-1100° C., and the second period of time is in a range of 1-1500 hours.

In certain embodiments, the nominal composition comprises one of

Co-$a_1$Ni-$b_1$Al-$c_1$Ti-$d_1$Ta-$f_1$V-$g_1$B-$h_1$Cr, wherein $a_1$ is in a range of about 0-40 at. %, $b_1$ is in a range of about 2.5-10 at. %, $c_1$ is in a range of about 0-4 at. %, $d_1$ is in a range of about 2-4 at. %, $f_1$ is in a range of about 1.5-6 at. %, $g_1$ is in a range of about 0-1 at. %, $h_1$ is in a range of about 0-20 at. %, and Co is in balance;

Co-$a_2$Ni-$b_2$Al-$c_2$Ti-$e_2$Nb-$f_2$V-$g_2$B-$h_2$Cr, wherein $a_2$ is in a range of about 0-40 at. %, $b_2$ is in a range of about 2.5-10 at. %, $c_2$ is in a range of about 0-4 at. %, $e_2$ is in a range of about 2-4 at. %, $f_2$ is in a range of about 1.5-6 at. %, $g_2$ is in a range of about 0-1 at. %, $h_2$ is in a range of about 0-20 at. %, and Co is in balance; and Co-$a_3$Ni-$b_3$Al-$c_3$Ti-$d_3$Ta-$e_3$Nb-$f_3$V-$g_3$B-$h_3$Cr, wherein $a_3$ is in a range of about 0-40 at. %, $b_3$ is in a range of about 2.5-10 at. %, $c_3$ is in a range of about 0-4 at. %, $d_3$ is in a range of about 2-4 at. %, $e_3$ is in a range of about 2-4 at. %, $f_3$ is in a range of about 1.5-6 at. %, $g_3$ is in a range of about 0-1 at. %, $h_3$ is in a range of about 0-20 at. %, and Co is in balance.

In certain embodiments, the nominal composition comprises one of Co-5Al-1Ti-3Ta-3V; Co-6Al-3Ta-3V; Co-2.5Ni-5Al-1Ti-3Ta-3V; Co-2.5Ni-6Al-3Ta-3V; Co-10Ni-5Al-2Ti-3Ta-3V-0.04B; Co-10Ni-5Al-2Ti-3Ta-3V-0.04B-5Cr; Co-6Al-3Nb-3V; Co-5Al-1Ti-3Nb-3V; Co-10Ni-5Al-2Ti-3Nb-3V-0.04B; Co-10Ni-5Al-2Ti-3Nb-3V-0.04B-4Cr; Co-10Ni-5Al-2Ti-3Nb-3V-0.04B-8Cr; Co-10Ni-5Al-2Ti-3Nb-3V-0.04B-10Cr; Co-10Ni-7.5Al-3Ti-4.5Nb-4.5V-0.04B-4Cr; Co-10Ni-5Al-2Ti-1.5Ta-1.5Nb-3V-0.04B-4Cr; and Co-20Ni-5Al-2Ti-1.5Ta-1.5Nb-3V-0.04B-4Cr.

In certain embodiments, the nominal composition comprises Co-10Ni-5Al-2Ti-3Ta-3V-0.04B, and the γ'-nanoprecipitates have a composition of $(Co_{0.83}Ni_{0.17})_3(Ta_{0.42}Al_{0.23}Ti_{0.19}V_{0.15}B_{0.01})$.

In certain embodiments, the nominal composition further comprises less than 2 at. % of Mo and/or W.

In certain embodiments, the nominal composition further comprises one or more of C, O, Mn, Y, Fe, Si, B, Zr, Hf, Ru and Re.

In certain embodiments, each element of the nominal composition has a purity of about 99.99%.

In certain embodiments, the γ+γ' microstructures are stable up to 1500 hours at a temperature of about 600-1100° C.

In certain embodiments, the γ' phase is presented near grain boundaries with or without carbide and/or borides phases, beneficial for creep resistance.

In certain embodiments, less than 5 vol. % of other deleterious phases or no other deleterious phases other than the γ, γ' carbide and/or borides phases are formed in the superalloy.

In certain embodiments, the superalloy is a tungsten-free and/or molybdenum-free cobalt based superalloy.

These and other aspects of the invention will become apparent from the following description of the preferred embodiment taken in conjunction with the following drawings, although variations and modifications therein may be affected without departing from the spirit and scope of the novel concepts of the invention.

BRIEF DESCRIPTION OF THE DRAWINGS

The following drawings form part of the present specification and are included to further demonstrate certain aspects of the invention. The invention may be better understood by reference to one or more of these drawings in combination with the detailed description of specific embodiments presented herein. The drawings described below are for illustration purposes only. The drawings are not intended to limit the scope of the present teachings in any way.

FIG. 24A shows APT three-dimensional reconstruction including 115 million atoms, and FIG. 24B shows concentration profile, across 8 γ/γ' interfaces measured along the arrow shown in FIG. 24A.

FIG. 25A shows APT three-dimensional reconstruction including 5 million atoms, and FIG. 25B shows proximity histogram, averaged among global composition of the two γ' precipitates present in the tip.

FIG. 26A shows APT three-dimensional reconstruction including 60 million atoms, and FIG. 26B shows proximity histogram corresponding to the interface shown in the APT reconstruction shown in FIG. 26A, measured from left to right.

FIGS. 40A-40C show respectively DSC solvus curve, solvus temperatures, and theoretical density for Co-10Ni-5Al-xCr-3Ta-3V-2Ti-0.04B (x=0 and 4) alloys, and Co-9Al-9W and 6 W-free Co-based superalloys from literature, according to embodiments of the invention.

DETAILED DESCRIPTION OF THE INVENTION

Figure 1:
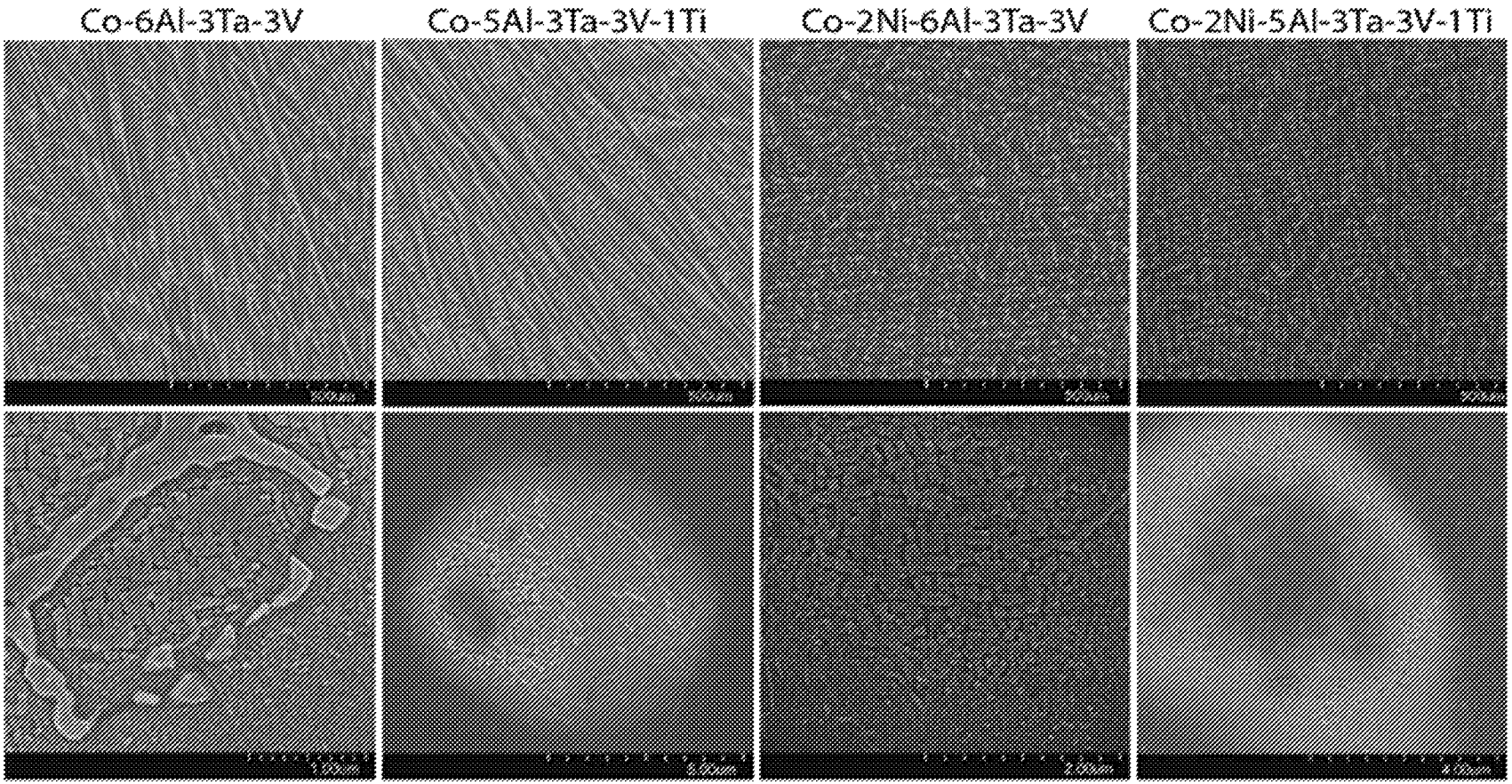
FIG. 1 shows dendritic microstructures in as arc-melted tantalum containing alloys (top row) and γ' precipitates as seen in the interdendritic regions (bottom row), according to embodiments of the invention.

The present invention will now be described more fully hereinafter with reference to the accompanying drawings, in which exemplary embodiments of the present invention are shown. The present invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. For convenience, certain terms may be highlighted, for example using italics and/or quotation marks. The use of highlighting and/or capital letters has no influence on the scope and meaning of a term; the scope and meaning of a term are the same, in the same context, whether or not it is highlighted and/or in capital letters. It will be appreciated that the same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification, including examples of any terms discussed herein, is illustrative only and in no way limits the scope and meaning of the invention or of any exemplified term. Likewise, the invention is not limited to various embodiments given in this specification.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below can be termed a second element, component, region, layer or section without departing from the teachings of the present invention.

It will be understood that, as used in the description herein and throughout the claims that follow, the meaning of "a", "an", and "the" includes plural reference unless the context clearly dictates otherwise. Also, it will be understood that when an element is referred to as being "on," "attached" to, "connected" to, "coupled" with, "contacting." etc., another element, it can be directly on, attached to, connected to, coupled with or contacting the other element or intervening elements may also be present. In contrast, when an element is referred to as being, for example, "directly on." "directly attached" to, "directly connected" to, "directly coupled" with or "directly contacting" another element, there are no intervening elements present. It will also be appreciated by those of skill in the art that references to a structure or feature that is disposed "adjacent" to another feature may have portions that overlap or underlie the adjacent feature.

It will be further understood that the terms "comprises" and/or "comprising," or "includes" and/or "including" or "has" and/or "having" when used in this specification specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the figures. It will be understood that relative terms are intended to encompass different orientations of the device in addition to the orientation shown in the figures. For example, if the device in one of the figures is turned over, elements described as being on the "lower" side of other elements would then be oriented on the "upper" sides of the other elements. The exemplary term "lower" can, therefore, encompass both an orientation of lower and upper, depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used in this disclosure, "around", "about", "approximately" or "substantially" shall generally mean within 20 percent, preferably within 10 percent, and more preferably within 5 percent of a given value or range. Numerical quantities given herein are approximate, meaning that the term "around", "about", "approximately" or "substantially" can be inferred if not expressly stated.

As used in this disclosure, the phrase "at least one of A, B, and C" should be construed to mean a logical (A or B or C), using a non-exclusive logical OR. As used herein, the term "and/or" includes any and all combinations of one or more of the associated listed items.

Embodiments of the invention are illustrated in detail hereinafter with reference to accompanying drawings. The description below is merely illustrative in nature and is in no way intended to limit the invention, its application, or uses. The broad teachings of the invention can be implemented in a variety of forms. Therefore, while this invention includes particular examples, the true scope of the invention should not be so limited since other modifications will become apparent upon a study of the drawings, the specification, and the following claims. For purposes of clarity, the same reference numbers will be used in the drawings to identify similar elements. It should be understood that one or more steps within a method may be executed in different order (or concurrently) without altering the principles of the invention.

We have recently found metastable γ-γ' microstructures in the Co—Ta—V and Co—Nb—V systems, where γ' precipitates are seen after short aging times of 2 hours, but they coarsen, lose their cuboidal shape, dissolve and are consumed by other deleterious phases at longer aging times, due to their metastable nature. Therefore, there is the need to achieve a stable γ' phase in the Co—Ta—V and Co—Nb—V ternary systems.

In certain aspects, the invention discloses new families of tungsten-free, and/or molybdenum-free cobalt based superalloys with stable γ' strengthening precipitates without formation of deleterious other phases, based on the Co—Ta—V and Co—Nb—V ternary systems by utilizing additions of aluminum (Al) and optionally titanium (Ti) to stabilize the γ' phase in these ternary compositions while avoiding prior art where tungsten (W) and molybdenum (Mo) are used, or where very high V contents are used or where Al is missing. It is noted that, in future derivative alloys based on the ones disclosed in the disclosure, it might be desirable to add again small amounts of W and/or Mo, but not at the high levels found in prior art.

Additionally, in certain embodiments, nickel (Ni) is used to expand the γ' phase field while boron (B) is added to provide solid solution and grain boundary strengthening. Chromium (Cr) is added to improve the corrosion resistance of the alloys and boron to strengthen grain boundaries, with both also providing solid solution strengthening. Alloys are arc-melted from high purity elements (Co, Ni, Al. Ta, Nb. V. Ti, Cr and B) under a partial Ar atmosphere, and then subjected to a solution heat treatment to obtain a homogeneous composition and to dissolve any phases formed during solidification/cooling. Millimeter size sections of the ingots are aged at elevated temperatures to precipitate the γ' strengthening phase.

Furthermore, in certain embodiments, many other elements can be added to the new families of alloys, e.g., small quantities (<2 at. %) of Mo and/or W, as well as C, O, Mn, Y, Fe, Si, B. Zr. Hf, Ru, Re, etc., for oxidation-, corrosion-, coarsening-, fracture-, fatigue- and deformation resistance, as well as improved processability (e.g., casting and thermomechanical processing).

According to the invention, one family of the cobalt based superalloys is Co—Al—Ta—V-based alloys, where Ti, Cr and Ni can be further added. In one embodiment, a single-phases Co-based solid-solution (γ phase) is achieved after homogenization at about 1200-1300° C. After 1000 hours of aging at a temperature of about 850° C., the matrix only contain γ' precipitates showing (a) fine cuboidal structure within γ grains and (b) coarsened structure at the γ grain boundaries (GB); no other deleterious phases are observed after homogenization and/or aging.

Another family of the cobalt based superalloys is Co—Al—Nb—V—Ti based-alloys with Ni and Cr additions. In one embodiments, a single phase γ Co-based solid solution is achieved at 1200-1300° C., while the γ' phase is seen near the GBs for Cr containing alloys. After one week of aging at about 850° C., a γ-γ' microstructure is achieved with no other detrimental phases. Boron (0.01-1 at. %) is added for solid solution strengthening and GB strengthening. Chromium (Cr) and aluminum (Al) are added for oxidation and corrosion resistance, as well as precipitation and solid solution strengthening.

Yet another family of the cobalt based superalloys is a hybrid alloy containing both Ta and Nb, rather than one or the other, e.g., Co-20Ni-5Al-4Cr-3V-2Ti-1.5Nb-1.5Ta-0.08B. In one embodiment, the hybrid alloy shows single-phase γ Co-based solid-solution after homogenization, and γ' precipitates after aging, with no other deleterious phases.

Generally, according to the invention, the cobalt based superalloy includes a nominal composition comprising at least Co, Al, Z and V, Z being at least one of Ta and Nb, which is processed such that the superalloy comprises γ and γ' phases with stable γ+γ' microstructures.

In certain embodiments, for the Co—Al—Ta—V-based alloys, the nominal composition comprises Co-$a_1$Ni-$b_1$Al-$c_1$Ti-$d_1$Ta-$f_1$V-$g_1$B-$h_1$Cr, where $a_1$ is in a range of about 0-40 at. %, $b_1$ is in a range of about 2.5-10 at. %, $c_1$ is in a range of about 0-4 at. %, $d_1$ is in a range of about 2-4 at. %, $f_1$ is in a range of about 1.5-6 at. %, $g_1$ is in a range of about 0-0.1 at. %, $h_1$ is in a range of about 0-20 at. %, and Co is in balance. In certain embodiments, the nominal composition comprises one of Co-5Al-1Ti-3Ta-3V, Co-6Al-3Ta-3V. Co-2.5Ni-5Al-1Ti-3Ta-3V, Co-2.5Ni-6Al-3Ta-3V, Co-10Ni-5Al-2Ti-3Ta-3V-0.04B, and Co-10Ni-5Al-2Ti-3Ta-3V-0.04B-5Cr, which are listed in Table 1 as 11, 12, 13, 14, NT1 and NT2, respectively.

In one embodiment, when the nominal composition comprises Co-10Ni-5Al-2Ti-3Ta-3V-0.04B, the γ'-nanoprecipitates in the cobalt based superalloy have a composition of $(Co_{0.83}Ni_{0.17})_3(Ta_{0.42}Al_{0.23}Ti_{0.19}V_{0.15}B_{0.01})$.

In certain embodiments, for the Co—Al—Nb—V—Ti based-alloys, the nominal composition comprises Co-$a_2$Ni-$b_2$Al-$c_2$Ti-$e_2$Nb-$f_2$V-$g_2$B-$h_2$Cr, where $a_2$ is in a range of about 0-40 at. %, $b_2$ is in a range of about 2.5-10 at. %, $c_2$ is in a range of about 0-4 at. %, $e_2$ is in a range of about 2-4 at. %, $f_2$ is in a range of about 1.5-6 at. %, $g_2$ is in a range of about 0-0.1 at. %, $h_2$ is in a range of about 0-20 at. %, and Co is in balance. In certain embodiments, the nominal composition comprises one of Co-6Al-3Nb-3V, Co-5Al-1Ti-3Nb-3V, Co-10Ni-5Al-2Ti-3Nb-3V-0.04B, Co-10Ni-5Al-2Ti-3Nb-3V-0.04B-4Cr, Co-10Ni-5Al-2Ti-3Nb-3V-0.04B-8Cr, Co-10Ni-5Al-2Ti-3Nb-3V-0.04B-10Cr, and Co-10Ni-7.5Al-3Ti-4.5Nb-4.5V-0.04B-4Cr, which are listed in Table 1 as NN1, NN2, NN3, NN4, NN5, NN6 and NN7, respectively.

In certain embodiments, for the hybrid alloy containing both Ta and Nb, the nominal composition comprises Co-$a_3$Ni-$b_3$Al-$c_3$Ti-$d_3$Ta-$e_3$Nb-$f_3$V-$g_3$B-$h_3$Cr, where $a_3$ is in a range of about 0-40 at. %, $b_3$ is in a range of about 2.5-10 at. %, $c_3$ is in a range of about 0-4 at. %, $d_3$ is in a range of about 2-4 at. %, $e_3$ is in a range of about 2-4 at. %, $f_3$ is in a range of about 1.5-6 at. %, $g_3$ is in a range of about 0-0.1 at. %, $h_3$ is in a range of about 0-20 at. %, and Co is in balance. In certain embodiments, the nominal composition comprises one of Co-10Ni-5Al-2Ti-1.5Ta-1.5Nb-3V-0.04B-4Cr, and Co-20Ni-5Al-2Ti-1.5Ta-1.5Nb-3V-0.04B-4Cr, which are listed in Table 1 as BNT10 and BNT20, respectively.

In certain embodiments, the nominal composition further comprises less than 2 at. % of Mo and/or W. In certain embodiments, the nominal composition may also include one or more of C, O, Mn, Y, Fe, Si, B, Zr, Hf, Ru and Re.

TABLE 1

Alloy list with elemental compositions in at. %

| Group | ID | Co | Ni | Al | Ti | Nb | Ta | V | B | Cr |
|---|---|---|---|---|---|---|---|---|---|---|
| Co-Ta-V | I1 | 88 | — | 5 | 1 | — | 3 | 3 | — | — |
| | I2 | 88 | — | 6 | — | — | 3 | 3 | — | — |
| | I3 | 86 | 2.5 | 5 | 1 | — | 3 | 3 | — | — |
| | I4 | 86 | 2.5 | 6 | — | — | 3 | 3 | — | — |
| | NT1 | 77 | 10 | 5 | 2 | — | 3 | 3 | 0.04 | — |
| | NT2 | 73 | 10 | 5 | 2 | — | 3 | 3 | 0.04 | 4 |
| Co-Nb-V | NN1 | 88 | — | 6 | — | 3 | — | 3 | — | — |
| | NN2 | 88 | — | 5 | 1 | 3 | — | 3 | — | — |
| | NN3 | 77 | 10 | 5 | 2 | 3 | — | 3 | 0.04 | — |
| | NN4 | 73 | 10 | 5 | 2 | 3 | — | 3 | 0.04 | 4 |
| | NN5 | 69 | 10 | 5 | 2 | 3 | — | 3 | 0.04 | 8 |
| | NN6 | 67 | 10 | 5 | 2 | 3 | — | 3 | 0.04 | 10 |
| | NN7 | 66.5 | 10 | 7.5 | 3 | 4.5 | — | 4.5 | 0.04 | 4 |
| Hybrid | BNT10 | 73 | 10 | 5 | 2 | 1.5 | 1.5 | 3 | 0.04 | 4 |
| | BNT20 | 63 | 20 | 5 | 2 | 1.5 | 1.5 | 3 | 0.04 | 4 |

In certain embodiments, the γ+γ' microstructures are stable up to 1500 hours at a temperature of about 600-1100° C.

In certain embodiments, the γ' phase is presented near grain boundaries with or without carbide and/or borides phases, beneficial for creep resistance.

In certain embodiments, less than 5 vol. % of other deleterious phases or no other deleterious phases other than the γ, γ' carbide and/or borides phases are formed in the superalloy.

In certain embodiments, the superalloy is a tungsten-free and/or molybdenum-free cobalt based superalloy.

In another aspect, the invention also discloses a method for producing a cobalt based superalloy. In one embodiment, the method includes providing a nominal composition comprising at least Co, Al, Z and V, Z being at least one of Ta and Nb; and arc-melting the nominal composition under a partial Ar atmosphere to obtain an ingot; homogenizing the ingot at a first temperature for a first period of time, followed water quenching; and performing aging heat treatment of the homogenized ingot at a second temperature for a second period of time, followed water quenching, to form the cobalt based superalloy that comprises γ and γ' phases with stable γ+γ' microstructures.

In certain embodiments, the ingots is melted a number of times under the partial Ar atmosphere and flipped between each melting cycle to improve homogeneity.

In certain embodiments, the method, prior to homogenizing the ingot, further comprises vacuum-encapsulating the ingot in a quartz ampoule.

In certain embodiments, the method, prior to performing aging heat treatment, further comprises vacuum-encapsulating the homogenized ingot in a quartz ampoule.

In certain embodiments, the first temperature is in a range of 900-1500° C., and the first period of time is in a range of 40-60 hours.

In certain embodiments, the second temperature is in a range of 600-1100° C., and the second period of time is in a range of 1-1500 hours.

In certain embodiments, each element of the nominal composition has a purity of about 99.99%.

The exemplary embodiments of the cobalt based superalloys are listed in Table 1, and their characterizations are listed in Table 2 and presented in FIGS. 1-18.

TABLE 2

Alloy list with respective heat treatments and resulted microstructure.

| Group | ID | Solution Heat Treatment | Aging Heat Treatment | Notes |
|---|---|---|---|---|
| Co-Ta-V | I1 | 48 hours at 1250° C. | 850 and 900° C. for 7.5 and 168 hours | γ + γ' microstructure with γ' at grain boundaries (GBs) |
| | I2 | 48 hours at 1250° C. | 850 and 900° C. for 7.5 and 168 hours | γ + γ' microstructure with γ' at GBs |
| | I3 | 48 hours at 1250° C. | 850 and 900° C. for 7.5 and 168 hours | γ + γ' microstructure with γ' at GBs |
| | I4 | 48 hours at 1250° C. | 850 and 900° C. for 7.5 and 168 v | γ + γ' microstructure with γ' at GBs |
| | NT1 | 48 hours at 1200° C. | 850° C. for 168, 500 and 1000 hours | γ + γ' microstructure with occasional γ' at GBs |
| | NT2 | 48 hours at 1200° C. | 850° C. for 168, 500 and 1000 hours | γ + γ' microstructure with occasional γ' at GBs |
| Co-Nb-V | NN3 | 48 hours at 1200° C. | 850° C. for 168, 500 and 1000 hours | γ + γ' microstructure with occasional γ' at GBs |
| | NN4 | 48 hours at 1200° C. | 850° C. for 168, 500 and 1000 hours | y+γ' microstructure with occasional γ' at GBs |
| | NN5 | 48 hours at 1200° C. | 850° C. for 168, 500 and 1000 hours | γ + γ' microstructure with occasional γ' at GBs |
| | NN7 | 48 hours at 1200° C. | 850° C. for 168, 500 and 1000 hours | primary regions of γ + γ' with secondary eutetic regions |
| Hybrid | BNT10 | 48 hours at 1200° C. | 850° C. for 168, 500 and 1000 hours | γ + γ' microstructure with γ' at GBs |
| | BNT20 | 48 hours at 1200° C. | 850° C. for 168, 500 and 1000 hours | γ + γ' microstructure with γ' at GBs |

FIG. 1 is SEM micrographs showing the as arc-melted microstructure for Co—Ta—V based alloys with nominal compositions (all in at. %): (1) Co-6Al-3Ta-3V (base alloy), (2) Co-5Al-3Ta-3V-1Ti ((1) with 1 Al replaced with 1 Ti), (3) Co-6Al-3Ta-3V-2Ni ((1) with 2 Co replaced by 2 Ni) and (4) Co-5Al-3Ta-3V-2Ni-1Ti ((3) with 1 Al replaced with 1 Ti). The alloys exhibit dendritic microstructure at low magnification (top row) with coarse γ' created on solidification and γ' precipitates at higher magnification (bottom row) in the interdendritic regions created on subsequent cooling from casting, but no sign of deleterious other phases.

Figure 2:
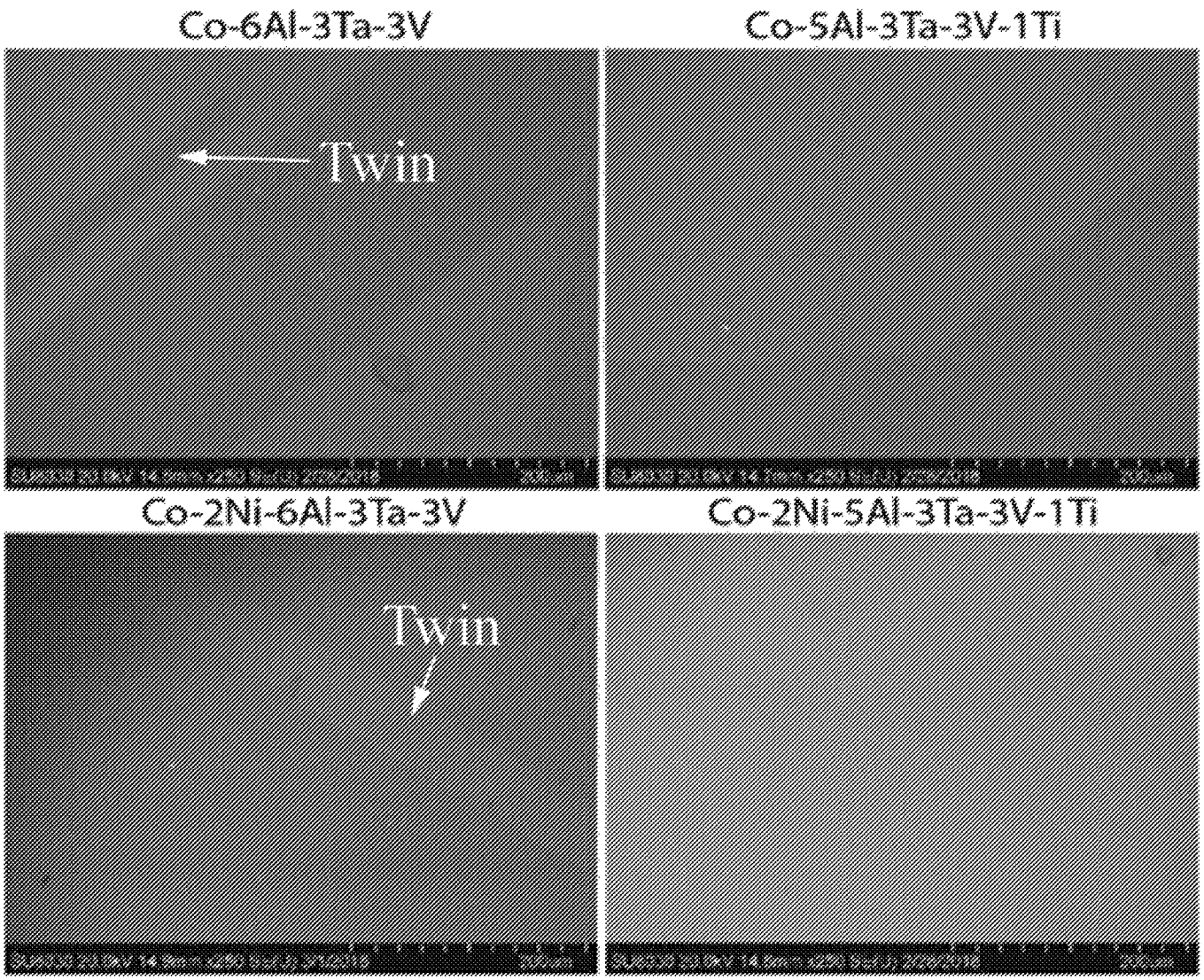
FIG. 2 presents scanning electron microscope (SEM) micrographs of tantalum containing alloys such as Co-6Al-3Ta-3V(-2Ni) and Co-5Al-3Ta-3V-1Ti(-2Ni, at. %) after solutionizing at 1250° C. for 48 hours showing a single-phase γ-matrix with twins, according to embodiments of the invention.

FIG. 2 is SEM micrographs of Co-6Al-3Ta-3V(-2Ni) and Co-5Al-3Ta-3V-1Ti(-2Ni, at. %) showing a single-phase γ-matrix with twins. The single-phase γ structure is achieved after homogenization at 1200-1300° C. and quenching, for all alloys. This is a prerequisite for forming γ', and confirms that no other deleterious phases are created.

Figure 3:
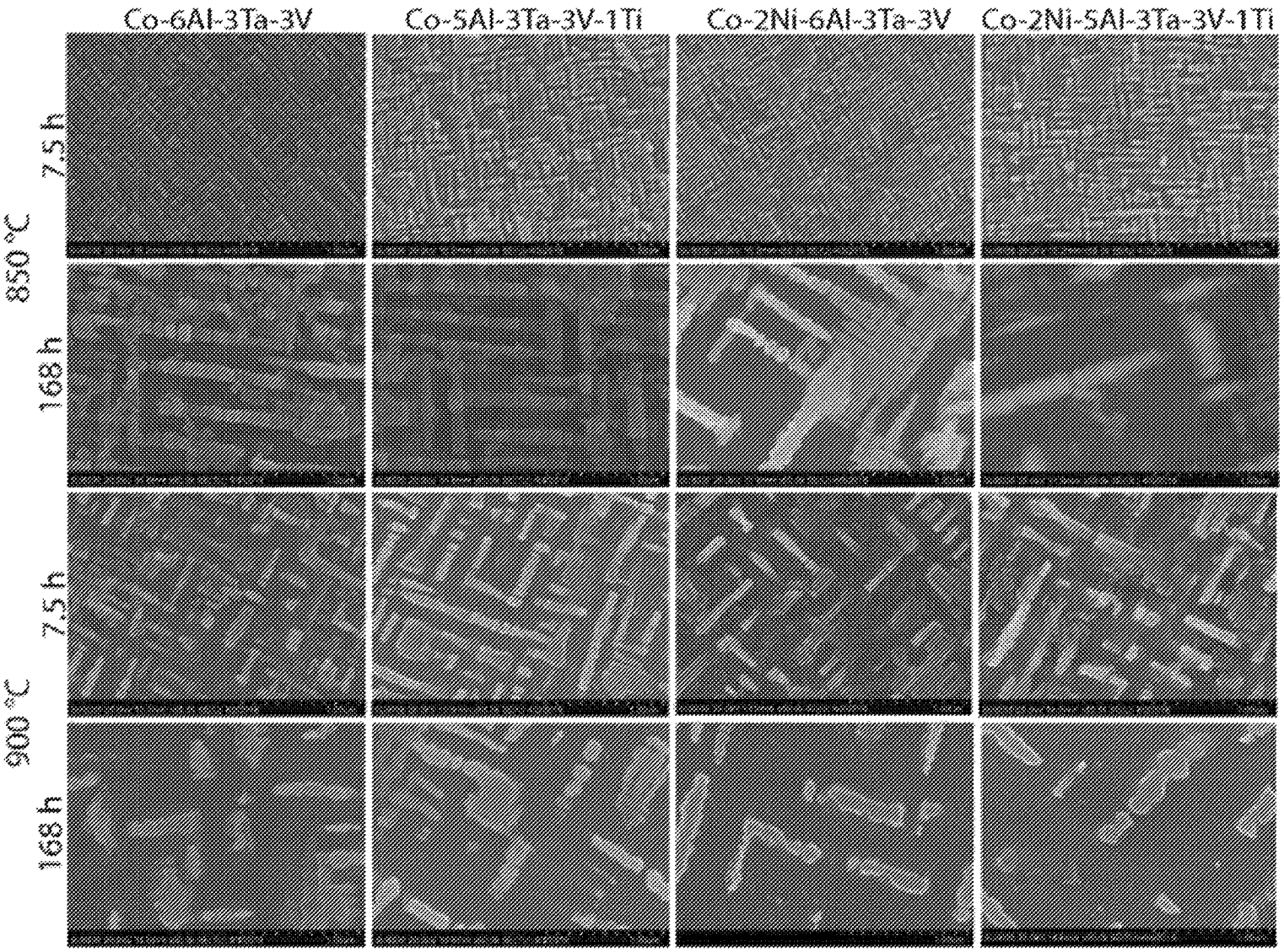
FIG. 3 shows γ-γ' microstructures in tantalum containing alloys aged at 850 and 900° C. for 7.5 and 168 hours, according to embodiments of the invention.

FIG. 3 is SEM micrographs showing the microstructure evolution after aging at 850 and 900° C. for 7.5 and 168 hours (1 week). For all times, γ+γ' microstructures is maintained, no other deleterious phases are formed and the alloys only contain cuboidal γ' precipitates which coarsen with time, as expected. Also expected is the presence of coarsened γ' precipitates at the GB, as shown in FIG. 5, which confirms absence of other deleterious phases.

Figure 4:
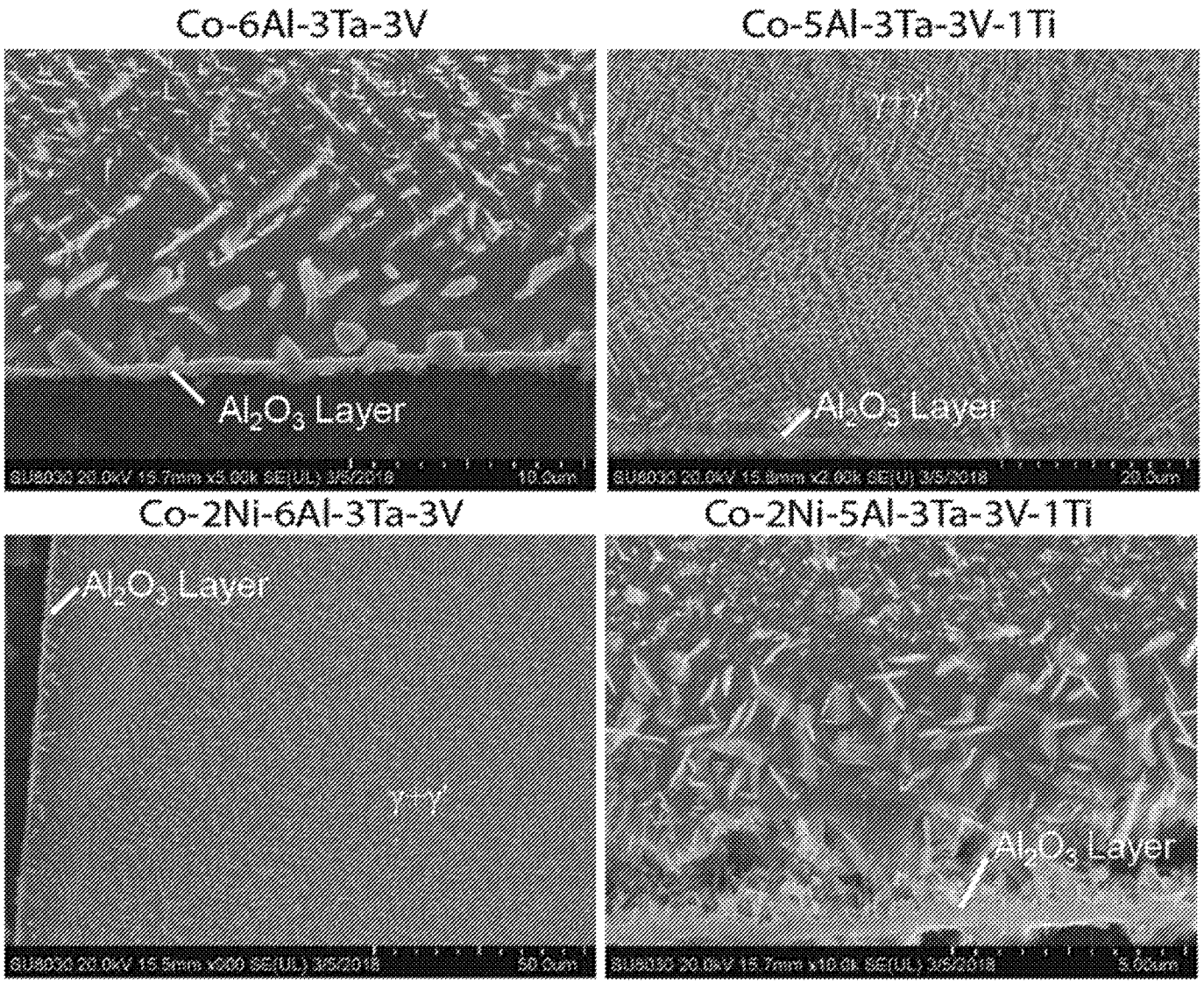
FIG. 4 presents SEM micrographs showing oxidation near the surface of the specimens while the γ-γ' microstructures is seen in the interior of the sample in tantalum containing alloys aged at 900° C. for 30 hours, according to embodiments of the invention.

FIG. 4 is SEM micrographs showing that a thin oxide layer is present at the surface of the sample aged at 900° C. for 30 hours in vacuum (reacting with residual oxygen and providing protection). The layer appears to be protective, as no other oxides (e.g., Co-, Ni- or Ta oxides) are present, which was the other reason to add Al (beside γ' stabilization).

Figure 5:
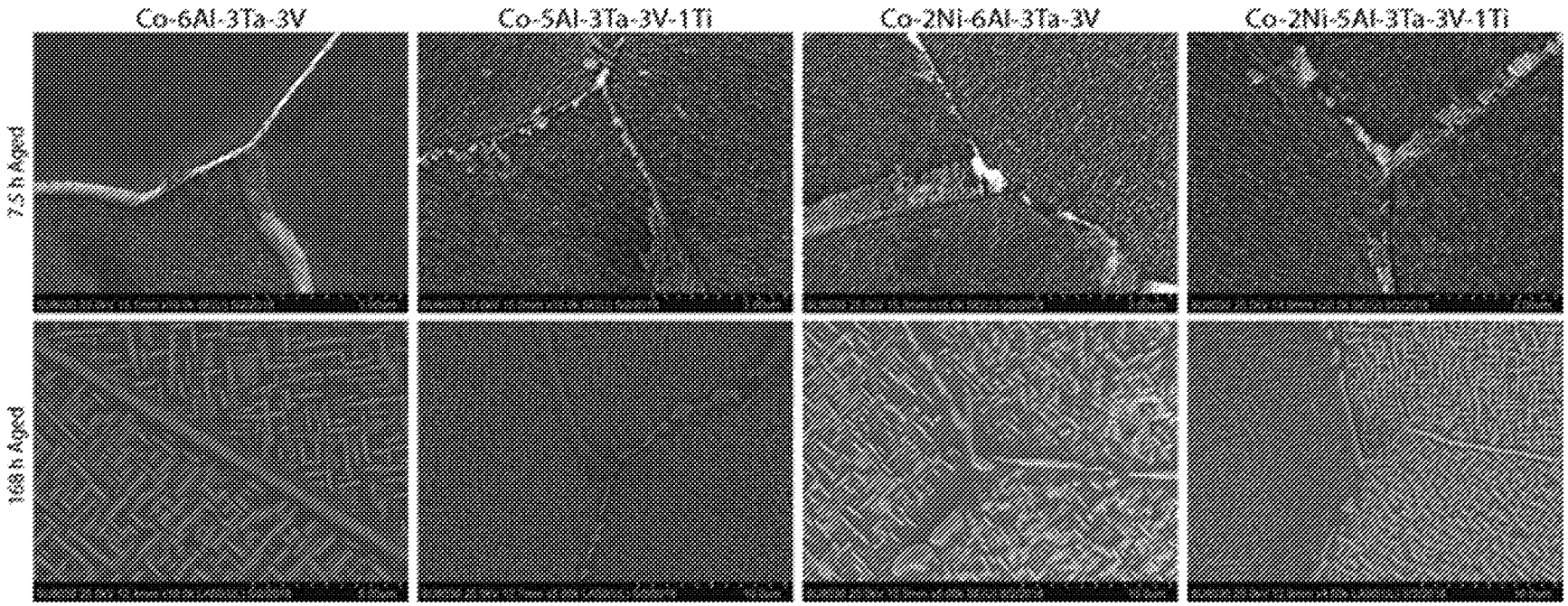
FIG. 5 presents SEM micrographs showing γ' precipitates in the grain boundary (GB) after 7.5 hours of aging at 850° C. and coarsened γ' precipitates after 168 hours of aging, according to embodiments of the invention.

FIG. 5 is SEM micrographs showing γ' precipitates in the GB after 7.5 hours of aging at 850° C. and coarsened γ' precipitates after 168 hours of aging.

Figure 6:
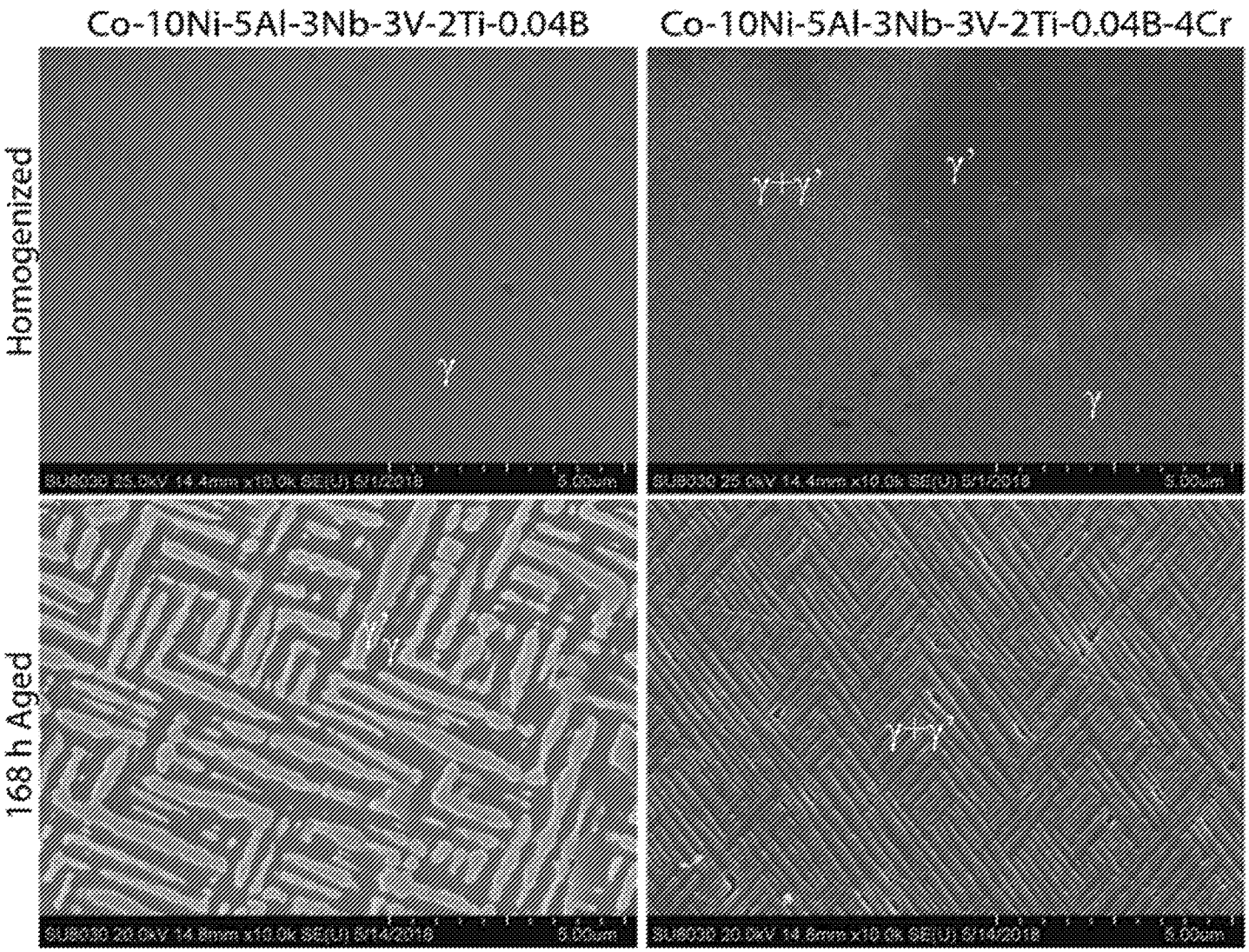
FIG. 6 presents SEM micrographs showing microstructure for a niobium containing alloys in the as homogenized condition and aged at 850° C. for 168 hours, according to embodiments of the invention.

FIG. 6 is SEM micrographs showing the microstructure evolution for Co—Nb—V based alloys with nominal compositions (all in at. %): (1) Co-10Ni-5Al-3Nb-3V-2Ti-0.04B, (2) Co-10Ni-5Al-4Cr-3Nb-3V-2Ti-0.04B (which is composition (1) with 4 Co replaced with 4 Cr), after homogenization at 1200-1300° C. and aged at 850° C. for 1 week. After homogenization, in the Cr-free alloy, a single γ phase is achieved (as for Co—Ta—V-based alloys shown in FIG. 2). In the Cr-containing alloy, a single γ phase is seen in the grain interior while coarsened γ' precipitates are seen near or at the grain boundaries. After one week of aging, both above alloys show that the γ+γ' microstructure is present, no other deleterious phases are formed and the alloys only contain cuboidal γ' precipitates which coarsen with time, as expected. Other Co—Nb—V alloys we cast had the compositions (3) Co-5Al-3Nb-3V-1Ti and (4) Co-6Al-3Nb-3V, which displayed (after one week of aging): for (3), the γ' phase as the majority second phase, but coexisting with undesirable $D0_{19}$ needle-like precipitates, and for (4), undesirable $D0_{19}$ needle-like precipitates as the second phase, respectively. This shows the importance of adding 10% Ni, and doubling Ti for 1 to 2%. Importantly, 4% Cr can be added (e.g., for oxidation/corrosion resistance) without destabilizing the γ' or creating other deleterious phases.

Figure 7:
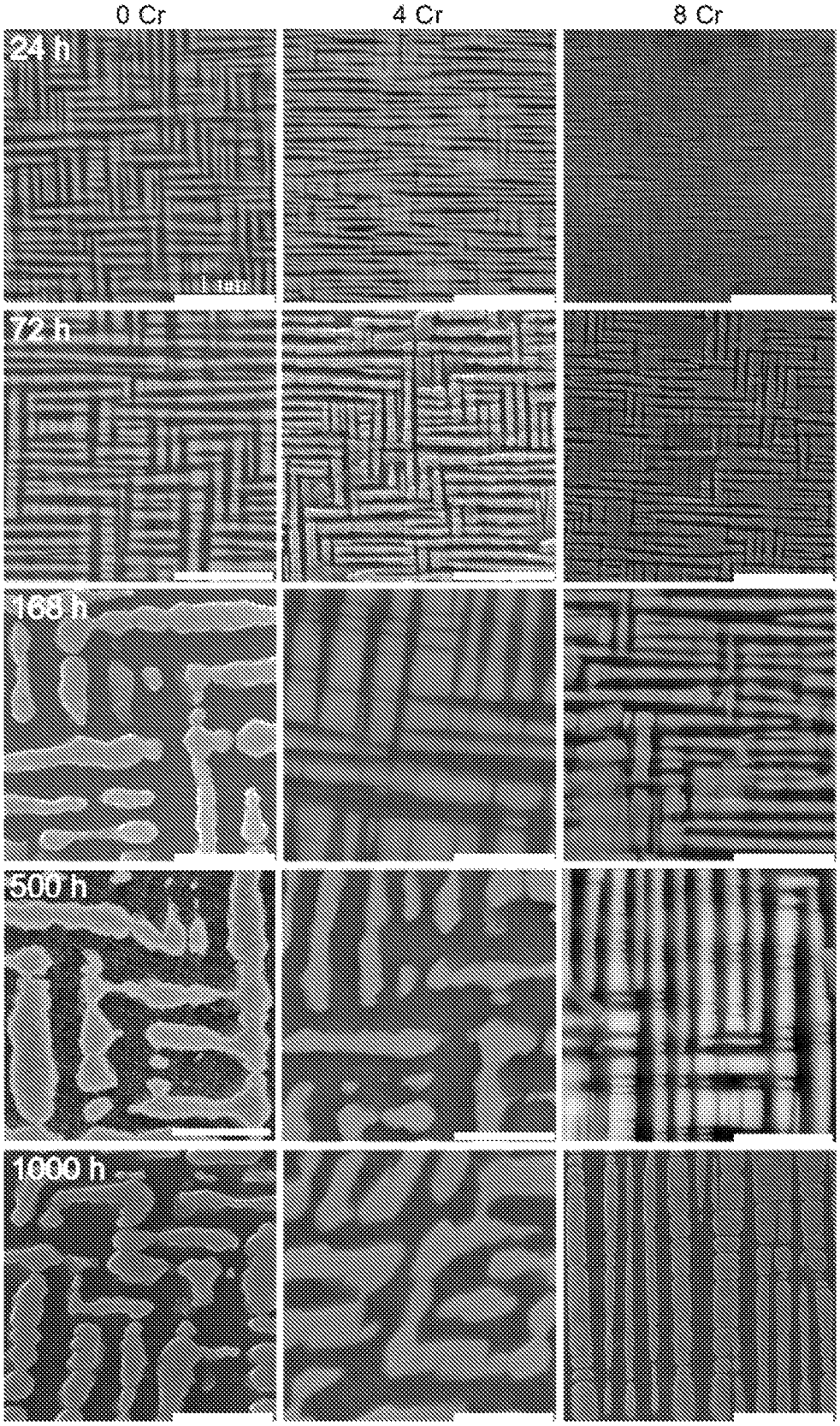
FIG. 7 presents SEM micrographs showing microstructure for Co-10Ni-5Al-xCr-3Nb-3V-2Ti-0.04B (x=0, 4 and 8 Cr) containing alloys aged at 850° C. for 24, 76, 168, 500 and 1000 hours, showing a γ matrix with γ' precipitates (slowly coarsening with time, but with no other phases), according to embodiments of the invention.

FIG. 7 is SEM micrographs showing microstructure for Co-10Ni-5Al-xCr-3Nb-3V-2Ti-0.04B (x=0, 4 and 8 Cr) containing alloys aged at 850° C. for 24, 76, 168, 500 and 1000 hours, showing a γ matrix with γ' precipitates (slowly coarsening with time, but with no other phases).

Figure 8:
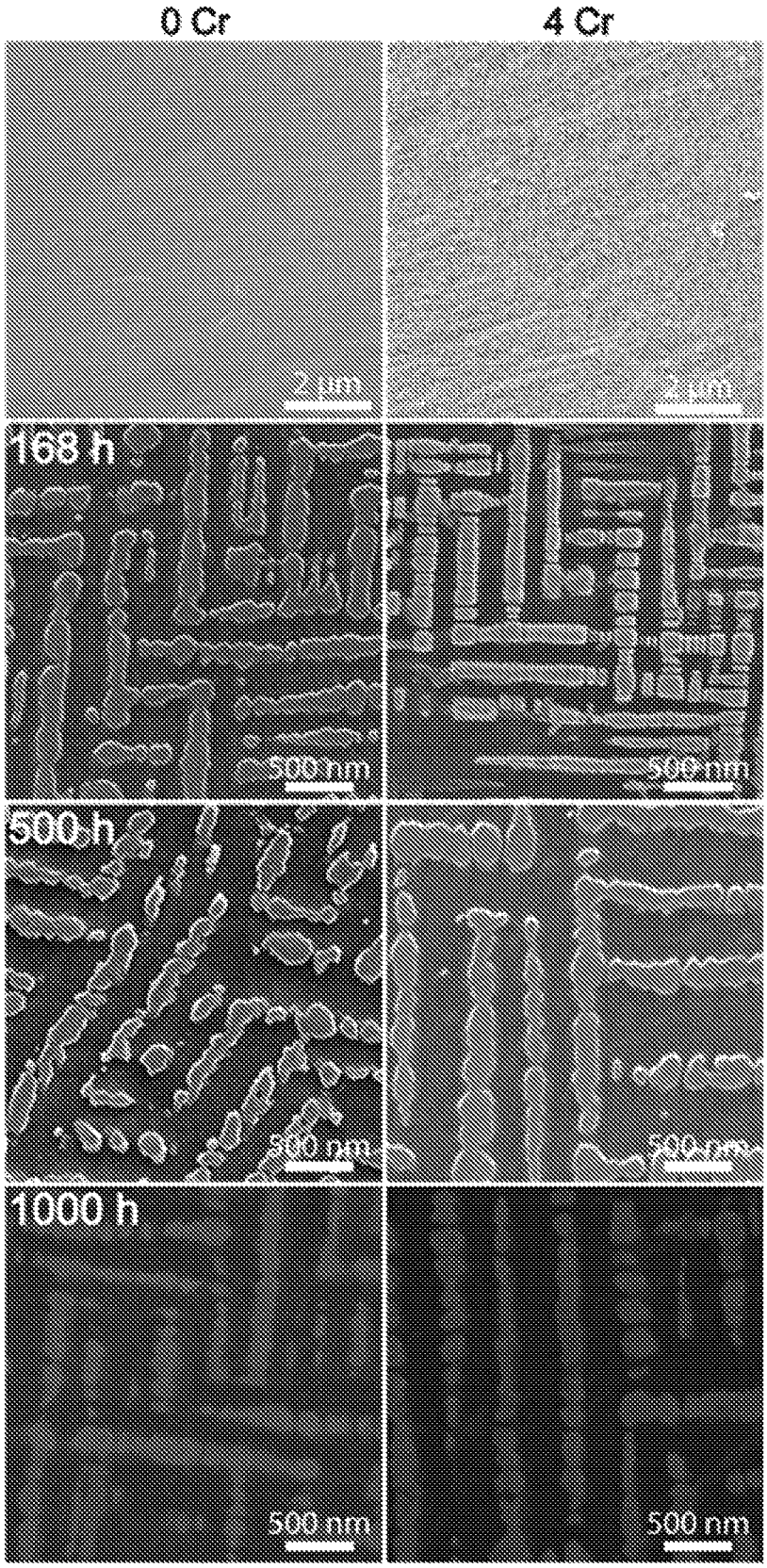
FIG. 8 presents SEM micrographs showing microstructure for Co-10Ni-5Al-xCr-3Ta-3V-2Ti-0.04B (x=0 and 4 Cr) alloys in the as homogenized condition and aged at 850° C. for 0, 168, 500 hours and 1000 hours, showing a γ matrix with γ' precipitates (slowly coarsening with time, but with no other phases), according to embodiments of the invention.

FIG. 8 is SEM micrographs showing microstructure for Co-10Ni-5Al-xCr-3Ta-3V-2Ti-0.04B (x=0 and 4 Cr) alloys in the as homogenized condition and aged at 850° C. for 0, 168, 500 hours and 1000 hours, showing a γ matrix with γ' precipitates (slowly coarsening with time, but with no other phases).

Figure 9A:
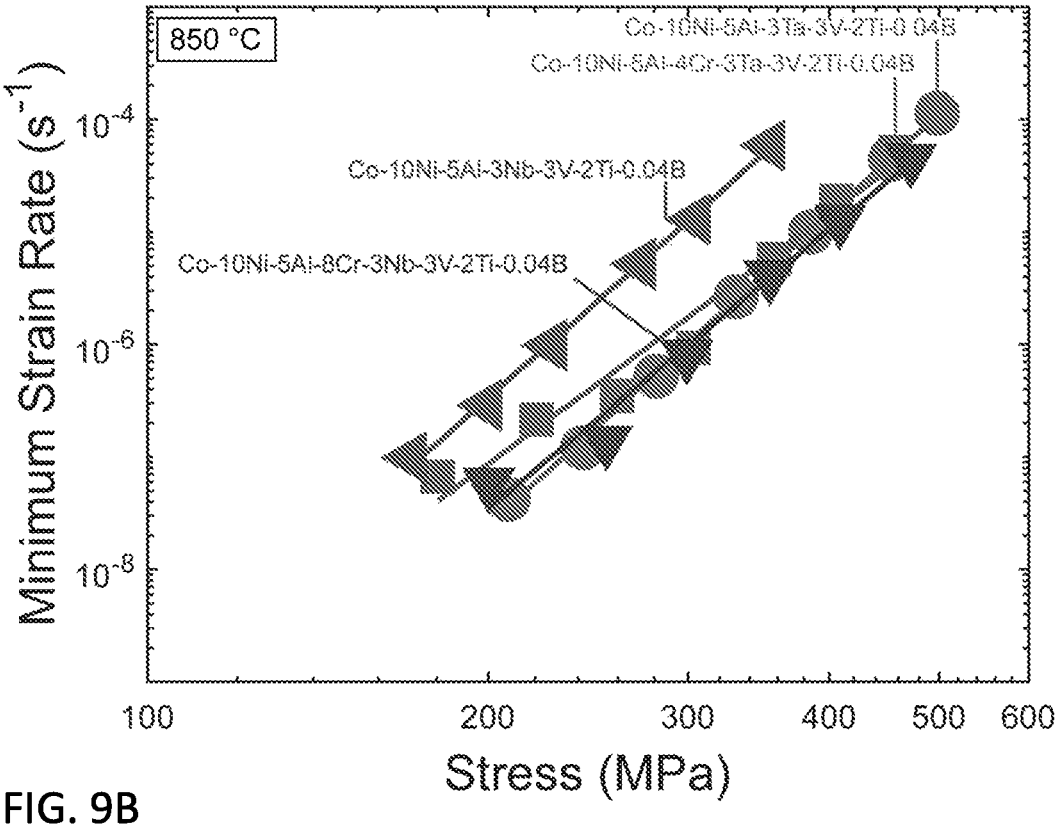
FIG. 9A shows plots for minimum strain rate data for Co-10Ni-5Al-3Ta-3V-2Ti-0.04B-(0 and 4)Cr and Co-10Ni-5Al-3Nb-3V-2Ti-0.04B-(0 and 8)Cr alloys tested under high temperature compression creep at 850° C. for different stresses, showing creep resistance is improved with Cr additions for the latter alloy, according to embodiments of the invention.

FIG. 9A shows plots for minimum strain rate data for Co-10Ni-5Al-3Ta-3V-2Ti-0.04B-(0 and 4)Cr and Co-10Ni-5Al-3Nb-3V-2Ti-0.04B-(0 and 8)Cr alloys tested under high temperature compression creep at 850° C. for different stresses, showing creep resistance is improved with Cr additions for the latter alloy.

Figure 9B:
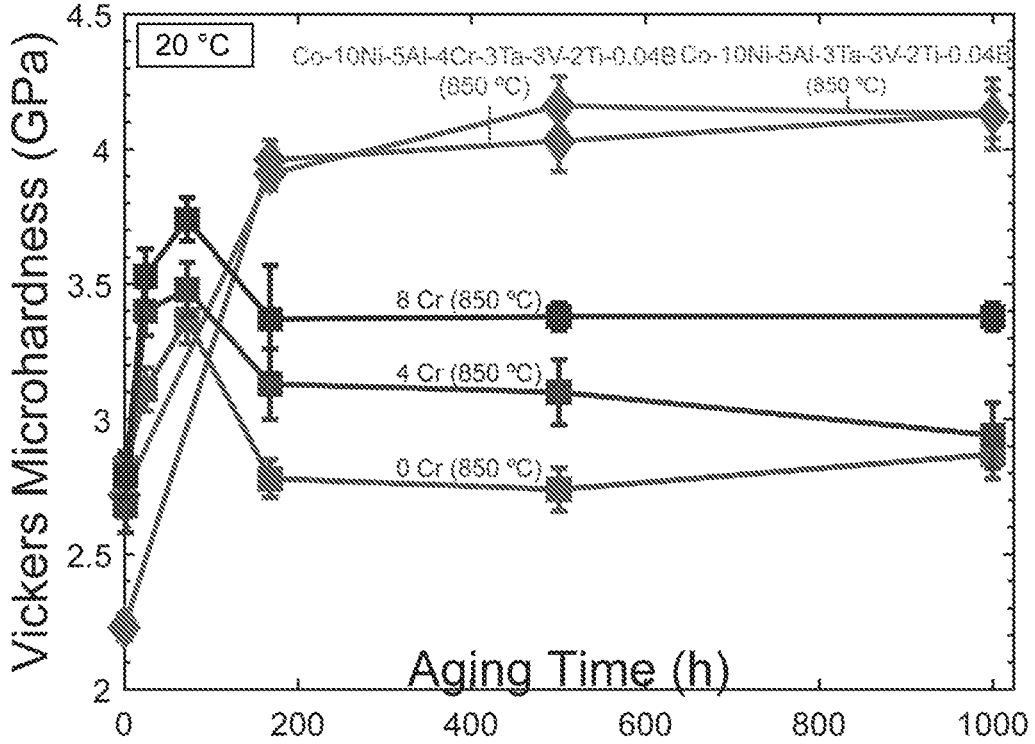
FIG. 9B shows plots for Vicker hardness data for Co-10Ni-5Al-3Ta-3V-2Ti-0.04B-(0 and 4)Cr and Co-10Ni-5Al-3Nb-3V-2Ti-0.04B-(0, 4 and 8)Cr alloys aged 850° C. and tested under room temperature (20° C.), showing that Cr additions improve hardness for latter alloys, according to embodiments of the invention.

FIG. 9B shows plots for Vicker hardness data for Co-10Ni-5Al-3Ta-3V-2Ti-0.04B-(0 and 4)Cr and Co-10Ni-5Al-3Nb-3V-2Ti-0.04B-(0, 4 and 8)Cr alloys aged 850° C. and tested under room temperature (20° C.), showing that Cr additions improve hardness for latter alloys.

Figure 10:
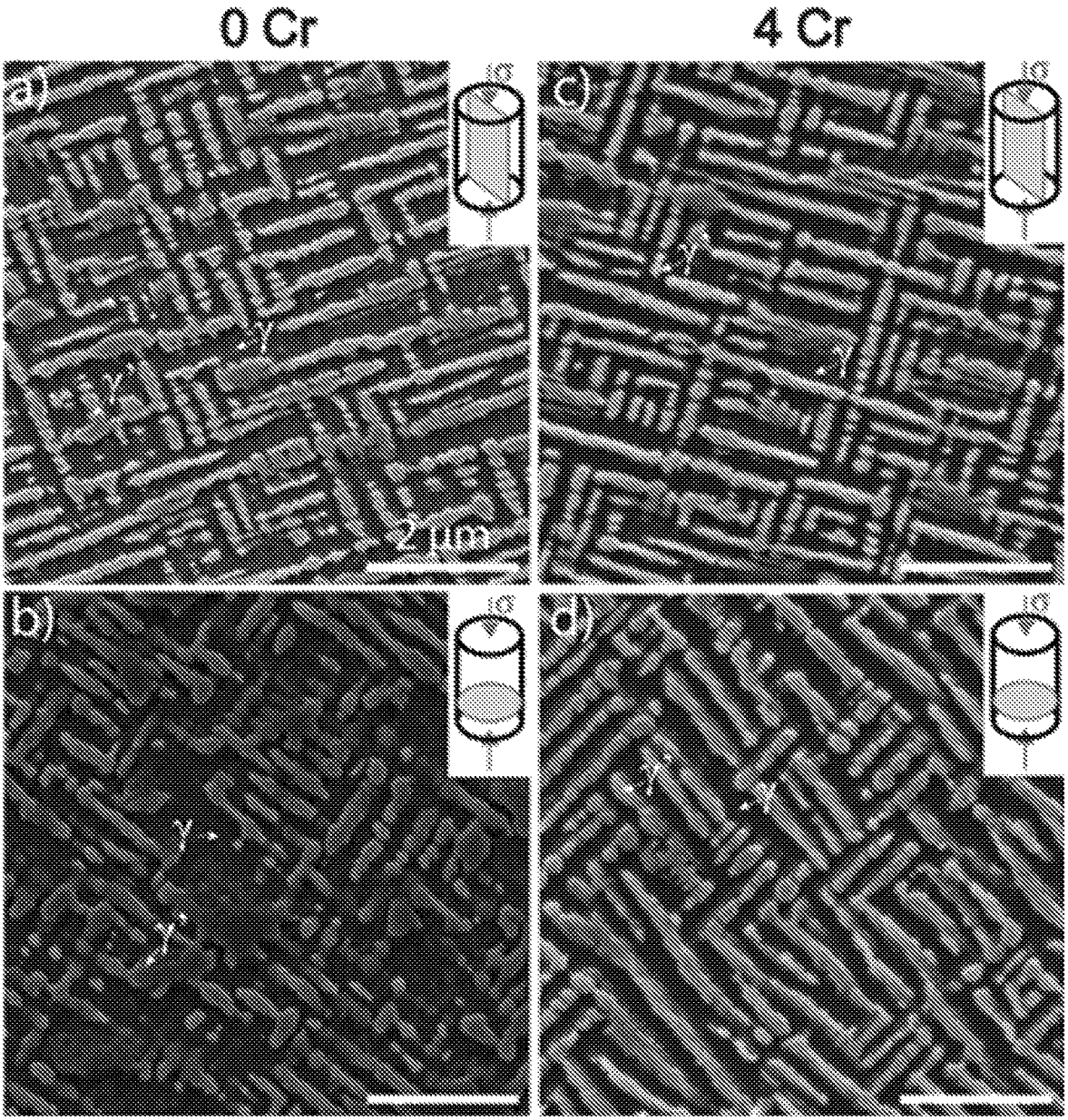
FIG. 10 presents SEM micrographs showing partial γ'-rafting in cross-sections parallel (portions a) and c)) and perpendicular (portions b) and d)) to the applied load for Co-10Ni-5Al-3Ta-3V-2Ti-0.04B (0Cr) and Co-10Ni-5Al- 4Cr-3Ta-3V-2Ti-0.04B (4Cr) crept at 850° C. according to embodiments of the invention.

FIG. 10 is SEM micrographs showing partial γ'-rafting in cross-sections parallel (portions a) and c)) and perpendicular (portions b) and d)) to the applied load for Co-10Ni-5Al-3Ta-3V-2Ti-0.04B (0Cr) and Co-10Ni-5Al-4Cr-3Ta-3V-2Ti-0.04B (4Cr) crept at 850° C.

Figure 11:
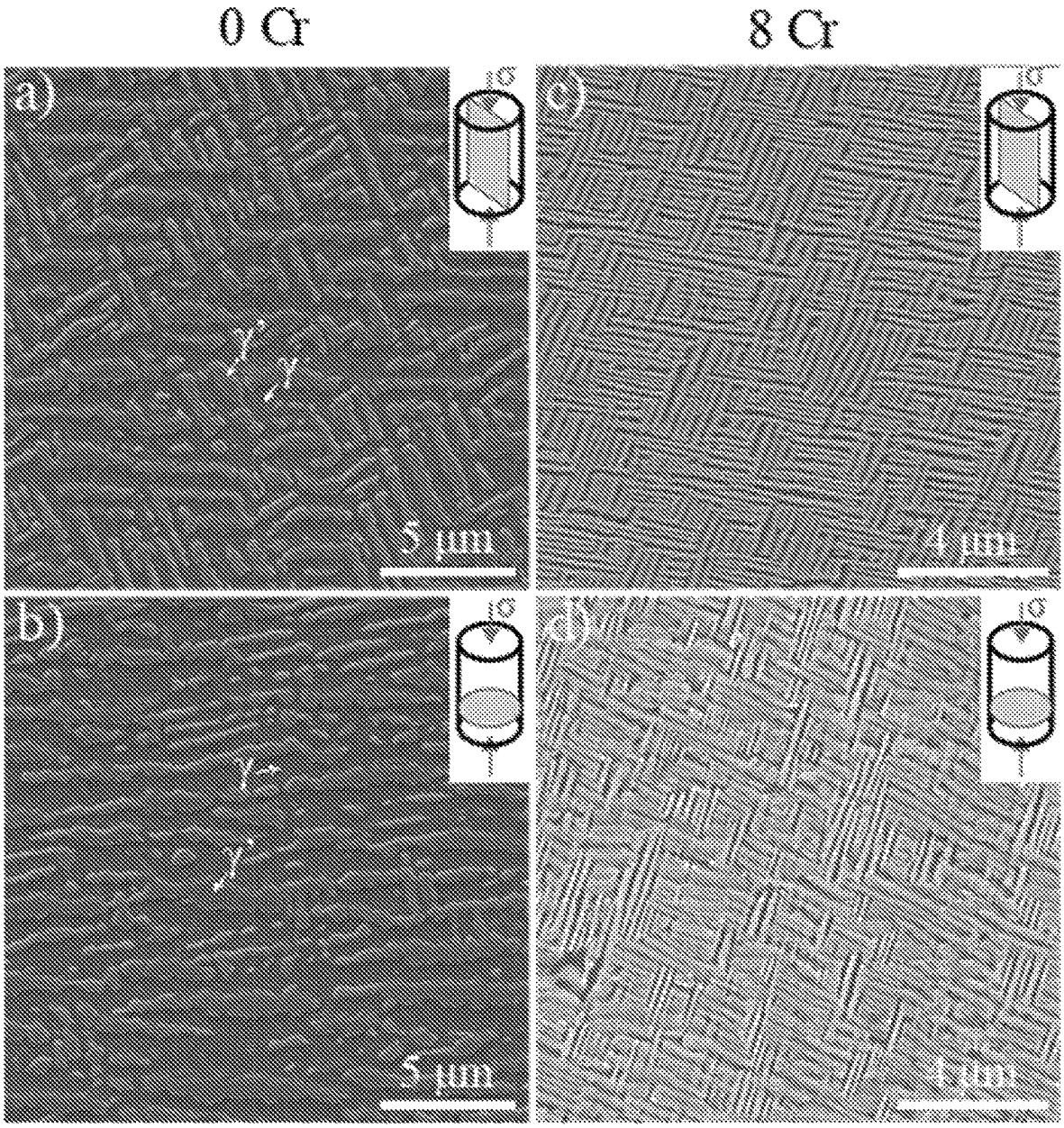
FIG. 11 presents SEM micrographs showing partial γ'-rafting in cross-sections parallel (portions a) and c)) and perpendicular (portions b) and d)) to the applied load for Co-10Ni-5Al-3Nb-3V-2Ti-0.04B (0Cr) and Co-10Ni-5Al-4Cr-3Nb-3V-2Ti-0.04B (8Cr) crept at 850° C. according to embodiments of the invention.

FIG. 11 is SEM micrographs showing partial γ'-rafting in cross-sections parallel (portions a) and c)) and perpendicular (portions b) and d)) to the applied load for Co-10Ni-5Al-3Nb-3V-2Ti-0.04B (0Cr) and Co-10Ni-5Al-4Cr-3Nb-3V-2Ti-0.04B (8Cr) crept at 850° C.

Figures 12A, 12B:
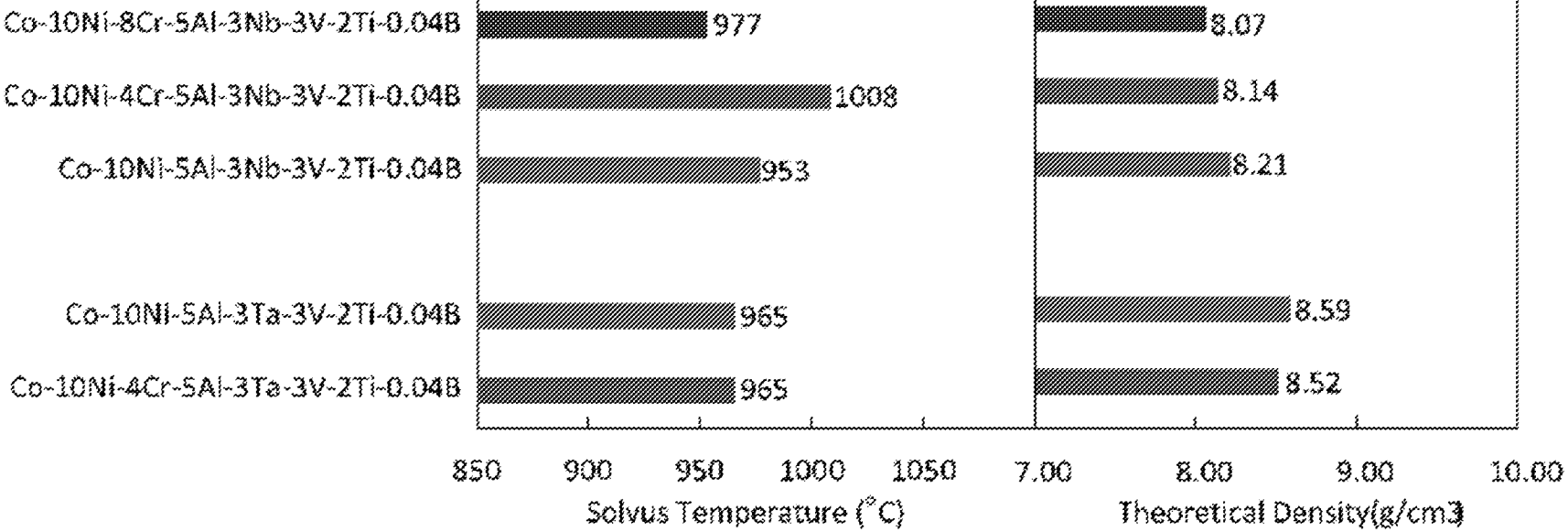
FIGS. 12A and 12B show respectively solvus temperatures and theoretical density for certain alloys, according to embodiments of the invention.

FIGS. 12A and 12B show respectively solvus temperatures and theoretical density for certain alloys.

Figure 13:
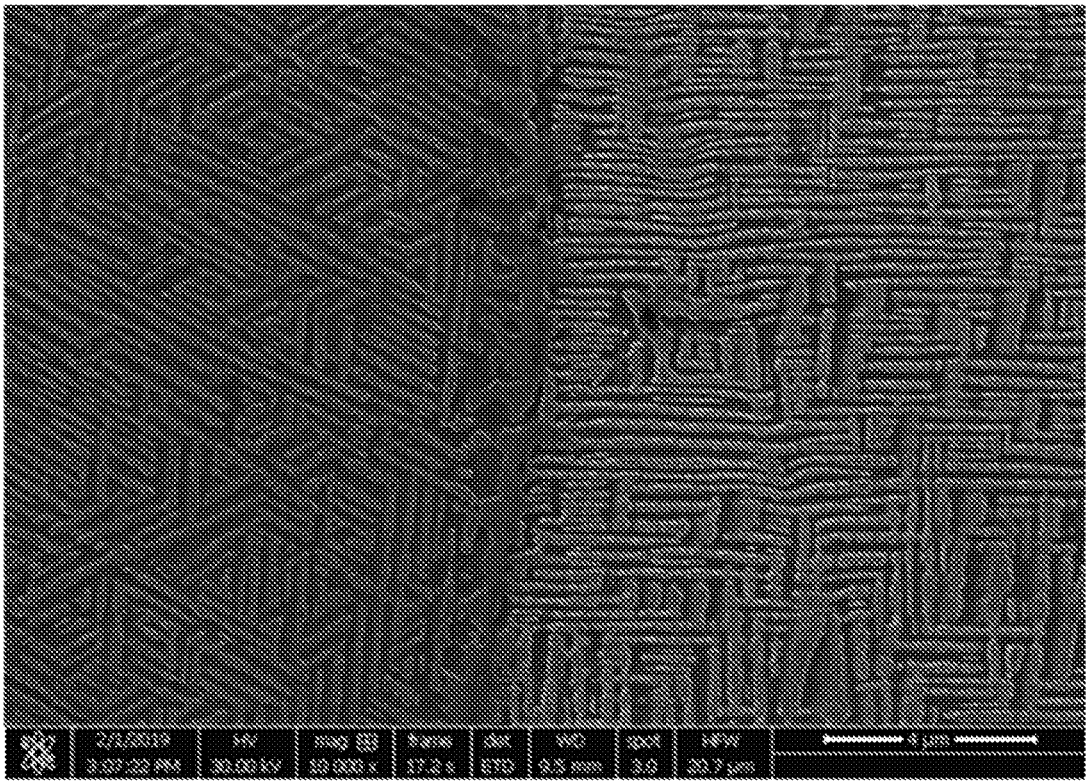
FIG. 13 presents an SEM micrograph of Co-10Ni-5Al-4Cr-3V-2Ti-1.5Nb-1.5Ta-0.08B aged for 168 hours at 850° C. showing γ+γ' microstructure with γ' at grain boundary but no other phases, according to embodiments of the invention.

FIG. 13 is an SEM micrograph of Co-10Ni-5Al-4Cr-3V-2Ti-1.5Nb-1.5Ta-0.08B aged for 168 hours at 850° C. showing γ+γ' microstructure with γ' at grain boundary but no other phases.

Figure 14:
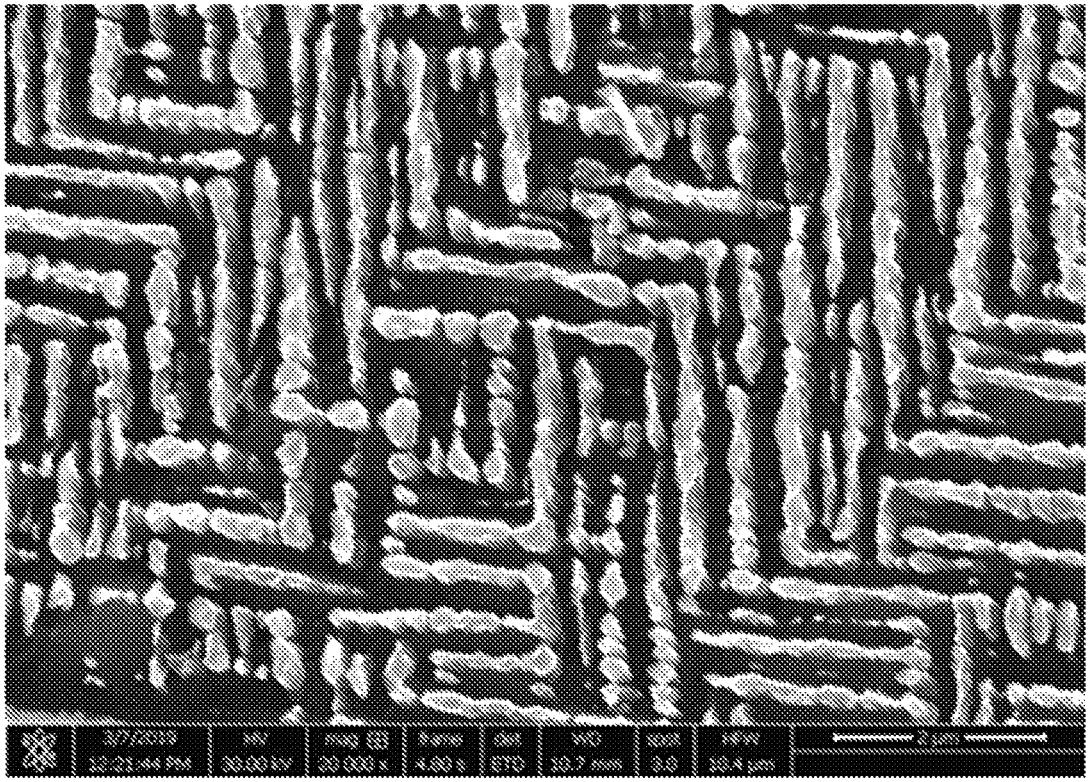
FIG. 14 presents an SEM micrograph of Co-10Ni-5Al-4Cr-3V-2Ti-1.5Nb-1.5Ta-0.08B aged for 500 hours at 850° C. showing γ+γ' microstructure but no other phases, according to embodiments of the invention.
Figure 15:
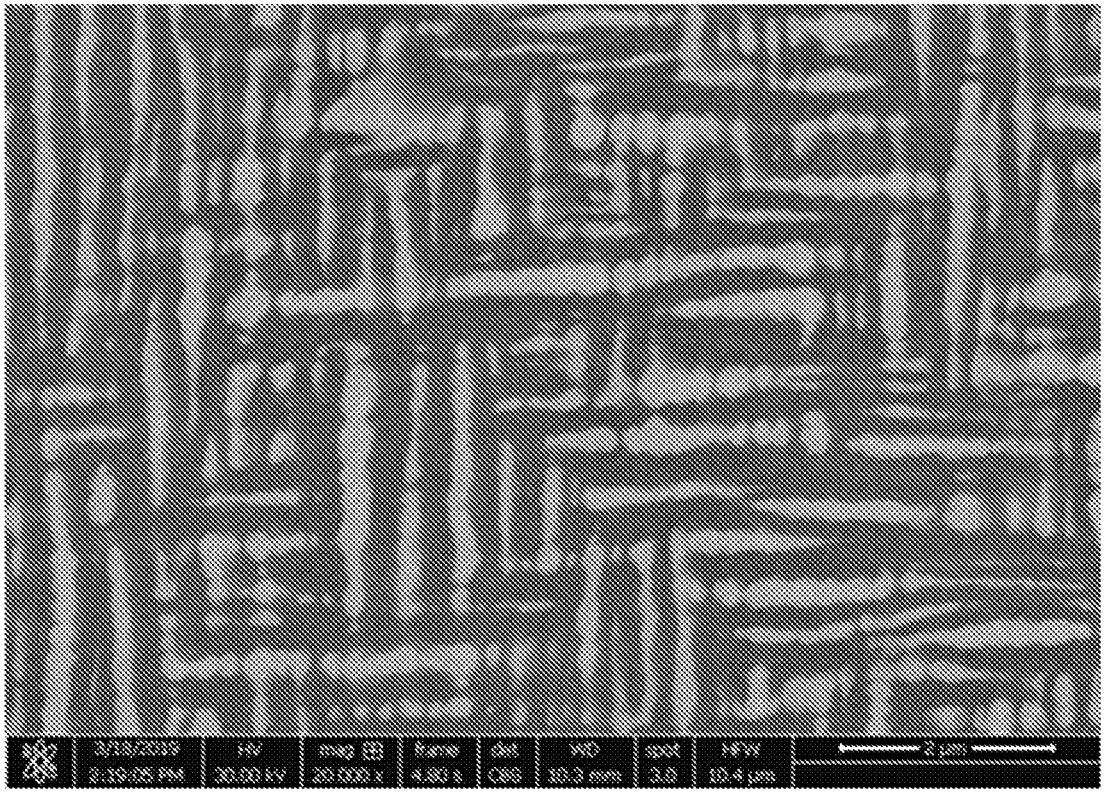
FIG. 15 presents an SEM micrograph of Co-10Ni-5Al-4Cr-3V-2Ti-1.5Nb-1.5Ta-0.08B aged for 1000 hours at 850° C. showing γ+γ' microstructure but no other phases, according to embodiments of the invention.

FIG. 14 is an SEM micrograph of Co-10Ni-5Al-4Cr-3V-2Ti-1.5Nb-1.5Ta-0.08B aged for 500 hours at 850° C. showing γ+γ' microstructure but no other phases. FIG. 15 is an SEM micrograph of Co-10Ni-5Al-4Cr-3V-2Ti-1.5Nb-1.5Ta-0.08B aged for 1000 hours at 850° C. showing γ+γ' microstructure but no other phases.

Figure 16:
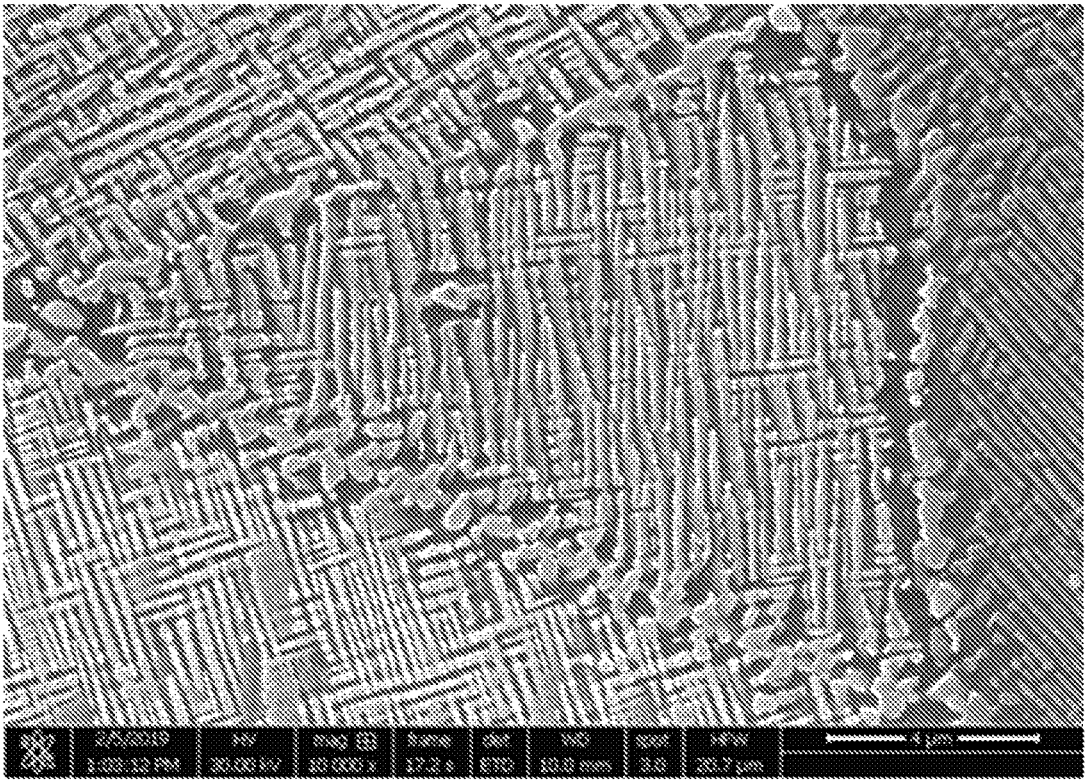
FIG. 16 presents an SEM micrograph of Co-20Ni-5Al-4Cr-3V-2Ti-1.5Nb-1.5Ta-0.08B aged for 168 hours at 850° C. showing γ+γ' microstructure with coarsened γ' at grain boundary but no other phases, according to embodiments of the invention.

FIG. 16 is an SEM micrograph of Co-20Ni-5Al-4Cr-3V-2Ti-1.5Nb-1.5Ta-0.08B aged for 168 hours at 850° C. showing γ+γ' microstructure with coarsened γ' at grain boundary but no other phases.

Figure 17:
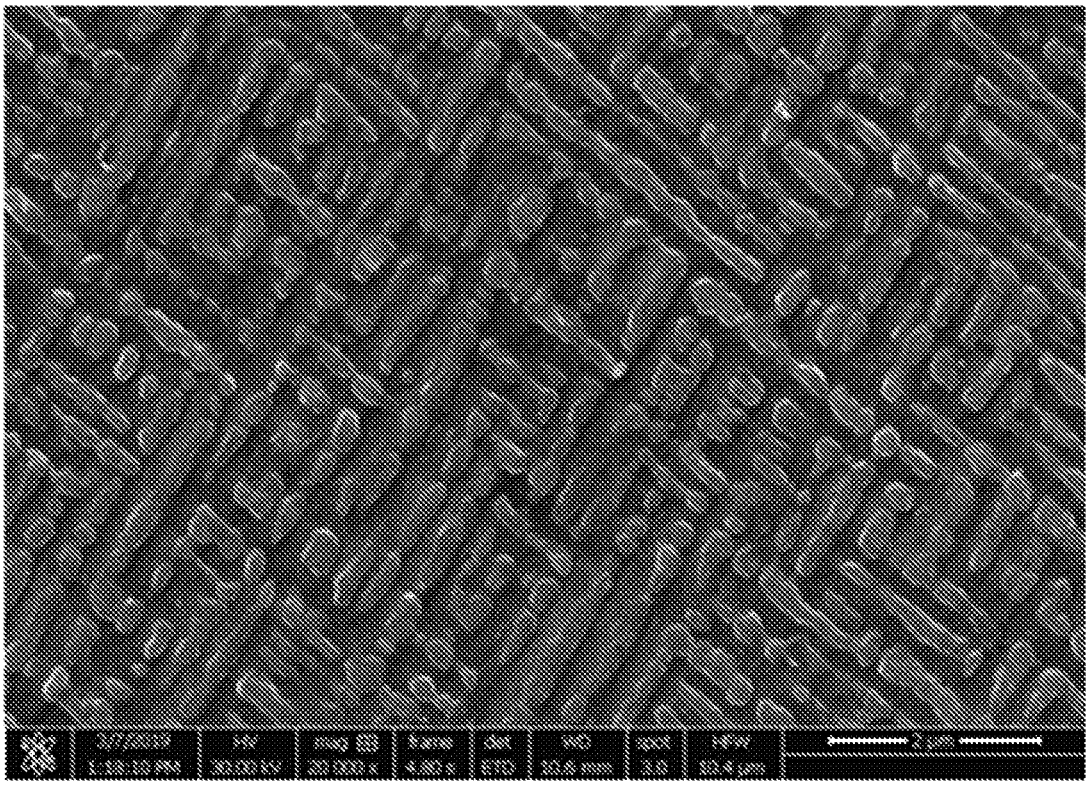
FIG. 17 presents an SEM micrograph of Co-20Ni-5Al-4Cr-3V-2Ti-1.5Nb-1.5Ta-0.08B aged for 500 hours at 850° C. showing γ+γ' microstructure but no other phases, according to embodiments of the invention.

FIG. 17 is an SEM micrograph of Co-20Ni-5Al-4Cr-3V-2Ti-1.5Nb-1.5Ta-0.08B aged for 500 hours at 850° C. showing γ+γ' microstructure but no other phases.

Figure 18:
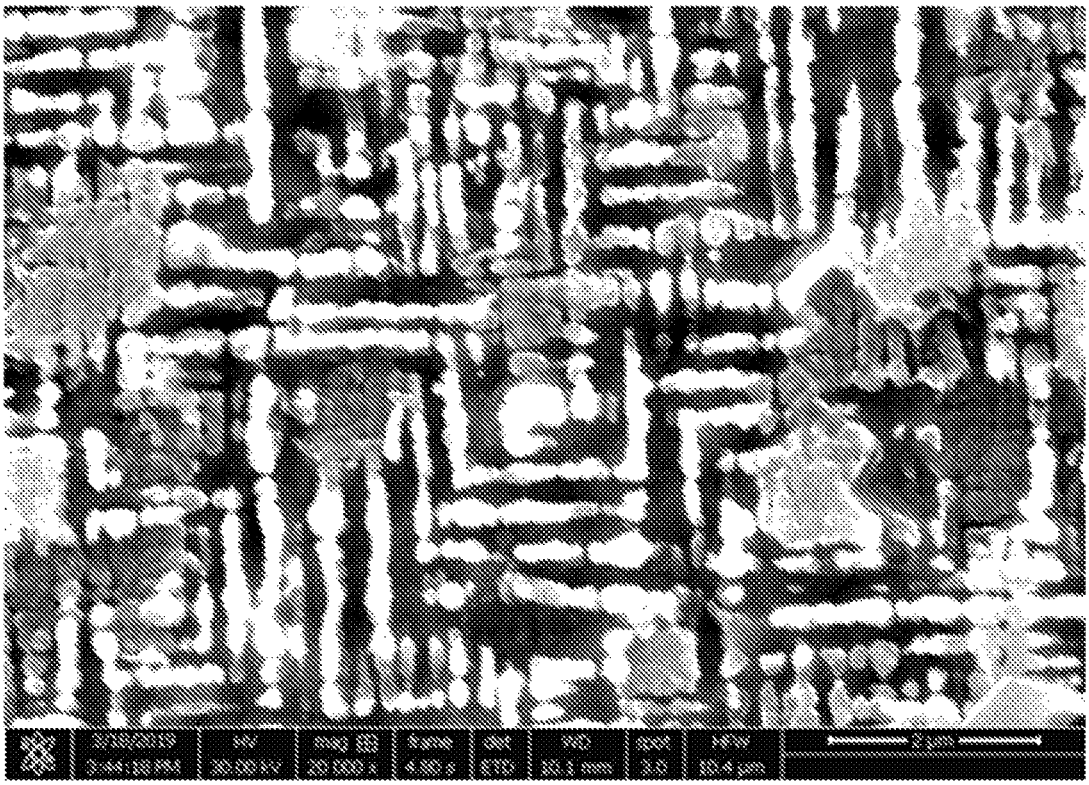
FIG. 18 presents an SEM micrograph of Co-20Ni-5Al-4Cr-3V-2Ti-1.5Nb-1.5Ta-0.08B aged for 1000 hours at 850° C. showing γ+γ' microstructure but no other phases, according to embodiments of the invention.

FIG. 18 is an SEM micrograph of Co-20Ni-5Al-4Cr-3V-2Ti-1.5Nb-1.5Ta-0.08B aged for 1000 hours at 850° C. showing γ+γ' microstructure but no other phases.

The cobalt based alloys according to the invention have, among other things, advantages over the existing alloys.

As compared to Ni-based superalloys (currently commercial), the cobalt based alloys of the invention have a higher melting point than nickel, which may increase turbine operating temperature, thus achieving higher efficiency. In addition, the cobalt based alloys have better corrosion resistance than nickel alloys.

As compared to W-containing Co-based superalloys based on Co—W—Al: the W-free cobalt based alloys of the invention achieve lower density enabling higher turbine rotations (and thus efficiency and power) for a given stress.

As compared to Mo-containing Co-based superalloys: the Mo-free cobalt based alloys of the invention do not have $MoO_3$ formation and vaporization problems at temperatures as low as 500° C. Our Co—Al—Nb—V based alloys have very low density, given that Nb and V (8.6 and 6.0 g/cc) have densities lower than Mo (10.3 g/cc), and much lower than Ta (16.7 g/cc) or W (19.3 g/cc).

As compared to a Co-11Ti-15Cr superalloy (at. %), the cobalt based alloys of the invention contain Al for better oxidation/corrosion resistance, and V for low density. Also, the cobalt based alloys include Nb or Ta refractory elements which decrease γ' coarsening rates and provide solid solution strengthening.

As compared to very recent a Co-5Ti-15V-2Al superalloy (at. %), the cobalt based alloys of the invention contain much less V (thus having better corrosion and oxidation resistance) and more Al (for better oxidation resistance and lower density). Also, the cobalt based alloys include Nb or Ta refractory elements which decrease γ' coarsening rates and provide solid solution strengthening The invention may find a wide spectrum of applications in, for example, parts for gas turbines, jet engines and diesel turbo engines, where one must combine high-temperature strength and stability as well as oxidation/corrosion resistance, and turbine blades and disks where one most combine low density, high-temperature creep resistance and good oxidation/corrosion/fatigue resistance.

These and other aspects of the present invention are further described below. Without intent to limit the scope of the invention, examples according to the embodiments of the present invention are given below. Note that titles or subtitles may be used in the examples for convenience of a reader, which in no way should limit the scope of the invention. Moreover, certain theories are proposed and disclosed herein; however, in no way they, whether they are right or wrong, should limit the scope of the invention so long as the invention is practiced according to the invention without regard for any particular theory or scheme of action.

Example 1

γ+γ' Microstructures in Co—Ta—V and Co—Nb—V Ternary Systems

In this exemplary example, the Co—Ta—V and Co—Nb—V ternary systems are investigated in a search for $L1_2$-ordered γ' precipitation. Four alloys with nominal (at. %) composition Co-6Ta-6V, Co-5.4Ta-6.6V-xNi (x=0 and 10), and Co-6Nb-6V are arc-melted, homogenized at 1250° C., and aged at 900° C. for 2, 16 and 64 hours. Nanometric, cuboidal γ' precipitates within a fcc-γ matrix are discovered in the Co—Ta—V system after aging for 2 hours, and in the Co—Nb—V system after cooling from homogenization. The compositions of these two new γ'-phases, as measured via atom probe tomography, are $Co_3(Ta_{0.76}V_{0.24})$ and $Co_3(Nb_{0.65}V_{0.35})$, respectively. Upon aging 900° C., the γ' precipitates coarsen, dissolve and transform to lamellar C36-$Co_3$(Ta,V) and needle-shape $D0_{19}$-$Co_3$(Nb,V), measured as $Co_3(Nb_{0.81}V_{0.19})$ by APT, respectively. This shows that these ternary γ' phases are metastable and points to the need for their stabilization via additional alloying elements.

In the exemplary study, the formation of γ' precipitates is experimentally demonstrated in the Co—Ta—V and the Co—Nb—V system. The ternary alloys have nominal compositions (at. %) of Co-6Nb-6V, Co-6Ta-6V, with equiatomic solute additions. Nyshadham et al. computationally predicted $Co_3(Nb_{0.5}V_{0.5})$ and $Co_3(Ta_{0.5}V_{0.5})$ are $L1_2$-ordered γ' phases, which are not previously reported in phase diagrams in standard databases. Nyshadham et al. calculate that $Co_3(Nb_{0.5}V_{0.5})$ and $Co_3(Ta_{0.5}V_{0.5})$ have lower decomposition energy (19 and 18 meV/atom, respectively) and lower formation enthalpy (−156 and −189 meV, respectively) than the γ'-$Co_3(Al_{0.5}W_{0.5})$ phase found in cobalt-base superalloy (66 meV/atom and −130 meV at T=0 K, respectively). They also predict that the two new $L1_2$-γ' phases are in stable two-phase equilibrium with a fcc-γ Co-rich matrix, with a low lattice mismatch of 2%. In the exemplary example, two experimental alloys, as well as two modified ternary and quaternary alloys (Co-5.4Ta-6.6V-xNi with x=0 and 10 at. %), are aged at various times at 900° C. and their microstructures are studied via scanning electron microscopy (SEM) and atom probe tomography (APT) to search for the predicted γ' phases. Additionally, the formation of non-γ' phases is identified by microstructure analysis.

Experimental Procedures

Button ingots of about 20 g with nominal composition Co-6Ta-6V, Co-5.4Ta-6.6V, Co-10Ni-5.38Ta-6.55V and Co-6Nb-6V (all compositions being given hereafter in at. %) were produced by arc melting of high purity Co (99.99%), Ta (99.99%), V (99.99%), Nb (99.99%) and Ni (99.99%), under a partial Ar atmosphere. The button ingots where remelted six times and flipped between each melting step to ensure homogenous distribution of the constituent elements in the alloys. Button ingots for Co-6Ta-6V and Co-6Nb-6V alloys were then homogenized in a high-vacuum furnace at 1250° C. for 48 hours and furnace-cooled to room temperature. Ingots for alloys Co-5.4Ta-6.6V and Co-10Ni-5.38Ta-6.55V where vacuum-encapsulated in quartz ampoules, homogenized at 1250° C. for 48 hours followed by water quenching. Sections of these ingots were vacuum-encapsulated in quartz ampoules and aged at 900° C. for 2, 16 and 64 hours, followed by water quenching.

Microstructure characterization and composition analysis were performed using SEM and energy dispersive spectroscopy (EDS) with a Hitachi SU8030 SEM equipped with an Oxford Aztec SDD EDS detector. As-homogenized and aged specimens used for SEM were grinded using 320, 400, 600, 800, 1200 grit SiC paper, polished using 6, 3, and 1 μm diamond suspension, and chemically etched at room temperature using a solution of 33% hydrochloric acid (12.1M), 33% acetic acid and 1% hydrofluoric acid volume in deionized water. SEM micrographs were taken from grains orientated close to a {100}-type plane.

To determine the partition behavior and the composition of the γ- and γ' phases, 2 hour-aged samples of the Co-5.4Ta-6.6V and Co-6Nb-6V alloys were prepared into nanotip specimens for APT studies via a lift-out technique with a $Ga^+$ dual-beam focused-ion beam (FIB) microscope using a FEI Helios Nanolab SEM/FIB. Areas displaying a γ+γ' and a γ+$D0_{19}$ microstructure were extracted from the samples by creating rectangle-topped wedges using the FEI dual-beam FIB and attached to a Si micropost on a coupon. Sectioned wedges on the silicon micropost were then sharpened using $Ga^+$ to a about 25 nm minimum radius. APT was performed using a Cameca local-electrode atom-probe (LEAP) 4000X-Si system (a 5000X-Si system was used for the 64-hour aged Co-6Nb-6V condition) with picosecond ultraviolet (wavelength=355 nm) laser with a specimen temperature of about 25 K, a pulse energy of 30 pJ, a 500-kHz pulse repetition rate and a 4% detection rate. Differential Scanning calorimetry (DSC) was performed on 2 hours-aged and on homogenized Co-6Nb-6V alloys from 300° C. to 500° C. (at a rate of 10°/min) using a Mettler-Toledo DSC822e. All phases presented here are studied based on morphology, microstructure and composition (using EDS and APT) in comparison with other published studies.

Experimental Results

Figure 19:
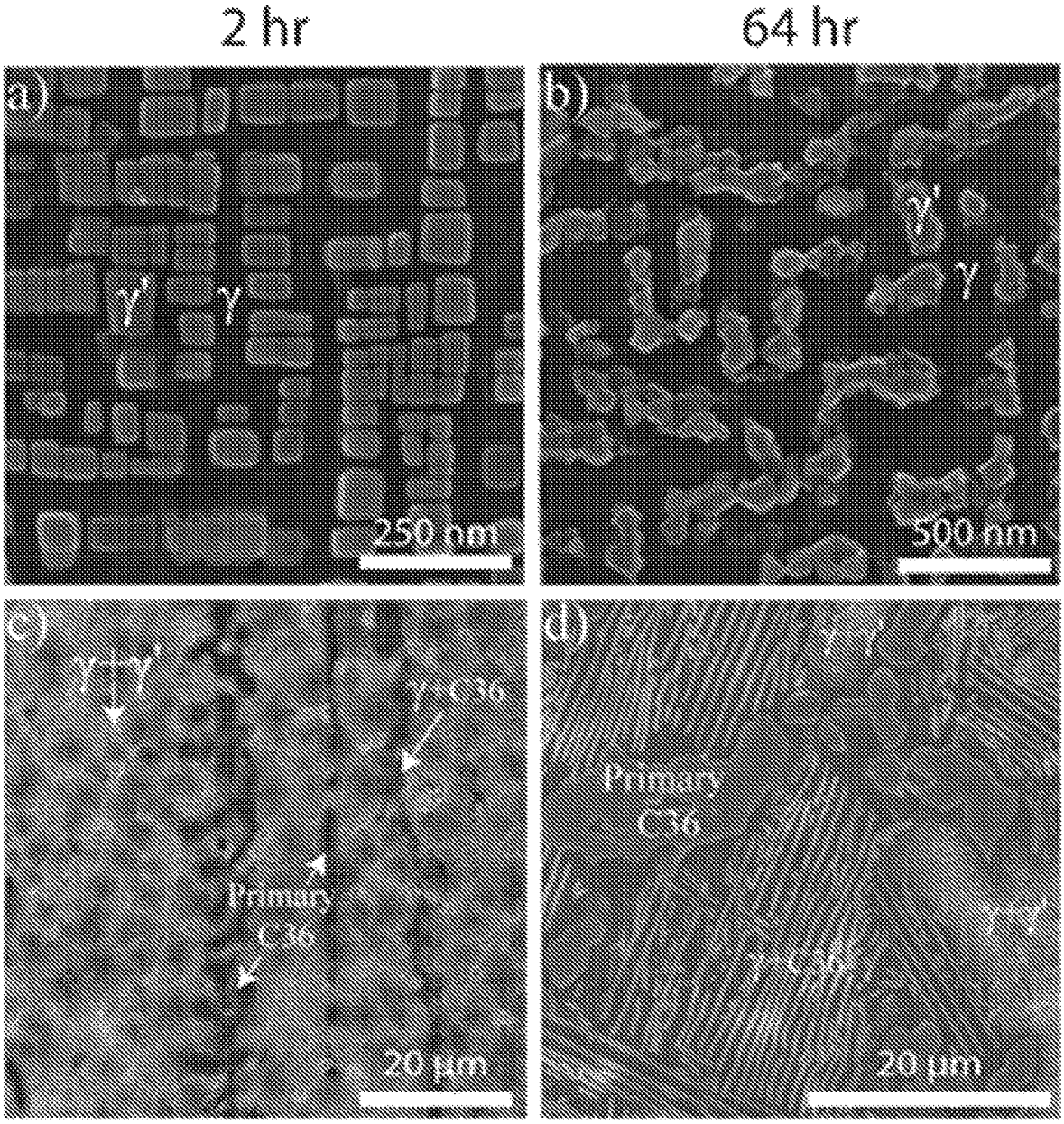
FIG. 19 presents high-magnification (top row) and low-magnification (bottom row) SEM micrographs for Co-6Ta-6V aged at 900° C. for 2 and 64 hours, showing the presence of: (top row) γ+γ' microstructure and (bottom row) primary and lamellar C36 precipitates, according to embodiments of the invention.

Microstructure Evolution for Co—Ta—V: FIG. 19 shows high- and low-magnification SEM micrographs for the Co-6Ta-6V alloy aged at 900° C. for 2 and 64 hours. A representative high-magnification micrograph is shown in portion a) of FIG. 19 for the alloy aged for 2 hours, which displays the presence of cuboidal γ'-$L1_2$ precipitates within a chemically-etched dark background of γ-Co matrix. Using ImageJ thresholding on two micrographs, the γ' volume fraction and average size are measured to be 44% and 48±18 nm, respectively. After aging for 64 hours, portion b) of FIG. 19 shows that the γ'-precipitates coarsen and partially lose their cuboidal shape.

Figure 31:
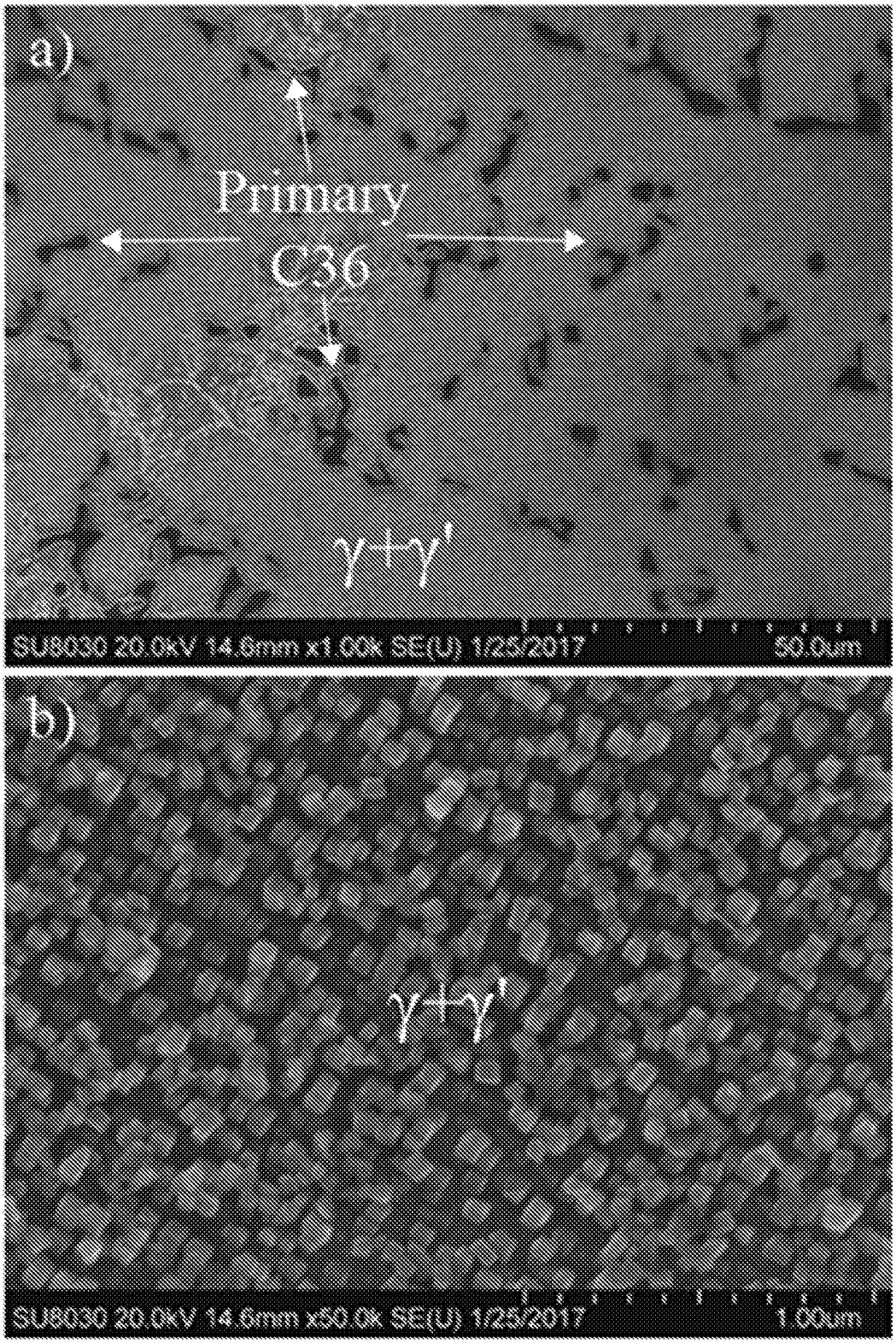
FIG. 31 presents low- and high-magnification SEM micrographs of Co-6Ta-6.6V in the as homogenized condition (homogenized at 1250° C. for 48 hours) and furnace cooled showing: portion a), dendritic, globular C36 primary precipitates; and portion b), the fine γ+γ' microstructure, according to embodiments of the invention.
Figure 32:
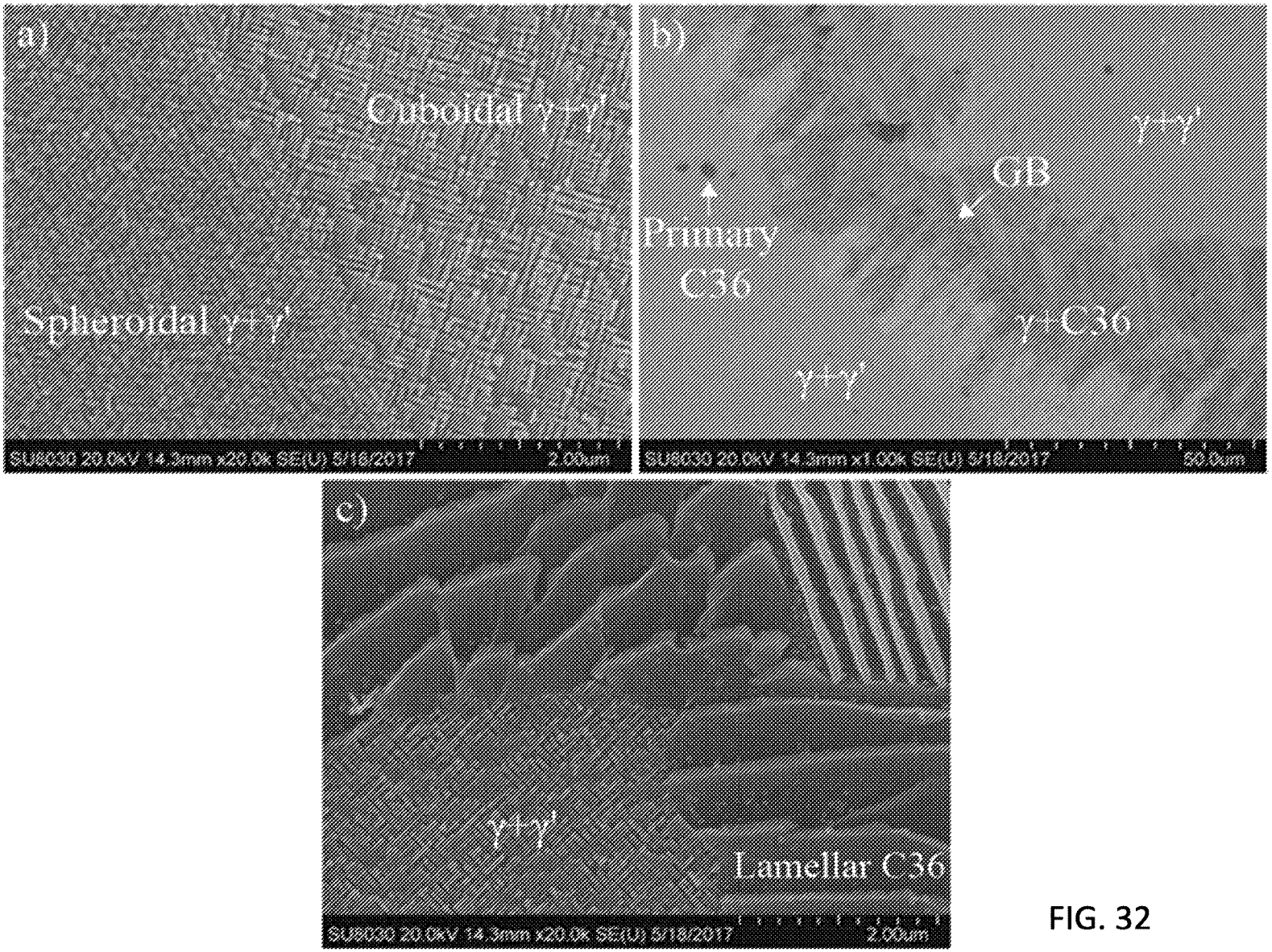
FIG. 32 presents SEM micrographs for Co-5.4Ta-6.6V-2.5Ni, aged for 2 hours at 900° C., showing: portion a), γ' precipitates with spheroidal and cuboidal morphologies; portion b), γ+γ' microstructure being consumed by lamellar microstructure growing from a grain boundary; and portion c), the front of C36 plates growing into a γ+γ' region, according to embodiments of the invention.

Portion c) of FIG. 19 is a low magnification micrograph, at 2 hours of aging, showing wide regions with the fine γ+γ' microstructure shown at higher magnification, as illustrated in portion a) of FIG. 19, coexisting with much coarser, dendritic precipitates. These are expected to be C36-Laves phase, most probably created during solidification as they are also present after homogenization before any aging together with the fine γ+γ' microstructure, as illustrated in FIGS. 31 and 32. Using ImageJ thresholding on one low-magnification SEM micrograph (with 0.124 $mm^2$ area) of the as-homogenized alloy, the volume fraction of C36 primary precipitates was measured as about 7%, with an average precipitate size of about 2±0.9 μm (measured on about 400 precipitates). Also, the identification of the C36-Laves phase is based on the published phase diagrams which show the Co-6Ta-6V composition to be in the two-phase field fcc-γ+$Co_7(Ta,V)_2$ at 900° C. and fcc-γ+C36 at more than 1100° C., and do not display the γ'-phase. After 64 hours of aging, as shown in portion d) of FIG. 19, most of the γ+γ' regions have been consumed by a lamellar phase (expected to be C36-$Co_3$(Ta,V)) embedded in the γ matrix; still, a few γ+γ' regions remain, with the coarsened structure shown at higher magnification, as shown in portion c) of FIG. 19. This is consistent with the γ' phase being metastable at 900° C. and being replaced upon aging by stable, lamellar C36-$Co_3$(Ta,V), similar to the results reported by Shinagawa et al. in the Co—Ta binary system, where metastable $L1_2$-$Co_3Ta$ precipitated in γ-Co is consumed by lamellar domains of γ-Co+C36-$Co_3Ta$ after aging at 1000° C. for 1 hour.

Figure 20:
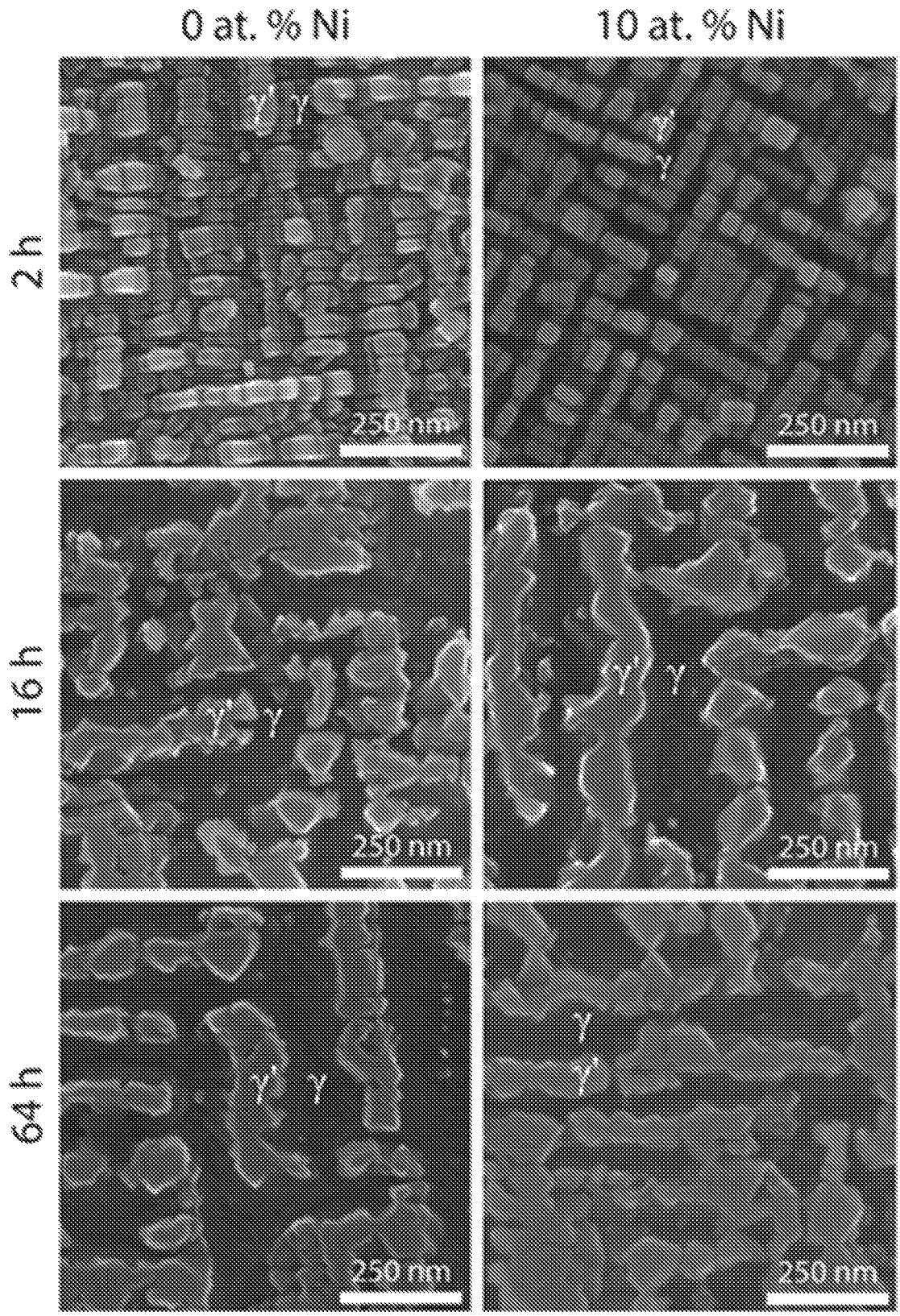
FIG. 20 presents high-magnification SEM micrographs of Co-5.4Ta-6.6V (left column) and Co-5.4Ta-6.6V-10Ni (right column), aged at 900° C. for 2, 16 and 64 hours, showing cuboidal γ'-phase morphology evolution and coarsening as a function of time, according to embodiments of the invention.

With the goal of stabilizing the γ'-$L1_2$ precipitates present at early aging times in the Co-6Ta-6V alloy, two new alloys were arc-melted with nominal compositions Co-5.4Ta-6.6V-xNi (x=0 and 10 at. %). The modified ternary alloy composition of Co-5.4Ta-6.6V corresponds to the SEM-EDS measurements obtained from the γ+γ' regions of the Co-6Ta-6V aged for 2 hours at 900° C. FIG. 20 shows high magnifications SEM micrographs for ternary Co-5.4Ta-6.6V (left column) and quaternary Co-5.4Ta-6.6V-10Ni (right column) aged for 2, 16 and 64 hours at 900° C. For both alloys after 2 hours of aging, cuboidal γ' precipitates are seen over a chemically-etched dark background matrix of γ-Co. After 16 hours of aging, precipitates in both alloys undergo growth and coarsening and start losing their cuboidal shape. This process continues after 64 hours of aging, with the γ' precipitates coalescing into elongated precipitate. The γ' morphology is indistinguishable between the two alloys at all aging time.

Apart from the alloys disclosed above, a button ingot of about 20 g with nominal composition Co-5.4Ta-6.6V-2.5Ni was produced using high purity Co (99.99%), Ta (99.99%), V (99.99%), and Ni (99.99%). The button ingot was arc melted under a partial Ar atmosphere and homogenized following the same procedure described above. Microstructure characterization was performed using SEM. FIG. 32 shows high-magnification and low-magnification images of the microstructure of Co-5.4Ta-6.6V-2.5Ni aged for 2 hours at 900° C. As shown in portion a) of FIG. 32, two grains with different γ' morphology are visible, with the grain on the left and right side of the micrographs showing spheroidal and cuboidal γ' precipitates, respectively. In comparison, neither the Co-6Ta-6V alloy nor the Co-5.4Ta-6.6V-0/10Ni alloys contained spheroidal γ' precipitates. Primary C36 precipitates and the lamellar phase seen in the other Co—Ta—V (—Ni) alloy are also present in this alloy, as shown in portion b) of FIG. 32, which shows that the transformation to lamellar C36 starts after 2 hours of aging and spreads from grain boundaries, consuming the γ' precipitates. A high magnification micrograph shown in portion c) of FIG. 32 shows the reaction front, where lamellar C36 precipitates grow into a γ+γ' region.

Figure 21:
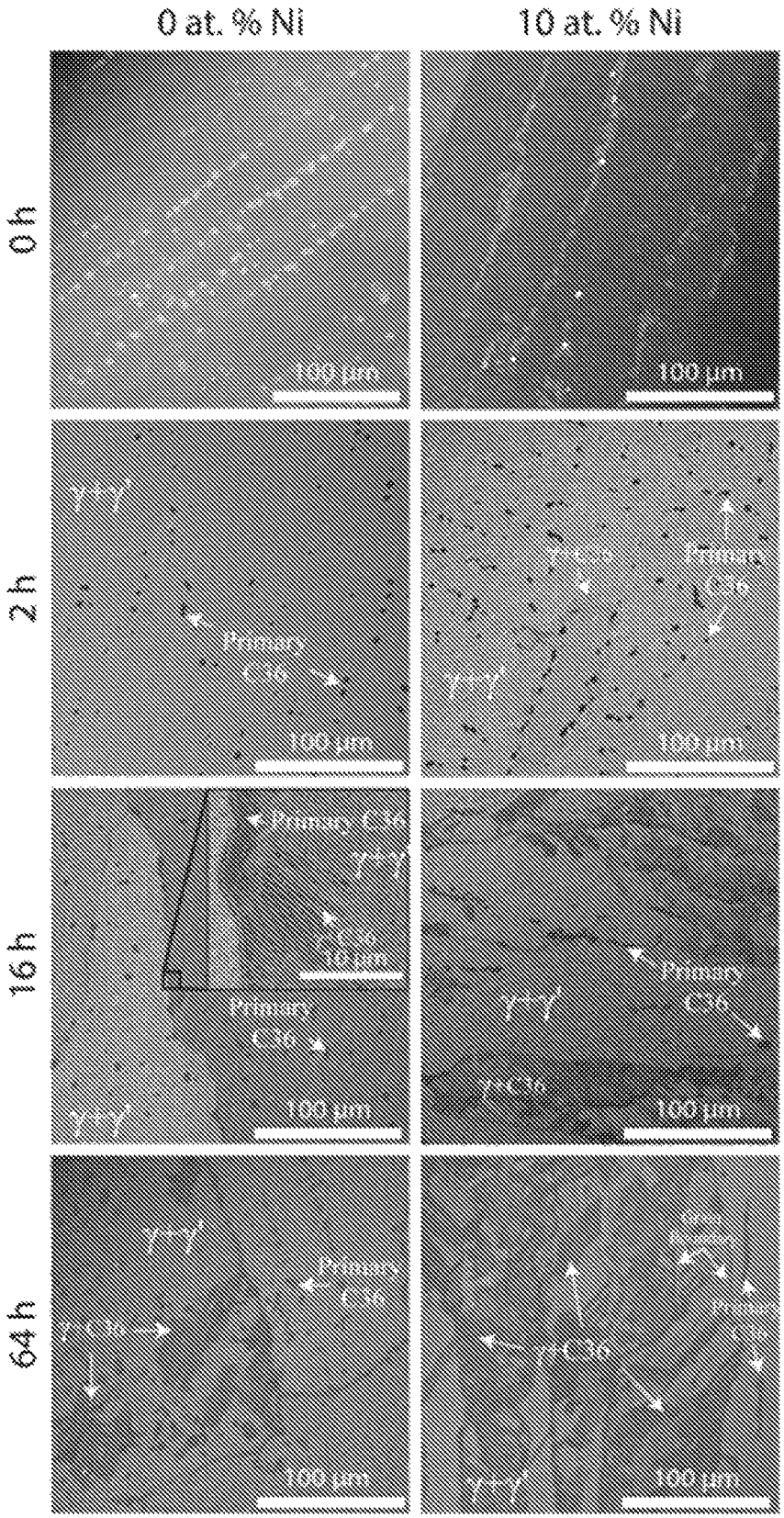
FIG. 21 presents low-magnification SEM micrographs of Co-5.4Ta-6.6V (left column) and Co-5.4Ta-6.6V-10Ni (right column), aged at 900° C. for 0, 2, 16 and 64 hours, showing the growth of discontinuously precipitated γ+lamellar C36 at the expenses the γ+γ' structure, according to embodiments of the invention.

FIG. 21 provides low magnification micrographs of Co-5.4Ta-6.6V illustrating the presence of C36 primary precipitates within the γ-Co matrix in the as homogenized alloys, with very fine γ' precipitates. As for the Co-6Ta-6V alloy, as shown in portions c) and d) of FIG. 19, these C36 primary precipitates are globular in shape, and arranged in linear structures that appear dendritic. At 2 hours of aging, the γ+γ' microstructure is present in the alloy, together with the C36 primary precipitates which EDS measurements show to be rich in Ta (about 24 at. %) and poor in V (about 2 at. %), consistent with the C36-$Co_3$(Ta,V) phase present in the phase diagram (at 1300° C.) [25]. Using ImageJ thresholding on two low-magnification SEM micrographs (with combined areas of 0.127 $mm^2$) of the as-homogenized alloy, the volume fraction of C36 primary precipitates was measured as about 4%, with an average precipitate size of 3±1.3 μm (measured on about 60 precipitates). After 16 hours of aging, a lamellar phase is formed (magnified insert in FIG. 21), with a morphology consistent with discontinuous precipitation. Dark regions of the lamellae are assigned to the γ-Co matrix and gray regions to the C36-$Co_3$(Ta,V). In comparison with the Co-6Ta-6V alloy aged for 2 hours discussed previously, the Co-5.4Ta-6.6V alloy contains a noticeably lower volume fraction of C36 precipitates (as determined by visual inspection). This difference is confirmed at 64 hours of aging: for the Co-6Ta-6V alloy, about 90% of the γ+γ' microstructure has transformed into the lamellar γ+C36 microstructure, whereas in the modified Co-5.4Ta-6.6V alloy, the transformed volume fraction is about 50%.

Figure 33:
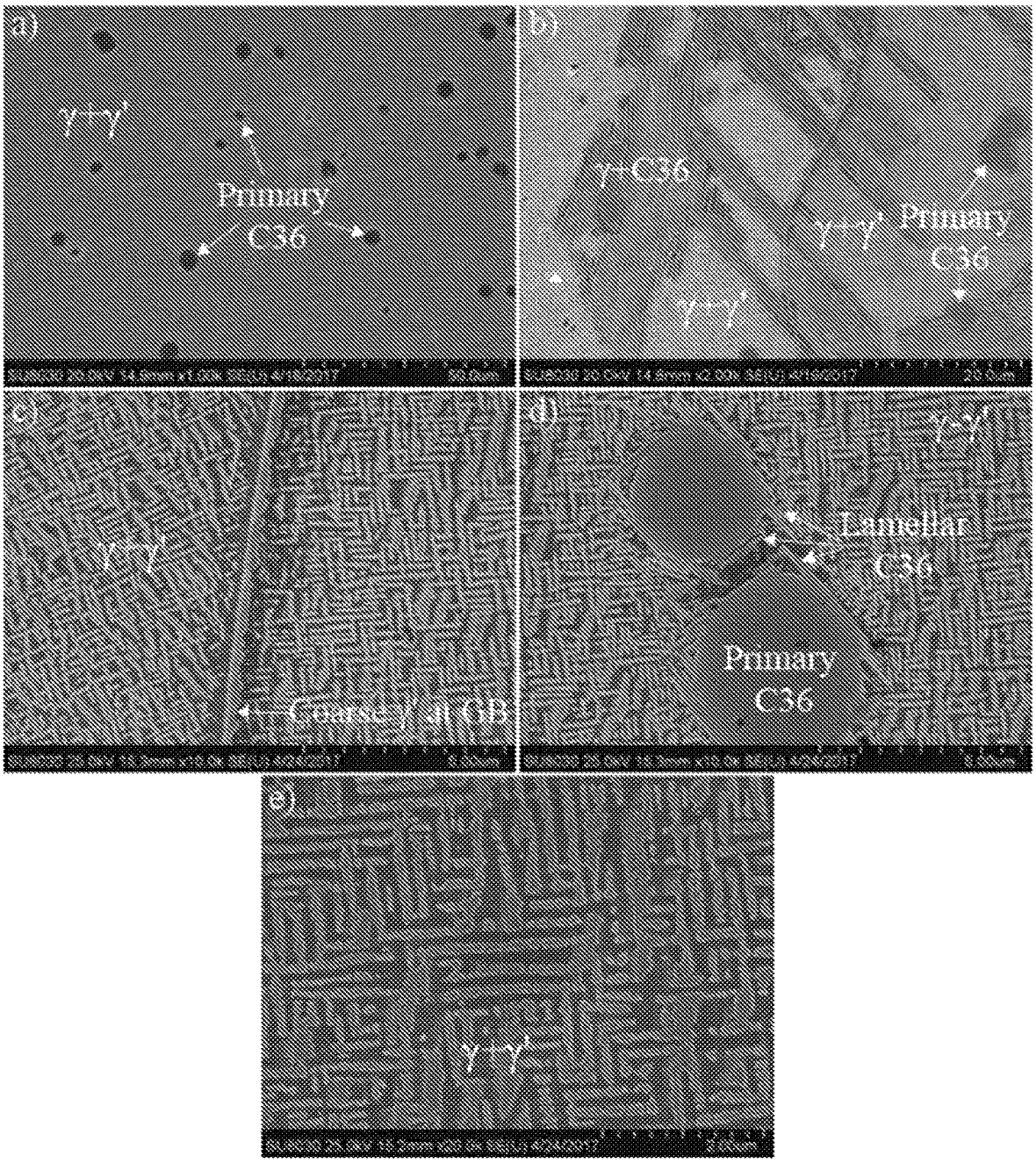
FIG. 33 presents SEM micrographs for Co-5.4Ta-6.6V aged for (portion a)) 2 hours, (portion b)) 16 hours and (portions c)-e)) 64 hours at 900° C., showing: portion a), γ+γ' microstructure with large primary C36 precipitates; portion b), γ+γ' microstructure with lamellar γ+C36 region growing from grain boundaries with a few primary C36 precipitates; portion c), two grains with γ+γ' microstructure in different orientations, with γ' precipitated at the GB as a film; portion d), two primary blocky C36 precipitates with C36 lamellae growing from their surfaces, surrounded by the γ+γ' microstructure; and portion e), γ+γ' microstructure after 64 hours of aging, showing coarsened, coalesced γ' precipitates, according to embodiments of the invention.
Figure 34:
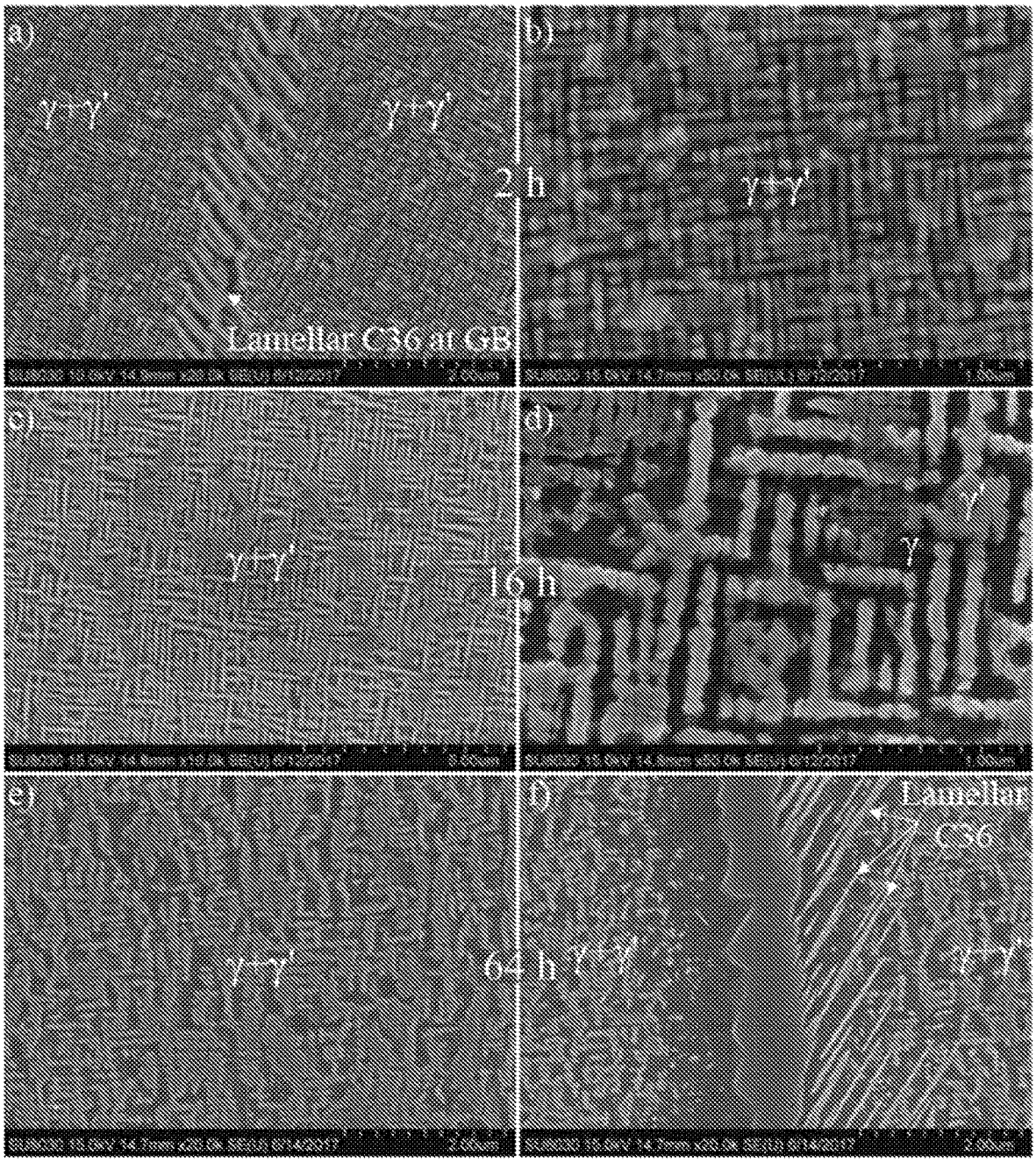
FIG. 34 presents SEM micrographs for Co-5.4Ta-6.6V-10Ni aged for (portions a) and b)) 2 hours, (portions c) and d)) 16 hours and (portions e) and f)) 65 hours at 900° C., showing a predominantly γ+γ' microstructure after 2, 16 and 64 hours (portions b)-e)), according to embodiments of the invention. Further visible are: portion a), two grains with γ+γ' microstructure and C36 plates at a grain boundary; and portion f), C36 film at a grain boundary with protruding C36 needles growing into one of the grains.

The Co-5.4Ta-6.6V-10Ni quaternary alloy shows a microstructure very similar to the Co-5.4Ta-6.6V alloy at 2 hours of aging, with the γ+γ' microstructure present together with the globular C36 primary precipitates, as illustrated in FIG. 21. However, in the quaternary alloy, the discontinuous precipitation of lamellar C36 starts after 2 hours of aging, compared to 16 hours in the ternary Co-5.4Ta-6.6V alloy. Finally, as in the two other ternary alloys, lamellar C36 phase grows at the expense of the γ+γ' microstructure after aging for 64 hours by visual inspection, it is apparent that more than 50% of the γ+γ' microstructure has transformed into a lamellar microstructure. Additional low magnification micrographs, showing the γ+γ' microstructure and C36 precipitate morphology, for the Co-5.4Ta-6.6V and Co-5.4Ta-6.6V-10Ni alloy, are shown in FIGS. 33 and 34, respectively, showing microstructure of Co-5.4Ta-6.6V alloy aged for 2, 16 and 64 hours at 900° C.

Figure 22:
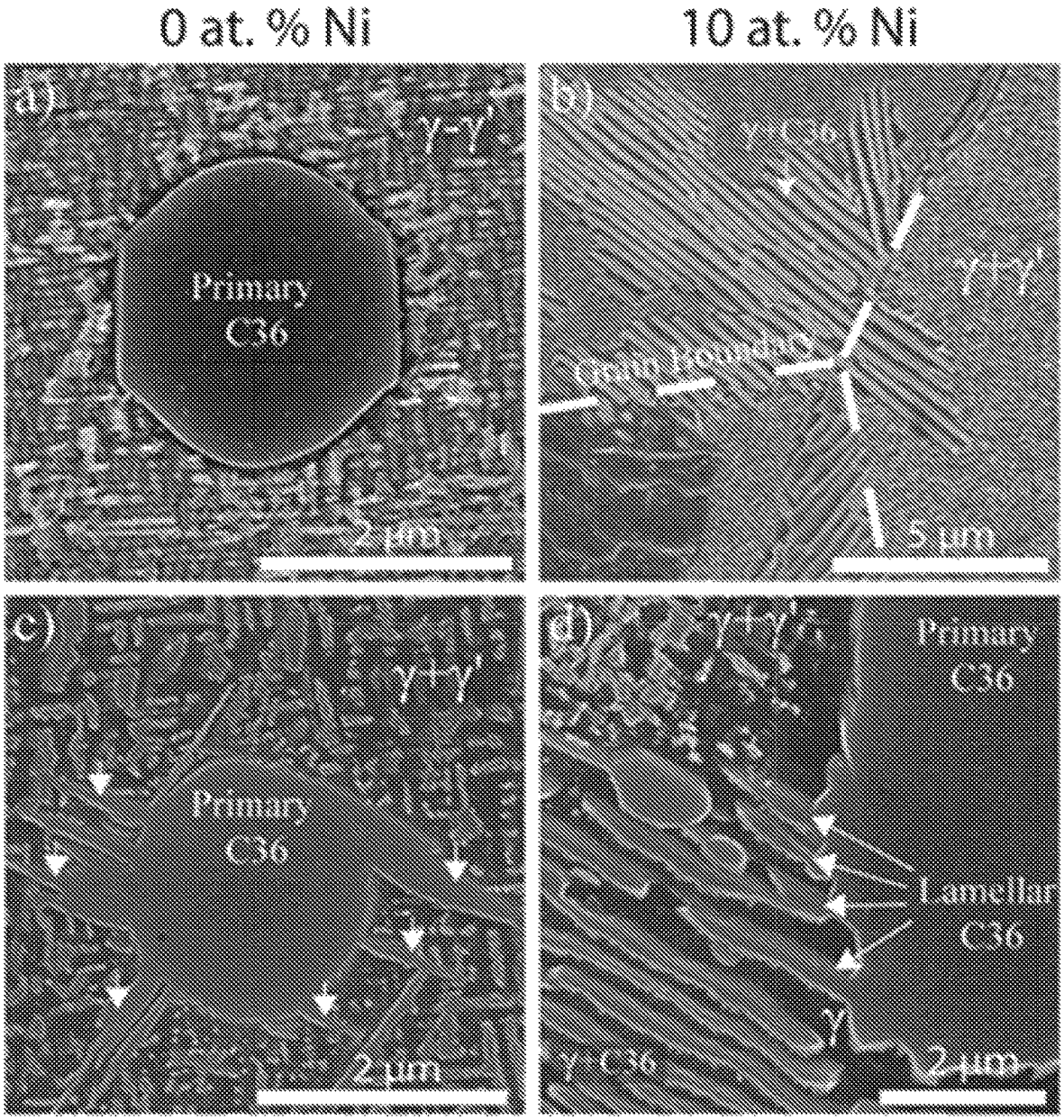
FIG. 22 presents SEM micrographs of Co-5.4Ta-6.6V (left column) and Co-5.4Ta-6.6V-10Ni (right column) aged at 900° C. showing: portion a), primary C36 precipitate surrounded by γ+γ' microstructure (aged for 2 hours); portion b), discontinuously-transformed lamellar C36 phase growing from grain boundaries into grains with γ+γ' microstructure (aged for 2 hours); portion c), primary C36 precipitate with lamellar arms (indicated by arrows) growing in different crystallographic directions (aged for 64 hours) at the expense of the γ+γ' microstructure; and portion d), idem, but aged for 16 hours, according to embodiments of the invention.
Figure 27:
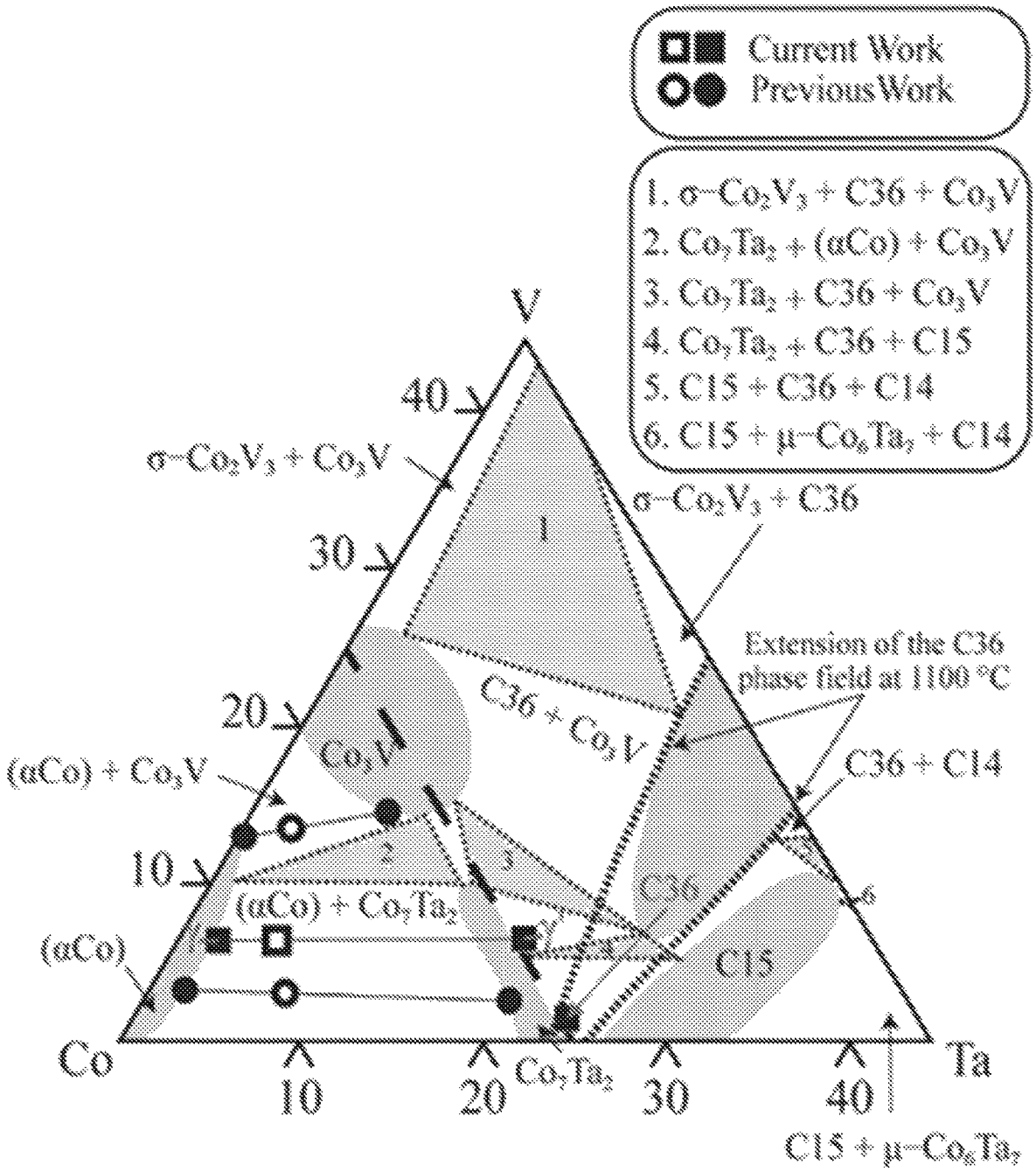
FIG. 27 shows Co-rich isothermal section of the Co—Ta—V ternary system at 900° C. created by Ruan et al. showing the phases (identified as current work) according to this embodiment of the invention as well as Ruan et al. study (identified as previous work). Hollow symbols represent alloy bulk composition, according to embodiments.

FIG. 22, shows high magnification images of the non-γ' phases present and their microstructural evolution over time in the Co—Ta—V-0/10Ni alloys aged at 900° C. The initial primary C36 precipitates, as shown in portion a) of FIG. 22, existing in the as homogenized samples display, signs of dendritic formation, as shown in FIG. 21. Precipitates with the same morphology and similar $Co_3$(Ta,V) and $Co_3$Ta compositions, formed during solidification, are reported by Ruan et al. in the Co—Ta—V system and Shinagawa et al. in the Co—Ta binary system [27]. Experimental isothermal ternary phase diagrams for 1100, 1200 and 1300° C. [25] show an extension of the C36 phase field to the composition of our measured C36 concentration, as shown in FIG. 27. Therefore, it is concluded that the large primary C36 precipitates in all three Co—Ta—V(—Ni) alloys are likely formed in our sample during solidification and are remain undissolved after homogenization due to their high stability, based on the experimental isothermal phase diagram at 1100° C. (and higher temperatures) produced by Ruan et al. [25].

After short aging times, in both Ni-free and Ni-containing Co-5.4Ta-6.6V alloys, the $L1_2$-ordered γ' phase cuboidal precipitates transform discontinuously into lamellar domains of γ-Co+C36, as illustrated in portions b) and c) of FIG. 22. In alloy Co-5.4Ta-6.6V, primary C36, as shown in portion a) of FIG. 22, does not evolve until the later ages of aging (16-64 hours) where lamellar domains start growing from primary C36 precipitates, as shown in portion c) of FIG. 22, and from the grain boundaries. In alloy Co-5.4Ta-6.6V-10Ni, the discontinuous precipitation of γ+C36 starts after 2 hours of aging (as shown in the right column of FIG. 21) and significant growth of the lamellar phases is seen mostly from the grain boundaries, as shown in portion b) of FIG. 22. The same type of microstructure evolution is reported in binary Co—Ta alloys after aging at 1000° C. for 1 hour [27].

Figure 23:
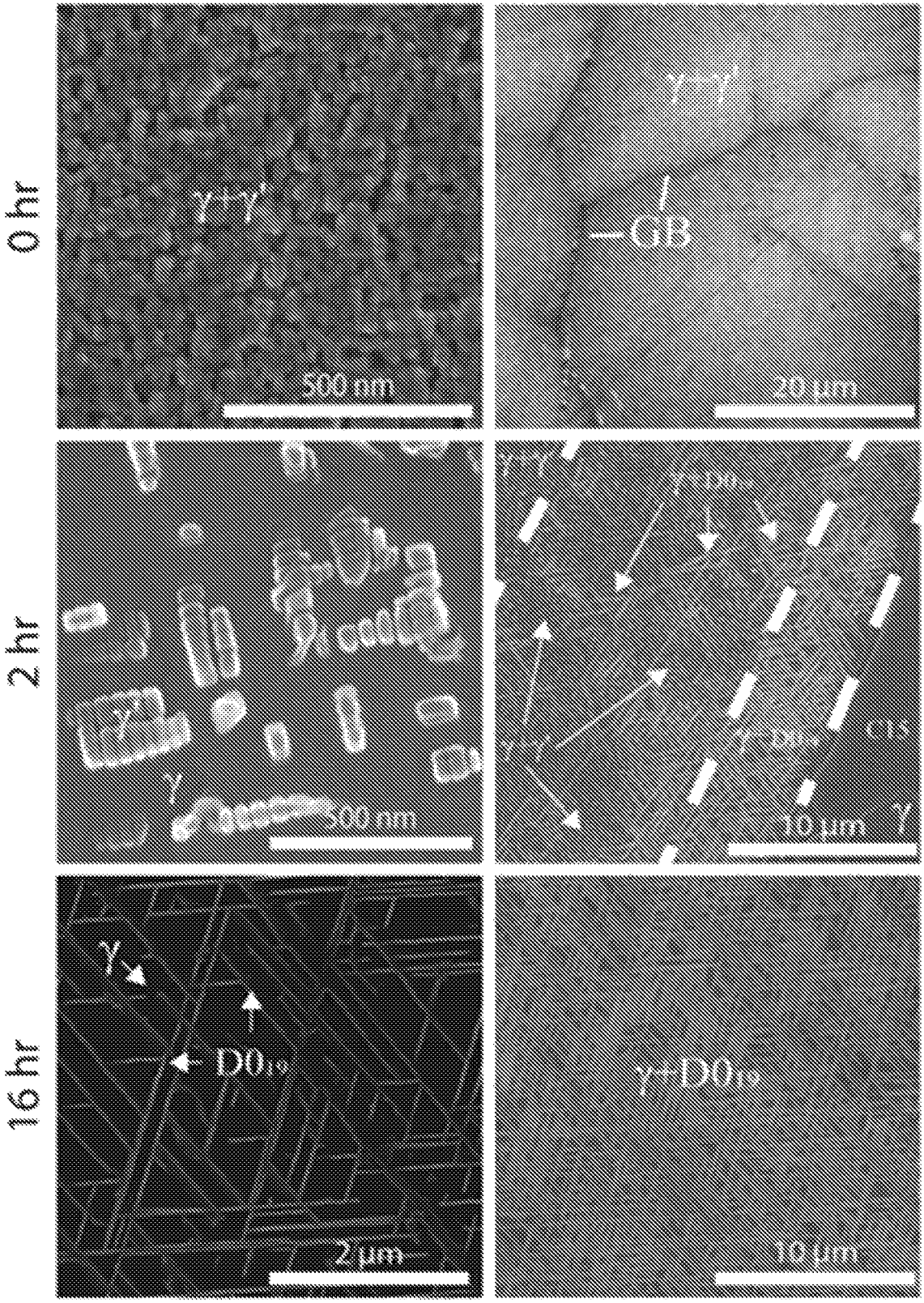
FIG. 23 presents high-magnification (left column) and low-magnification (right column) SEM micrographs of Co-6Nb-6V aged at 900° C. for 0, 2 and 16 hours, showing γ, γ', D019-$Co_3$(Nb,V) (needle-shape phase) and C15-$Co_2$(Nb,V), according to embodiments of the invention.

Microstructure Evolution for Co-6Nb-6V: FIG. 23 shows micrographs at high magnification (left column) and low magnification (right column) for the Co-6Nb-6V alloy after 0, 2, 16, and 64 hours aging at 900° C. In the as-homogenized state (0 hour aging), a high volume fraction of very fine cuboidal precipitates are present, which formed on furnace cooling from 1250° C., and are assigned to the γ'-phase (as confirmed in the next section via APT). At 2 hours of aging, the cuboidal γ' precipitates are seen in FIG. 23 over a chemically-etched dark background matrix of γ-Co, and display a larger size and lower volume fraction, consistent with simultaneous coarsening and dissolution. The low-magnification micrograph for 2 hours of aging in FIG. 23 shows the growth of needle-like precipitates displaying a Widmanstätten microstructure similar to $Co_3W$ needle-like precipitates reported in the Co—W binary system [28] that have a $D0_{19}$ structure. Thus, the precipitates shown in FIG. 23 are assigned to the $D0_{19}$ phase, close to the $Co_3$(Nb,V) composition (based on APT measurements reported in the next section). However, the ternary Co—Nb—V phase diagram shows that the alloy should be in the two-phase region fcc-γ+$Co_7$(Nb,V)$_2$. Thus, the γ' phase seen in the as homogenized alloy is metastable.

Figure 30:
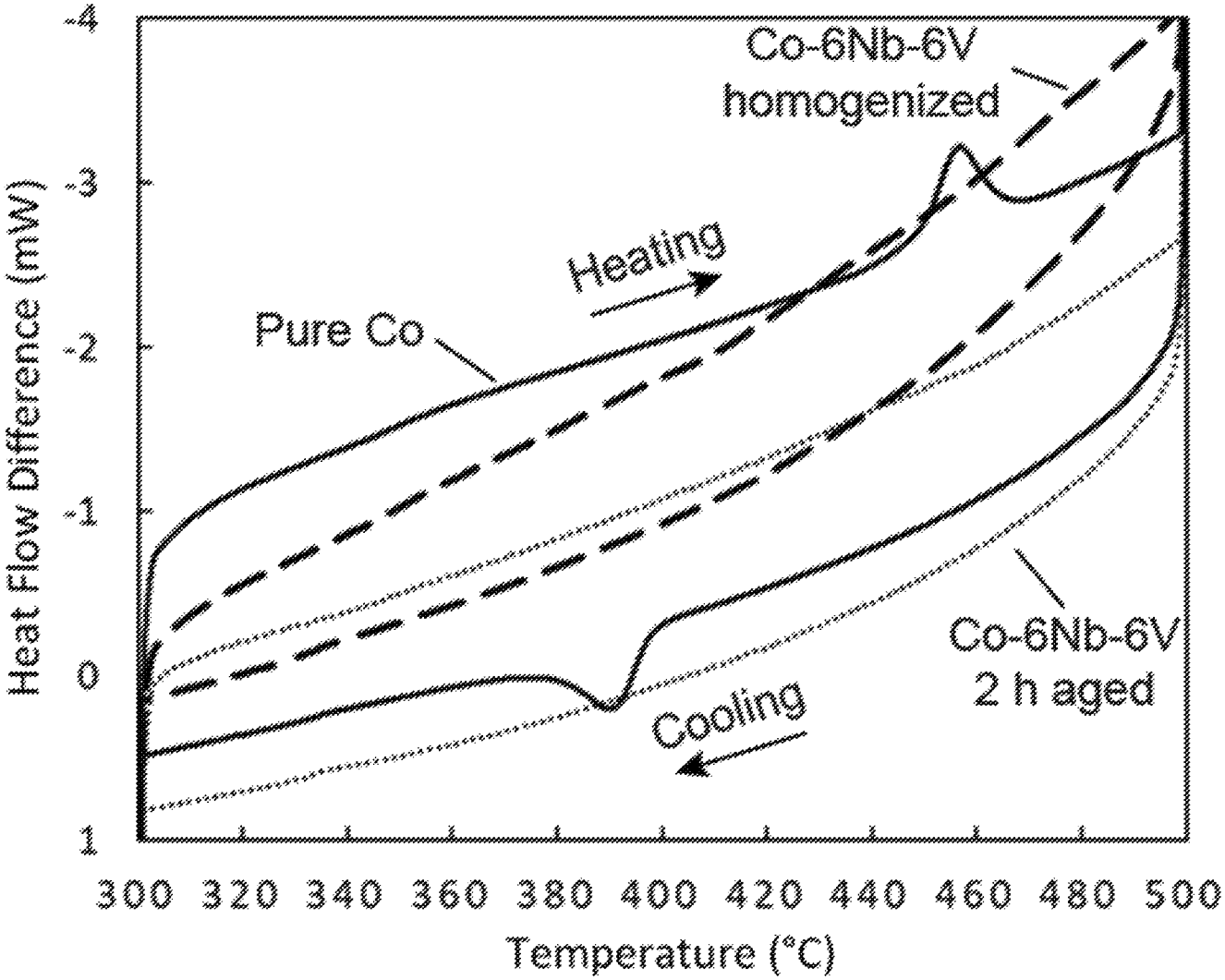
FIG. 30 shows differential scanning calorimetry (DSC) curves of pure Co and Co-6Nb-6V (homogenized and aged for 0 and 2 hours at 900° C.), according to embodiments of the invention. Peaks in the pure Co curve corresponds to the fcc/hcp transformation.
Figure 35:
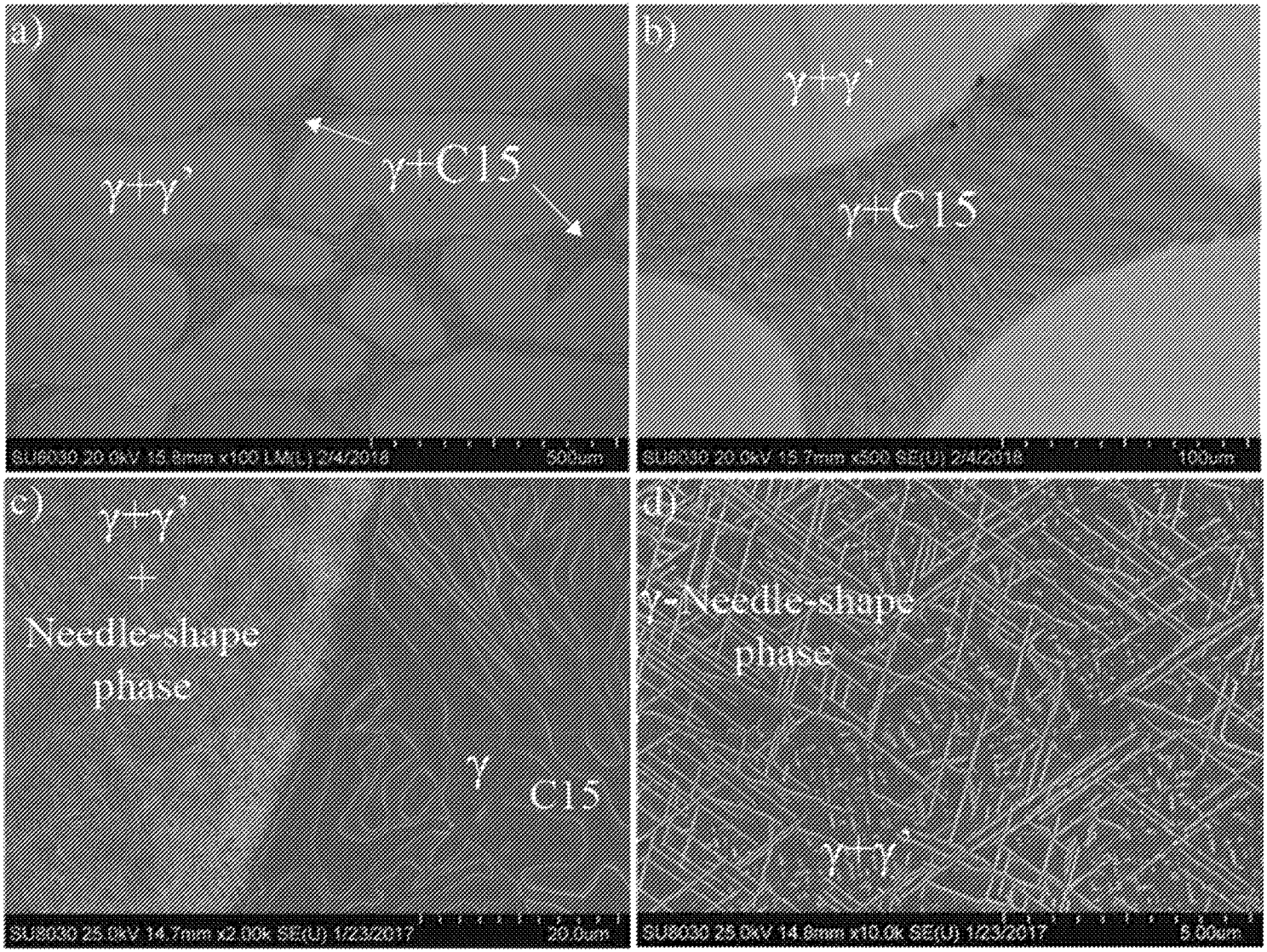
FIG. 35 presents SEM micrographs for Co-6Nb-6V of homogenized (portions a) and b), furnace cooled)) and aged for 2 hours at 900° C. (portions c) and d), quenched)) alloys, showing: portions a) and b), low-magnification micrographs of γ+γ' regions (light grey) with γ+C15-$Co_2$(Nb,V) (dark grey) regions; portion c), mixed regions of (γ+γ') consumed by (γ+$D0_{19}$-$Co_3$(Nb,V)) shown in portion d) at higher magnification (light grey, left side) and a two-phase region of γ+C15-$Co_2$(Nb,V) (dark grey, right side); and portion d), high magnification micrograph showing pockets of γ+γ' being consumed by expanding regions of γ+$D0_{19}$-$Co_3$(Nb,V) needles, according to embodiments of the invention.

Also present in the alloy are two-phase regions of fcc-γ+$Co_2$(Nb,V) based on EDS and shown at higher magnification in portions a)-c) of FIG. 35, the latter phase being consistent with the C15 phase, and having a cutectic morphology with some areas coarser than others, which Wang et al. reported in the ternary phase diagram [26]. The two-phase (γ+C15) regions, with an about 20% volume fraction, appear to have formed during solidification following a eutectic reaction. The overall volume fraction of C15-$Co_2$(Nb,V) is less than 10%, with platelets being about 6 μm wide and about 50 μm long. As illustrated in FIG. 23, it appears that the phase transformation starts at the regions closest to the γ+C15 two-phase region, creating regions of needle-like Widmanstätten $D0_{19}$-$Co_3$(Nb,V) at the expense of the cuboidal γ' precipitates. After 16 hours of aging, these have completely disappeared and the needle precipitates with the Widmanstätten morphology prevail. A higher magnification micrograph displaying regions of γ+D019 with some remaining γ+γ' pockets is shown in portion d) of FIG. 35. The lack of fcc/hcp transformation in the Co—Nb—V alloy was briefly investigated using DSC, which the results are shown in FIG. 30. No sign of the fcc/hcp transformation in the Co-6Nb-6V alloy was found by means of DSC from 300° C. to 500° C. (at a rate of 10° C./min) shown in FIG. 30 is the 10th cycle for two alloy conditions. Other studies have shown that the addition of Nb decrease the transformation temperature from about 420° C. (pure Co) to about 300° C. [30].

FIG. 31 shows low- and high-magnification micrographs of the microstructure of Co-6Ta-6V, at 0 hour of aging. Portion a) of FIG. 31 shows coarse dendritic precipitates (assigned to the C36 Laves phase) coexisting with regions of fine γ+γ' microstructure. Given that these precipitates are present before aging, it is most likely that they formed during solidification; however, they are not dissolved after high temperature solutionizing. Portion b) of FIG. 31 shows the fine γ+γ' microstructure region with a high volume fraction of cuboidal γ' precipitates.

Figure 24B:
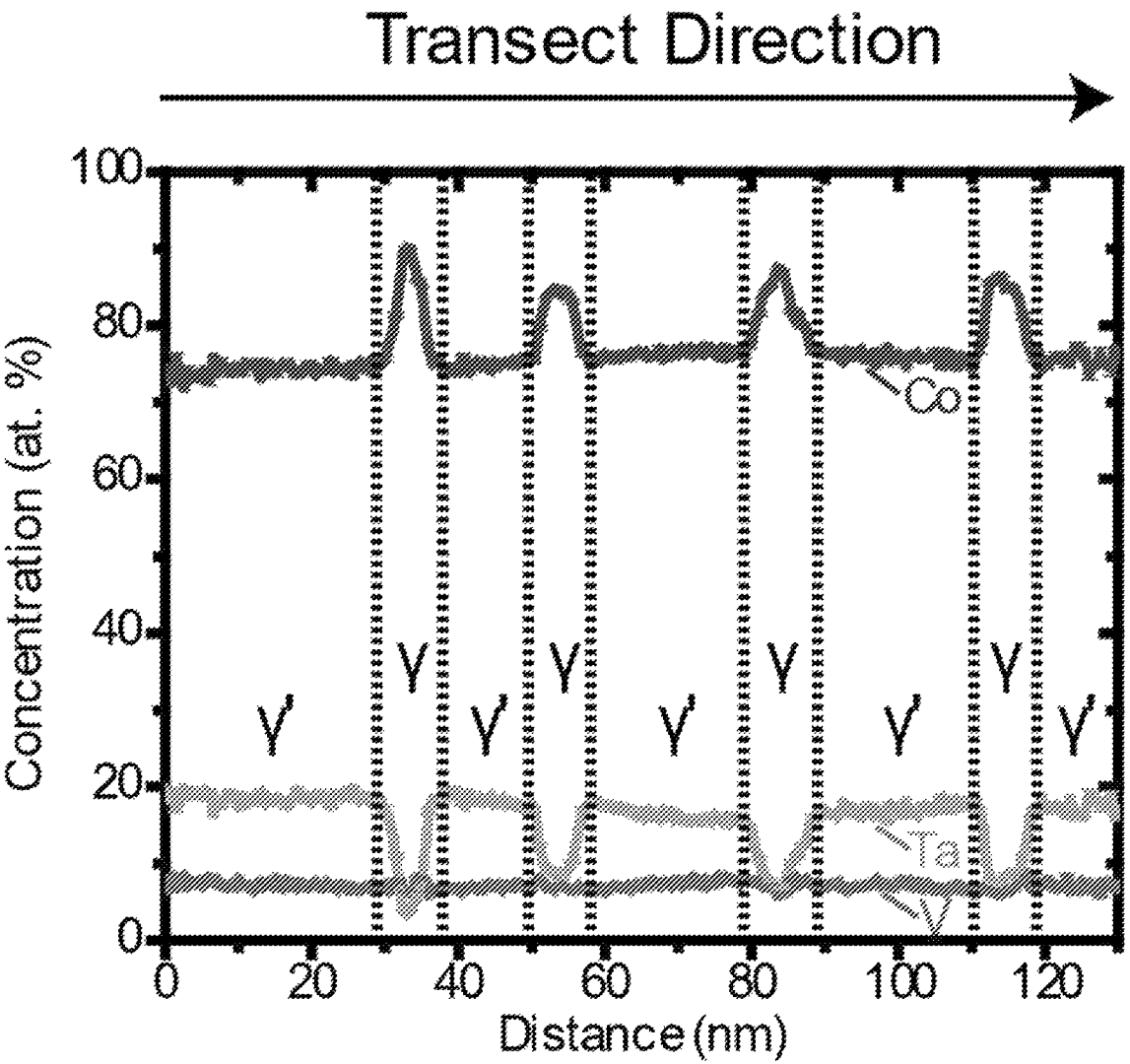
FIGS. 24A and 24B show atom probe tomography (APT) analysis for Co-5.4Ta-6.6V after 2 hours of aging at 900° C., according to embodiments of the invention.
Figure 24A:
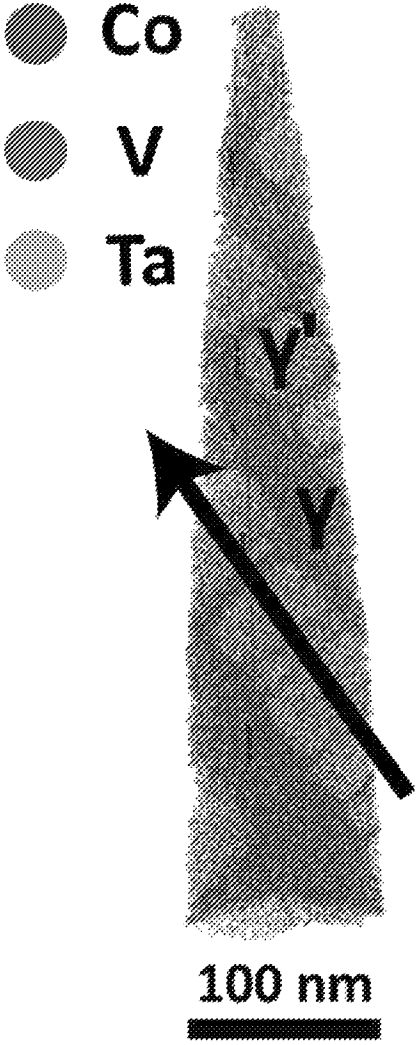

APT Study for Co-5.4Ta-6.6V: FIG. 24A shows a three-dimensional APT reconstruction for the Co-5.4Ta-6.6V alloy aged for 2 hours at 900° C., including 115 million atoms and containing 23 crystallographically-aligned γ' precipitates. A summary of APT composition measurements (calculated from the average of all phases and precipitates in this APT tip) is shown on Table 3: the γ' phase is Co-19Ta-7V while the composition of the thin γ-phase channels is Co-2Ta-7V. Hence. Ta partitions strongly to the γ' phase with a large partitioning coefficient ($K_{Ta}^{\gamma'/\gamma}$=8.5), whereas V shows little partitioning between the two phases ($K_V^{\gamma'/\gamma}$=1.1). A concentration profile is shown, in FIG. 24B, corresponding to a transect across a row of γ' precipitates, and illustrating the strong Ta (and Co) composition variation across the γ- and γ' phases, and the lack of change in V concentrations across the two phases. FIG. 23 shows the composition of each precipitate in the transect, while the composition values reported in the text and Table 3 (used to calculate the partition coefficient) are taken from the global average of all the precipitates in this APT tip.

TABLE 3

Co-5.4Ta-6.6V APT tip average concentration of γ- and γ'-phases and elemental partitioning coefficients ($K^{\gamma'/\gamma}$), as measured by APT after 2 hours of aging at 900° C.

| | Concentration (at. %) | | |
|---|---|---|---|
| Element | γ | γ' | $K^{\gamma'/\gamma}$ |
| Co | 91.20 | 74.00 | 0.81 |
| Ta | 2.20 | 19.00 | 8.54 |
| V | 6.60 | 7.00 | 1.11 |

Figure 25B:
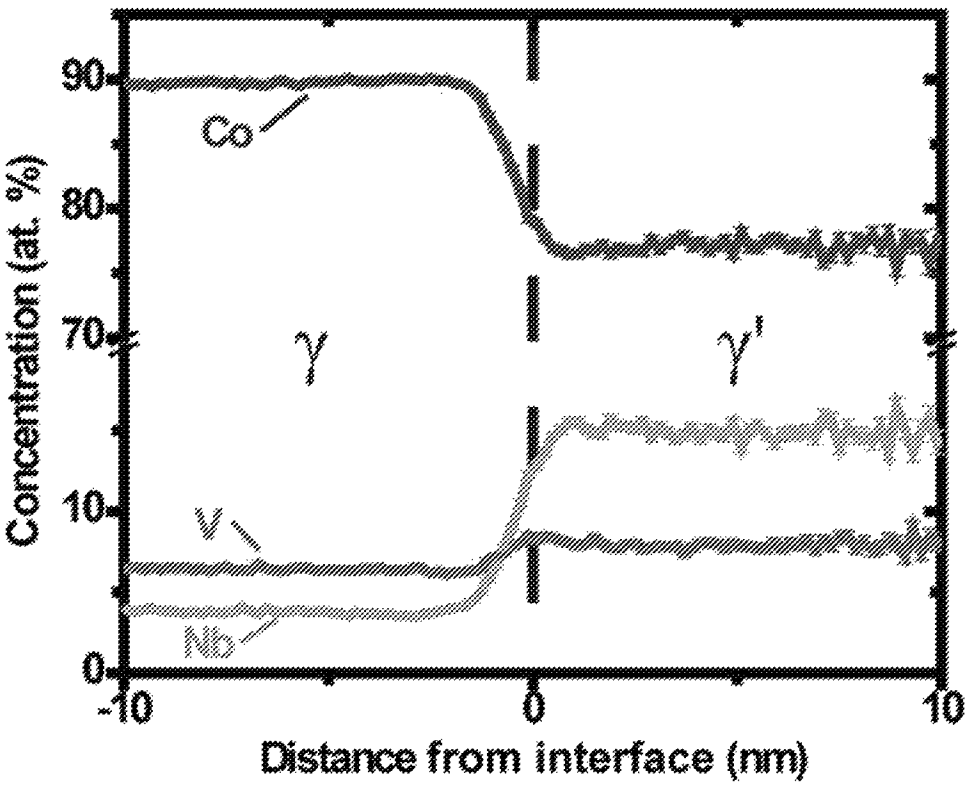
FIGS. 25A and 25B show elemental γ/γ' partitioning for Co-6Nb-6V after 2 hours of aging at 900° C., according to embodiments of the invention.
Figure 25A:
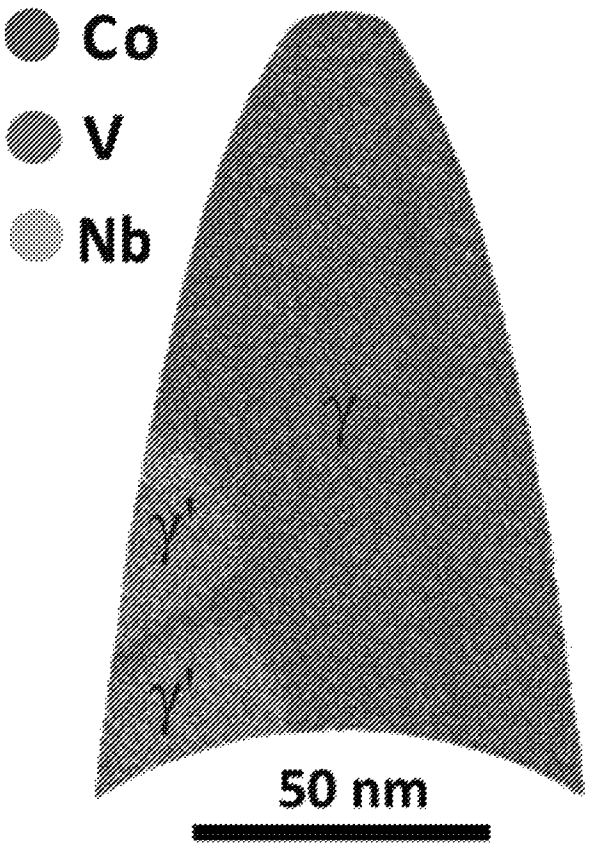
Figure 26B:
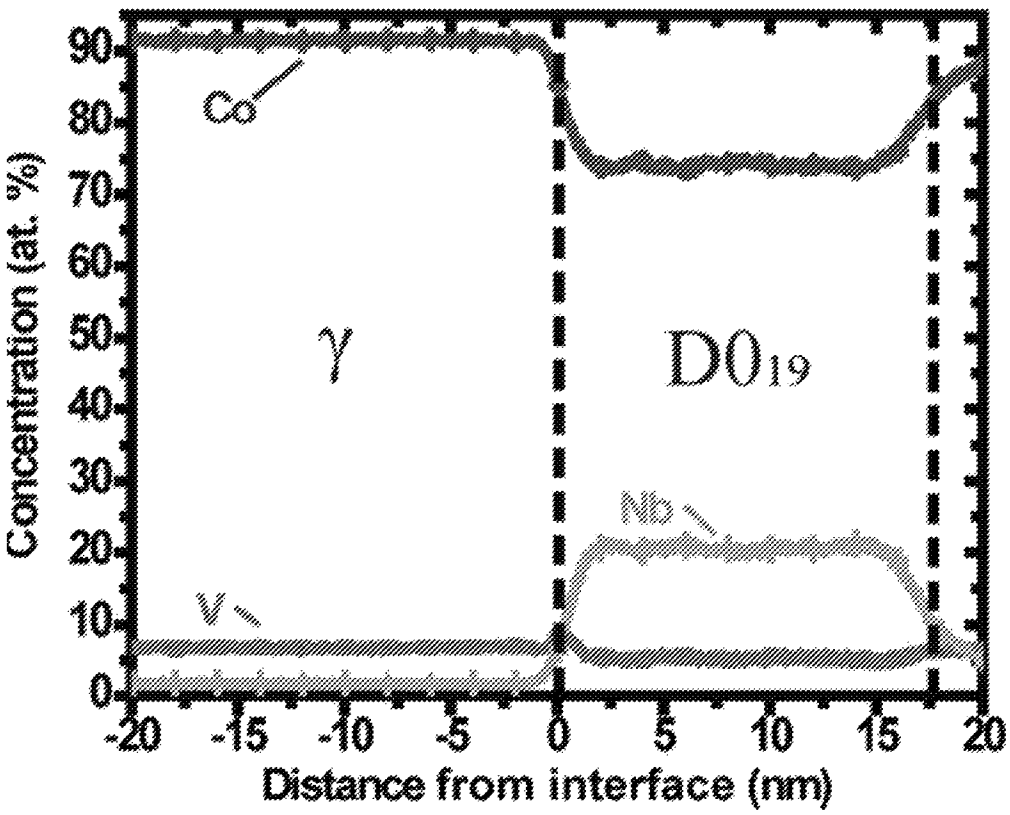
FIGS. 26A and 26B show elemental γ/$D0_{19}$ partitioning for Co-6Nb-6V after 64 hours of aging at 900° C., according to embodiments of the invention.
Figure 26A:
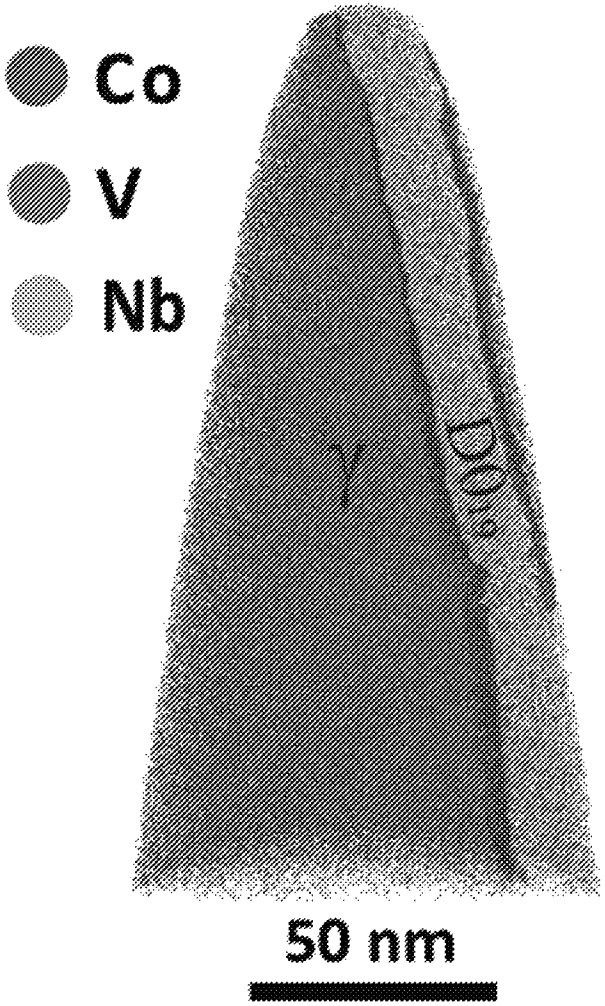

APT Study for Co-6Nb-6V: Three-dimensional APT reconstructions for the Co-6Nb-6V alloy aged for 2 and 64 hours at 900° C. are shown in FIGS. 25A and 26A, respectively. The APT tip for a first condition includes 18 million atoms and contains 2 γ' precipitates. A proximity histogram is shown in FIG. 25B corresponding to the global tip concentration (average of all phases and precipitates). The Nb concentration goes from 3.77 at. % in the γ-phase to 14.87 at. % in the γ' phase with $K_{Nb}^{\gamma'/\gamma}$=3.94, while the V concentration goes from 6.43 at. % in the γ-phase to 7.95 at. % in the γ' phase with $K_V^{\gamma'/\gamma}$=1.24. The composition of the γ' phase is Co-15Nb-8V (close to $Co_3(Nb_{0.65}V_{0.35})$), while the composition of the γ-phase is Co-3Nb-7V. A summary of APT composition measurements for the Co-6Nb-6V alloy aged for 2 hours is shown in Table 4.

TABLE 4

Co-6Nb-6V APT tip average concentration of γ- and γ' phases and elemental partitioning coefficients ($K^{\gamma'/\gamma}$), as measured by APT after 2 hours of aging at 900° C.

| | Concentration (at. %) | | |
|---|---|---|---|
| Element | γ | γ' | $K^{\gamma'/\gamma}$ |
| Co | 89.79 | 77.17 | 0.86 |
| Nb | 3.77 | 14.87 | 3.94 |
| V | 6.43 | 7.95 | 1.24 |

The APT reconstructed tip for the 64 hours aged condition contains one needle-like precipitate, taken to be $D0_{19}$-$Co_3$(Nb,V) based on composition as shown in FIG. 26A. A proximity histogram is given in FIG. 26B corresponding to the interface between the γ matrix and the $D0_{19}$ precipitate. The Nb concentration goes from 1.75 at. % in the γ-phase to 20.60 at. % in the $D0_{19}$ phase with a high partitioning ratio of $K_{Nb}^{D0_{19}/\gamma}$=11.75. The V concentration is 6.79 at. % in the γ-phase and 5.32 at. % in the $D0_{19}$ phase showing mild partitioning to the γ-phase with $K_V^{D0_{19}/\gamma}$=0.78. The composition of the $D0_{19}$ phase is Co-21Nb-5V (close to $Co_3(Nb_{0.81}V_{0.19})$) while the composition of the γ-phase is Co-2Nb-7V. A summary of APT composition measurements for the Co-6Nb-6V alloy aged for 64 hours is shown in Table 5.

TABLE 5

Co-6Nb-6V APT tip average concentration of γ and $D0_{19}$ phases and elemental partitioning coefficients ($K^{D019/\gamma}$) measured by APT after 64 hours of aging at 900° C.

| | Concentration (at. %) | | |
|---|---|---|---|
| Element | γ | γ' | $KD^{D019/\gamma}$ |
| Co | 91.45 | 74.08 | 0.81 |
| Nb | 1.75 | 20.60 | 11.75 |
| V | 6.79 | 5.32 | 0.78 |

Discussion

In the exemplary study, Co-rich ternary Co—Ta—V and Co—Nb—V systems are experimentally explored. Fine γ' cuboidal precipitates in both Ta- and Nb-containing alloys were observed indeed, albeit with the presence of other phases: (i) C36 for the Co—Ta—V system and (ii) C15 and D019 for Co—Nb—V system. The Co—Ta—V alloy composition was refined in an attempt to prevent the formation of the undesirable C36 phases, and nickel was added with the same goal (as Ni is known to widen the γ-γ' phase field in Co—Al—W alloys [29,30]); neither strategies succeeded and the γ' phase in both alloy systems remained metastable. Additional computational efforts are now warranted to identify alloying elements that stabilize the γ' phase in Co—Ta—V- and Co—Nb—V-based compositions, together with Al and Cr for oxidation and corrosion resistance.

Microstructure and phases in Co—Ta—V(—Ni) alloys: A previous study by Ruan et al. focused on the experimental microstructural investigation and phase equilibria in the Co—Ta—V system. Ruan et al. created experimental isothermal phase diagrams sections at 900, 1100, 1200 and 1300° C. based on their experimental study and the binary phase diagrams (Co—V, Co—Ta and Ta—V). They did not report the presence of an $L1_2$-ordered phase, consistent with our findings that the γ' phase is metastable and their very long aging times to achieve equilibrium (up to 90 days). Recently, it was demonstrated via transmission electron microscopy (TEM) that a metastable $L1_2$-ordered γ'-$Co_3Ta$ phase exists in the Co—Ta binary system, for a Co-8.5Ta alloy aged at 1000° C. for 1 hour [27]. Furthermore, Nagel and Fultz [31] have reported the observation of a metastable $L1_2$-ordered γ'-$Co_3V$ phase, using in-situ neutron diffraction, produced by quenching in the Co—V binary system [31]. In the exemplary embodiments, we find ternary γ' precipitates in the Co—Ta—V ternary system via metallographic/SEM, as shown in FIGS. 19 and 20, and APT examinations, as shown in FIG. 24. The precipitates have a cuboidal morphology similar to that reported for the $L1_2$-ordered γ' precipitates found in traditional Ni-base superalloys and the recently discovered Co-based superalloy. The composition of the γ' precipitates in the Co-5.4Ta-6.6V alloy was determined by APT to be Co-19Ta-7V or $Co_3(Ta_{0.76}V_{0.24})$ for 2 hours of aging at 900° C. The γ' phase is, however, metastable as can be inferred from the loss of its cuboidal shape shown in FIGS. 19 and 20 after 2 hours of aging. Interestingly, the γ'-$Co_3(Al_{0.45}\ W_{0.55})$ phase is also metastable, but its transformation kinetics are much more sluggish: transformation to the $D0_{19}$-$Co_3$(Al,W) phase starts after 1,000 hours at 900° C. [32]. FIG. 27 shows the isothermal phase diagram at 900° C. produced by Ruan et al. where we added the phases found in the present work for our Co-6Ta-6V alloy: γ-Co, γ'-$Co_3$(Ta V) and C36-$Co_3Ta$ (squares); also added are the concentrations of their two closest alloys, Co-6.8Ta-3.7V and Co-2.1Ta-12.3V and their phases: α-Co (γ-Co in our notation), $Co_7(Ta,V)_2$ and $Co_3$(V,Ta) (circles).

The formation of lamellar domains by the discontinuous precipitation of two phase has been well studied over the years for different alloy systems [33-36], including Co-[15, 17, 37, 38] and Ni-based superalloys, and can be describe by the Turnbull theory of cellular precipitation [40]. The discontinuous transformation of the metastable microstructure occurs by both boundary precipitation and interfacial migration [39], with cell boundary diffusion most likely acting as the limiting growth rate factor [33-36]. The rapid transformation of the γ+γ' microstructure indicates that the lamellar γ-Co+C36 is more energetically stable. Discontinuous precipitation into a lamellar microstructure (like those seen in our Co—Ta—V alloys) was reported after 35 hours at 800° C. by Makineni et al. [17] for W-free Co—Mo—Al—Nb superalloys with γ-γ' microstructure.

Figure 28:
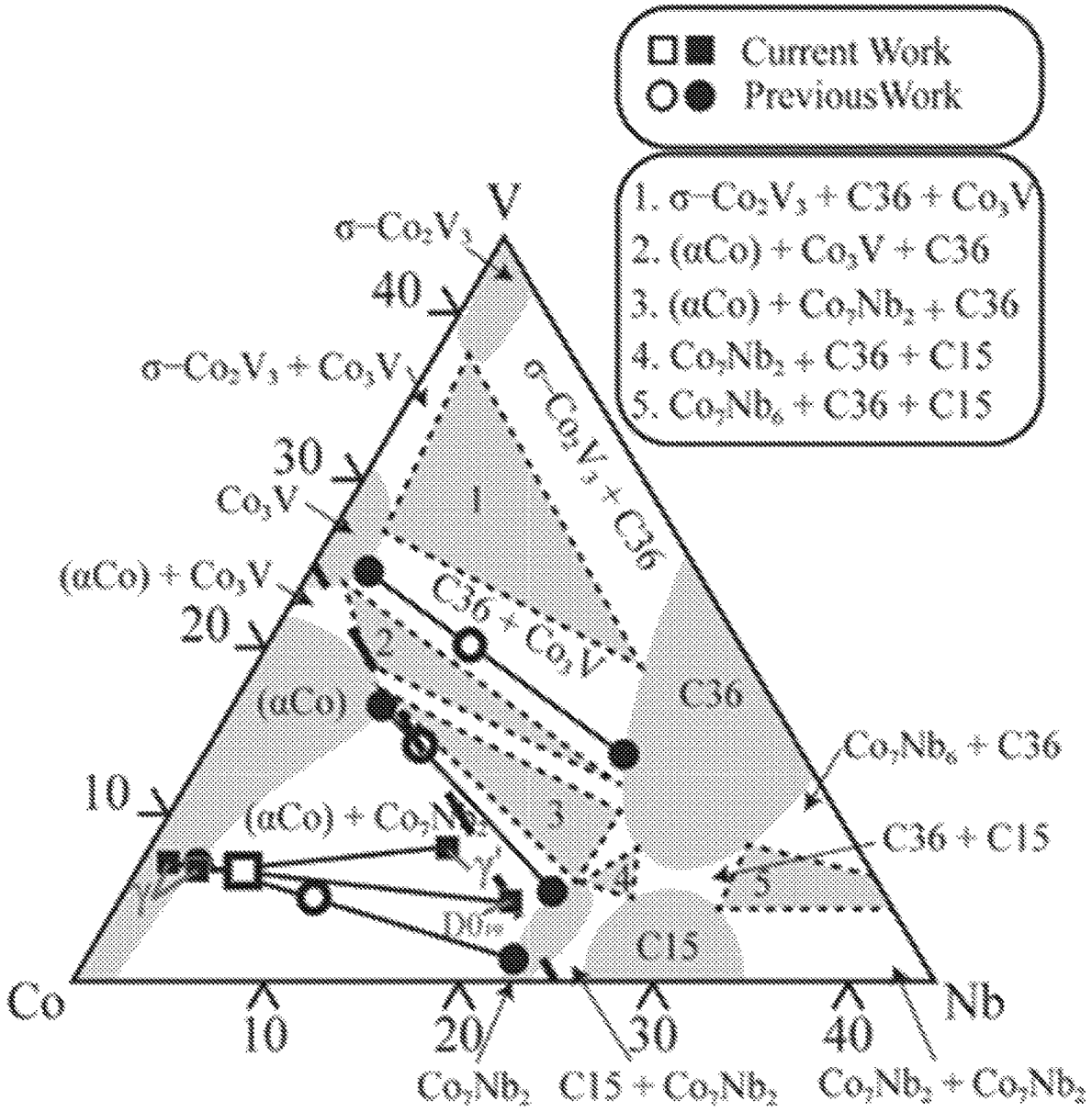
FIG. 28 shows Co-rich isothermal section of the Co—Nb—V ternary system at 1000° C. created by Wang et al. showing the phases at 900° C. (identified as current work) according to this embodiment of the invention as well as Wang et al. study at 1000° C. (identified as previous work). Hollow symbols represent alloy bulk composition.

Microstructure and phases in the Co-6Nb-6V alloy: Wang et al. [26] focused on the experimental microstructural investigation and phase equilibria in the Co—Nb—V system. The authors produced multiple isothermal phase diagram sections based on their experimental study at 1000 and 1200° C. and the binary phase diagrams (Co—V, Co—Nb and Nb—V). Like the previously mentioned study on the Co—Ta—V system [25], the authors did not report the presence of an $L1_2$-ordered phase for any of their compositions, consistent with their very long aging times (25 to 50 days). Interestingly, there is a phase with the $Co_3Nb$ stoichiometry in the Co—Nb binary phase diagram with the Laves $MgNi_2$ type structure (C36) [42], which is however stable only between 1005 and 1249° C. Given that it has been demonstrated that the addition of Nb into another system (Co-10Al-5Mo-2Nb) has helped stabilized the γ' phase [16, 19], it is plausible that this approach is also applicable to the Co—V system. Indeed, for our Co—Nb—V alloy, we find cuboidal γ' precipitates in homogenized and furnace-cooled conditions. These samples are then aged at 900° C. and quenched. After 2 hours of aging, the γ' precipitates transform into needle-like precipitates (taken to be $D0_{19}$) with a Widmanstätten morphology, comparable to what is seen during the transformation from fcc to $D0_{19}$ in Co—W alloys and, $L1_2$ to $D0_{19}$ in Co—Al—W and Co-10Al-5Mo-2Nb [17] alloys. FIG. 28, shows a reconstruction of the isothermal phase diagram at 1000° C. produced by Wang et al. [26] highlighting the phases observed in the present work (Y. γ' and $D0_{19}$, squares) and the Co-richest alloy concentrations used by Wang et al. and the corresponding phases (circles). We note that we are comparing our samples aged at 900° C. with an isothermal phase diagram at 1000° C. (none is available at 900° C.), which still provides an approximation of the expected phases close to our studied compositions and temperature.

Figure 29:
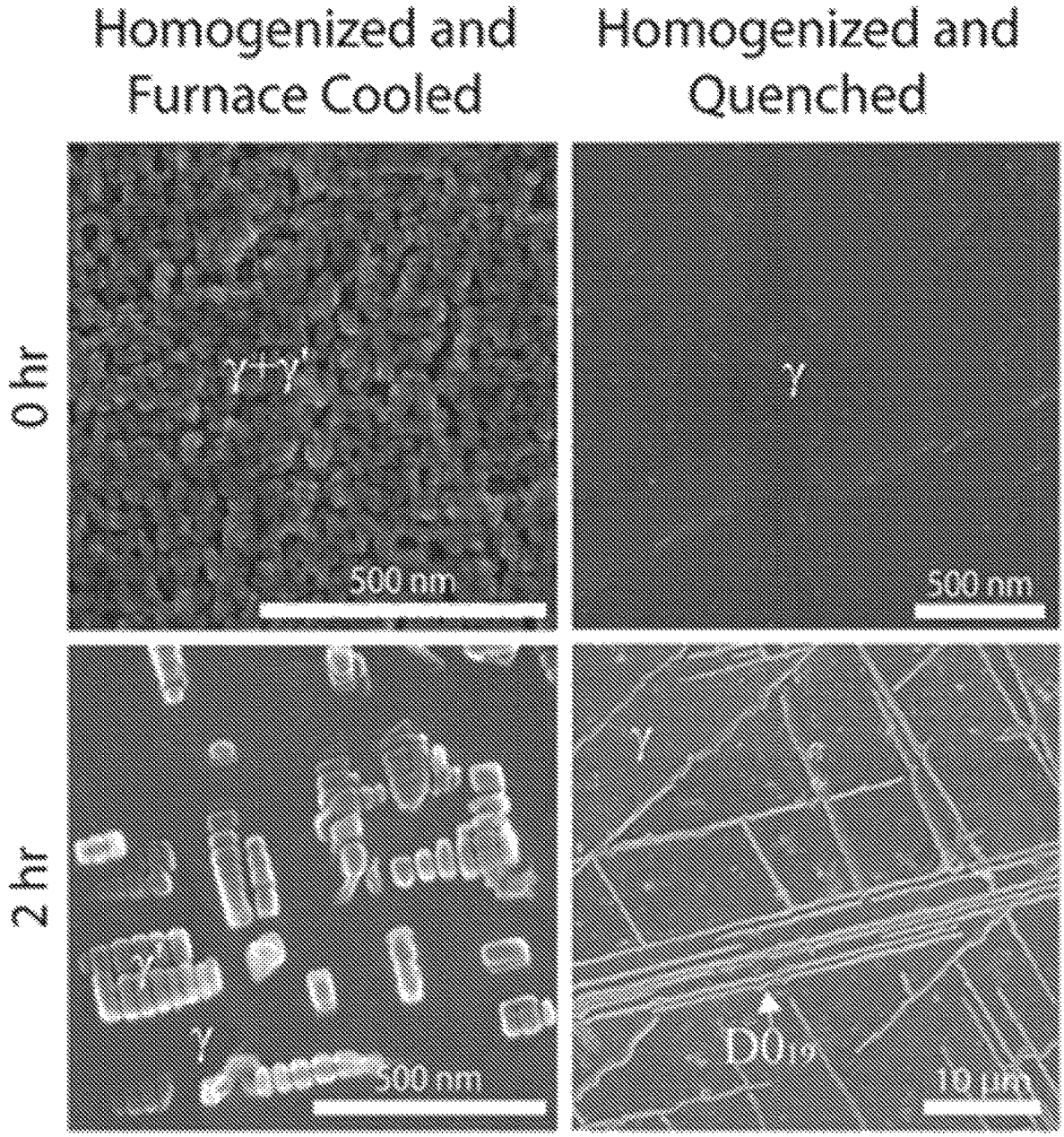
FIG. 29 presents SEM micrographs of Co-6Nb-6V homogenized and furnace-cooled (left column) or quenched (right column), and subsequently aged at 900° C. for 2 hours, according to embodiments of the invention.

FIG. 29 shows a comparison of homogenized samples cooled slowly via furnace-cooling and rapidly via quenching. As reported before, γ+γ' regions are present in the furnace cooled conditions, coexisting with γ+C15 regions. However, this is not the case in the quenched sample which exhibits a mixture of γ single-phase regions and γ+C15 two-phase regions. Aging for 2 hours at 900° C. shows that cuboidal precipitates are present only in the furnace-cooled samples, which however have partially transformed into needle-shape $Co_3$(Nb,V) precipitates. The quenched sample displays only needle-shape precipitates, identical in morphology and shape to those present in the furnace-cooled condition after aging at 900° C. for 2 and 16 hours, as shown in FIG. 23, which are thus assigned to be $D0_{19}$-$Co_3$(Nb,V). Similarly, needle-shaped $D0_{19}$-$Co_3$(Mo,Nb) precipitates were found to form after 100 hours at 950° by Makineni et al. in W-free Co(Ni)—Mo—Al—Nb superalloys originally with γ-γ' microstructure. This suggest that the cuboidal γ' phase in our Co-6Nb-6V alloy was formed continuously during slow furnace-cooling at temperatures different from 900° C., likely to be higher given the sluggish diffusivity of Nb in Co: further work to create a time-temperature-transformation (TTT) diagram may identify the optimal cooling treatment to form the γ' phase while avoiding the $D0_{19}$ phase.

In sum, in the exemplary embodiments, we report the discovery, in ternary Co—Nb—V and Co—Ta—V alloys, of metastable γ' cuboidal nanosize precipitates present within a terminal γ-fcc Co-rich solid solution. These γ' precipitates are formed after homogenization and aging at 900° C. in alloys with nominal compositions (at. %): Co-6Nb-6V and Co-6Ta-6V, as well as Co-5.4Ta-6.6V (composition refined based on EDS measurements of the matrix of the Co-6Ta-6V alloy) and Co-5.4Ta-6.6V-10Ni (as Ni is known to stabilize γ' in Co—Al—W alloys). The phases present are: γ, γ' and C36-$Co_3$(Ta,V) for the Co—Ta—V alloys; Y. γ', C15-$Co_2$(Nb,V) and $D0_{19}$-$Co_3$(Nb,V) for the Co—Nb—V alloy.

According the exemplary study, the following conclusions are drawn:

Micron-size C36 spheroidal particles, consistent with dendritic solidification, are present within a γ matrix in the Co-6Ta-6V alloy and, to a lesser extent, in the Co-5.4Ta-6.6V-0/10Ni alloys. In the Co-6Nb-6V alloy, regions of micron-size C15 phase within a γ matrix (expected to have formed on solidification) coexist with regions with fine γ+γ' microstructure (expected to have formed during furnace-cooling after homogenization).

SEM-based microstructure analysis shows that cuboidal, nanometric γ' precipitates are present after short aging times (2 hours at 900° C.) in all alloys. Degradation of the cuboidal shape at 900° C., accompanied by coarsening and dissolution, occurs after 2 hours for Co—Nb—V and 16 hours for Co—Ta—V alloys.

The composition of the cuboidal γ' precipitates, as measured by APT after 2 hours of aging, is $Co_3(Ta_{0.76}V_{0.24})$ and $Co_3(Nb_{0.65}V_{0.35})$ for alloys Co-5.4Ta-6.6V and Co-6Nb-6V, respectively.

The γ' phase in the Co—Ta—V alloys is metastable at 900° C., as it is consumed via the discontinuous precipitation of lamellar γ-Co+C36-$Co_3$(Ta,V). Transformation starts after 16 hours and is mostly completed after 64 hours.

Nickel addition of 10 at. % does stabilize the γ' phase in Co-5.4Ta-6.6V and in fact promotes the formation of lamellar γ-Co+C36-$Co_3Ta$ at the expense of the γ+γ' microstructure.

The γ' phase in the Co-6Nb-6V alloy is formed during furnace cooling after homogenization at 1250° C. and is also metastable at 900° C. After short aging times (2 hours) at that temperature, the γ' phase is consumed by the growth of $D0_{19}$ needles with Widmanstätten morphology and $Co_3(Nb_{0.81}V_{0.19})$ composition, as measured by APT after 64 hours of aging at 900° C.

Example 2

Effects of Al, Ti and Cr Additions on γ-γ' Microstructure of W-Free Co—Ta—V-Based Superalloys This exemplary study shows that the recently-discovered metastable γ'-$Co_3(Ta_{0.76}V_{0.24})$ phase formed on aging in a Co-6Ta-6V (at. %) ternary alloy can be stabilized by partial replacement of Ta and V with Al and Ti. In two alloys with composition Co-6Al-3Ta-3V and Co-5Al-3Ta-3V-1Ti with γ+γ' microstructure, the γ'-precipitates remain stable for up to 168 hours at 850 and 900° C., with no precipitation of additional phases. Adding Ni and B and doubling the Ti concentration produces a γ/γ' superalloy, Co-10Ni-5Al-3Ta-3V-2Ti-0.04B (at. %), with γ' precipitates which are stable up to 6 weeks of aging at 850° C., while slowly coarsening and coalescing from cuboidal to elongated shapes. After 1 day of aging at 850° C. the γ' nanoprecipitates have $(Co_{0.83}Ni_{0.17})_3(Ta_{0.42}Al_{0.23}\ Ti_{0.19}V_{0.15}B_{0.01})$ composition, with Al and Ti replacing at the same rate both Ta and V in the original metastable $Co_3(Ta_{0.76}V_{0.24})$ phase. To improve oxidation resistance, 4% Cr is added to the new superalloy, resulting in a somewhat higher volume fraction of finer cuboidal γ' precipitates after one week of aging at 850° C., but no other deleterious phases. These W- and Mo-free γ/γ' superalloys show good creep resistance at 850° C., on a par with two other recent Co-base γ/γ' superalloys: (i) Co-9W-9Al-8Cr (at. %) which has higher density due to its high W content, and (ii) Co-30Ni-10Al-5Mo-2Nb (at. %) which has lower density (as it is W-free) but contains triple the Ni concentration.

In the exemplary study, we identify alloying elements that stabilize the metastable γ' phase in Co—Ta—V-based alloys and to find optimal concentrations of the constituent elements to achieve a γ/γ' superalloy with good creep-, coarsening- and oxidation resistance. In certain embodiments, for new alloying elements, we focus here on (i) Al and Ti, to partition to and stabilize the γ' phase, (ii) Ni, to expand the γ+γ' the phase field, (iii) Cr, to provide additional oxidation and corrosion resistance, and (iv) B, to provide solid-solution and grain-boundary strengthening in Co-based superalloys. We demonstrate that the γ' phase is stabilized for a range of modified alloys containing some or all these elements upon aging at 850 and 900° C. and we show that an optimized γ/γ' superalloy, Co-10Ni-5Al-3Ta-3V-2Ti-0.04B, has excellent creep resistance at 850° C., and can be further modified by 4% Cr while maintaining its γ+γ' microstructure.

Experimental Procedures

Ingots about 10 g in mass with nominal compositions Co-(2−x)Ni-(6−y)Al-3Ta-3V−yTi (x=0 or 2 and y=0 or 1) and Co-10Ni-5Al-xCr-3Ta-3V-2Ti-0.04B (x=0 and 4), where all compositions hereafter are given in at. %, were produced by arc-melting of high purity Co (99.99%) Al (99.99%), Ta (99.95%), V (99.95%), B (99.99%), Ti (99.95%) and Ni (99.99%). The ingots were melted five times under a partial Ar atmosphere and flipped between each melt cycle to improve homogeneity. The alloys were then vacuum-encapsulated in quartz ampoules and homogenized at 1200-1250° C. for 48 hours, followed by water quenching. The ingots were cut into about 2×2×6 mm specimens which were vacuum-encapsulated in quartz ampoules for aging heat-treatments: (i) Co-(2−x)Ni-(6−y) Al-3Ta-3V−yTi (x=0 or 2 and y=0 or 1) alloys were aged at 850 and 900° C. for 7.5 and 168 hours (1 week); (ii) Co-10Ni-5Al-xCr-3Ta-3V-2Ti-0.04B (x=0 and 4) alloys were aged at 850° C. for 168, 500 and 1000 hours (1, 3 and 6 weeks). All alloys were water-quenched following the aging heat treatment.

Alloy cross-sections were imaged via scanning electron microscopy (SEM) using a Hitachi SU8030 SEM and a FEI Quanta 650 SEM, both equipped with an Oxford Aztec silicon drift detector (SDD) energy dispersive spectrometer (EDS). Solutionized specimens, with and without subsequent aging, were ground using 320, 400, 600, 800, 1200 grit SiC paper, polished using 6, 3, and 1 μm diamond suspension, and chemically etched at room temperature using Carapella's re-agent. ImageJ was used to quantify γ' precipitates in Co-10Ni-5Al-xCr-3Ta-3V-2Ti-0.04B (x=0 and 4) alloys. A large number of precipitates for each aging condition, between 500 and 750 over 5 SEM micrographs, were hand-traced and their area A was used to calculate the mean circular equivalent radius ($\langle R(t)\rangle=\sqrt{A/\pi}$). Also, the γ'-precipitate area fraction (φ) was determined using ImageJ thresholding and averaged over 11 micrographs. In an isotropic microstructure, this area fraction would be equal to the volume fraction. However, given the regular arrangement of the precipitates, this assumption can lead to an overestimation of the precipitate volume fractions. Nevertheless, changes in area fractions would be equivalent to changes of similar magnitudes in the volume fractions. Moreover, the Local Thickness function of BoneJ (ImageJ plugin) was used to determine the thickness (taken to be the smallest dimension between width and height of a precipitate) of the γ'-precipitate, to consider directional coarsening and coalescence.

Vickers microhardness tests were conducted at ambient temperature on polished cross-sections of the Co-10Ni-5Al-xCr-3Ta-3V-2Ti-0.04B (x=0 and 4) alloys using a Struers Duramin-5 microhardness tester with an applied load of 3 kg and a 5 s dwell time. Each hardness value is the average of 20 measurements performed over multiple grains. High-temperature compression creep was performed on the Co-10Ni-5Al-xCr-3Ta-3V-2Ti-0.04B (x=0 and 4) alloy in air at 850° C. for different stresses, using a dead-low creep frame. Creep samples were machined in the form of cylinders (6 mm in height and 3 mm in diameter) by wire electron discharge machining (EDM) and aged for 168 hours at 850° C., followed by water quenching. A creep specimen, water-quenched immediately after unloading, was sectioned parallel and perpendicular to the applied load. Sample preparation for SEM imaging was done in the same manner as for the aged stress-free specimens.

APT was used to determine the elemental partition behavior and composition of the γ- and γ' phases in Co-10Ni-5Al-3Ta-3V-2Ti-0.04B aged for 24 hours at 850° C. Nanotip specimens were prepared via an FIB lift-out technique using a $Ga^+$ dual-beam in a FEI Helios Nanolab SEM/FIB instrument. Regions of the representative γ-γ' microstructure were extracted by creating rectangle-topped wedges using the dual-beam FIB which were attached to a Si micropost on a coupon and sharpened using $Ga^+$ to a about 40 nm minimum tip radius. APT was then performed using a Cameca LEAP 5000X-Si system with a picosecond ultraviolet (wavelength=355 nm) laser with a specimen temperature of about 25 K, a pulse energy of 25 pJ, a 500-kHz pulse repetition rate and a 4% detection rate.

DSC was performed on Co-10Ni-5Al-xCr-3Ta-3V-2Ti-0.04B (x=0 and 4) alloys using a NETZSCH STA 449 F3 Jupiter instrument to determine γ' solvus temperature. Before DSC measurements, homogenized samples were aged for 24 hours at 850° C. followed by water quenching, and then segmented into 20-50 mg pieces. During DSC experiments, the samples were heated from 25 to 1300° C. (at 20° C./min), under an Ar atmosphere, and held for 1 hour at 1300° C. to allow dissolution of γ'. Cooling, was done from 1300 to 25° C. (at the same rate of 20° C./min) and held at 25° C. for 10 minutes. This cycle was repeated three times.

Experimental Results and Discussion

A. Microstructure Evolution

Figure 36:
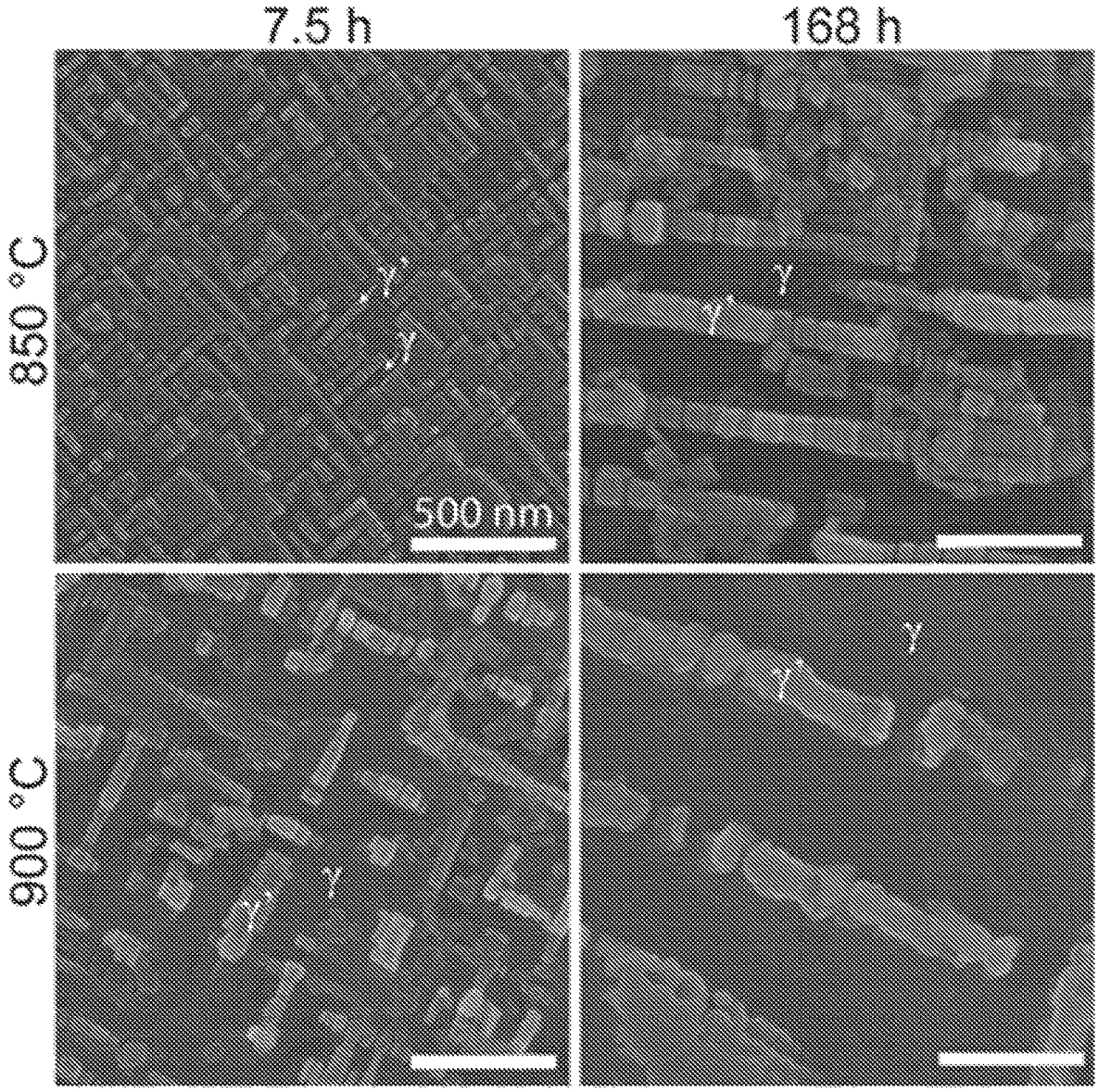
FIG. 36 presents SEM micrographs of Co-6Al-3Ta-3V homogenized and then aged at 850 and 900° C. for 7.5 and 168 hours, according to embodiments of the invention. The γ-matrix is deep-etched to show the γ' phase.
Figure 42:
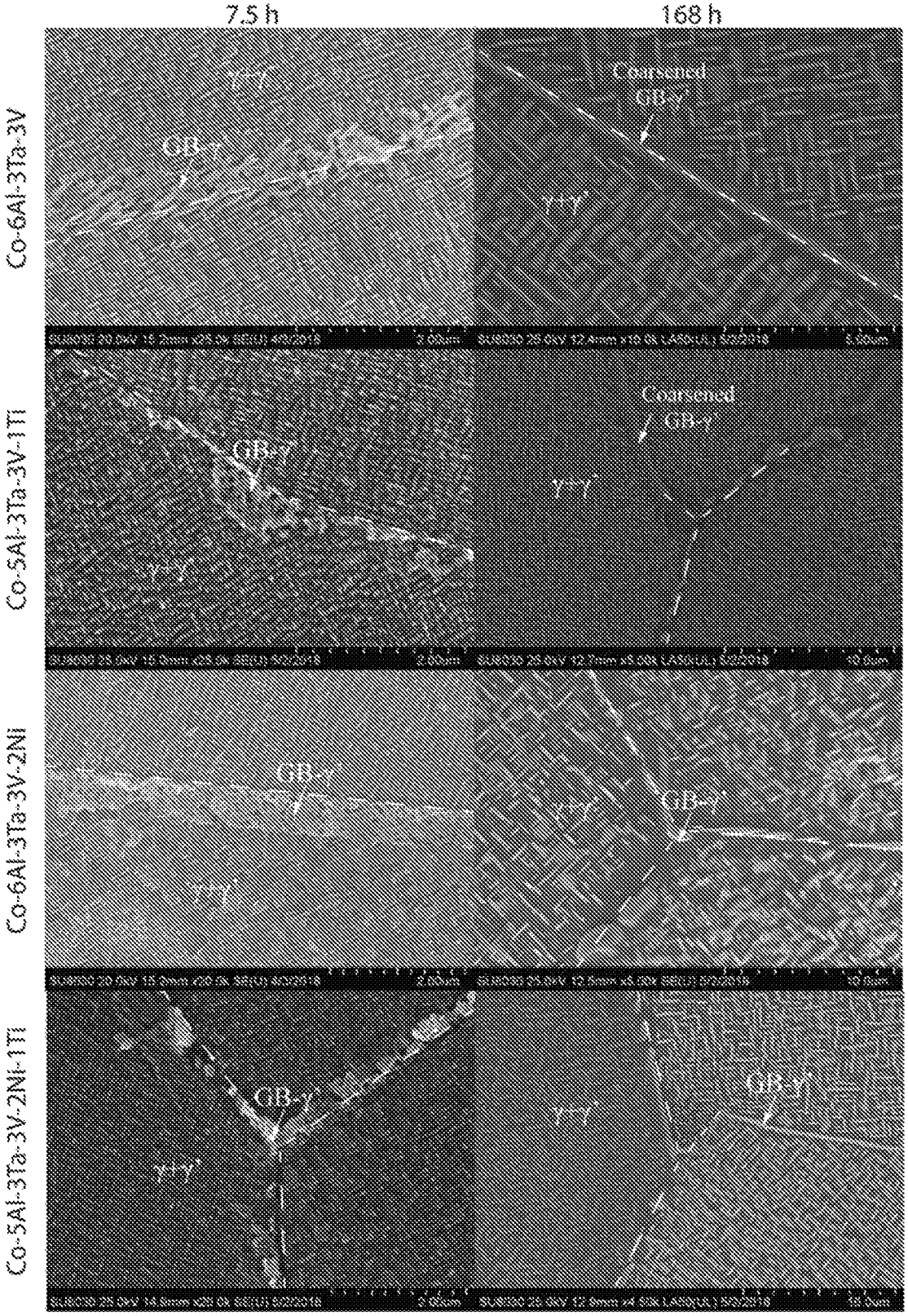
FIG. 42 presents SEM micrographs of etched Co-6Al-3Ta-3V(-2Ni) and Co-5Al-3Ta-3V-1Ti(-2Ni, at. %) homogenized and aged at 850° C. for 7.5 and 168 hours, showing fine γ' precipitates within grains and coarser γ' precipitates at grain boundaries, according to embodiments of the invention.

Effect of Al and Ti Additions on γ' Phase Stability: Metastable γ'-precipitates were first reported in Co-6Ta-6V after furnace-cooling from homogenization at 1300° C. as well as subsequent aging for 2-16 hours at 900° C. [61]; however, they were consumed by discontinuous precipitation (DP) of a C36 phase with $Co_3X$ composition after 64 hours aging at 900° C. To stabilize the γ'-phase in this ternary alloy, half the Ta and V concentrations (3 at. % each) are replaced with Al, with a cumulative amount of 6 at. %, leading to the first alloy studied here, Co-6Al-3Ta-3V. After solution heat-treatment at 1200° C. for 48 hours, the microstructure is single-phase γ, with no γ' precipitates in grains or at grain boundaries. A γ+γ' microstructure is formed upon aging at 850 and 900° C., as illustrated in FIG. 36. At 850° C., for the shorter aging time of 7.5 hours, a high area fraction (visually estimated as about 40-60%) of γ'-precipitates is seen. At 900° C. for 7.5 hours, the alloy displays a much lower area fraction (estimated as about 20-40%) of γ' precipitates, but with no clear difference in precipitate size. Also, after coarsening and coalescence during aging at 900° C. for 168 hours, the γ' precipitates lose their cuboidal shape. No further studies were carried out on this alloy, given the insufficient γ' visible area fractions at 900° C. Nevertheless, the replacement of half the Ta and V with Al clearly improves the thermodynamic stability of the γ'-phase in Co-6Al-3Ta-3V (at least to 168 hours at 900° C.), as compared to the original Co-6Ta-6V alloy which showed the γ'-phase being consumed by a C36 phase via DP after 64 hours of aging at 900° C. No other phases were observed in numerous cross-sections of these alloys, neither within grains or at grain boundaries, the latter being decorated by coarser γ'-precipitates (shown in FIG. 42).

Figure 37:
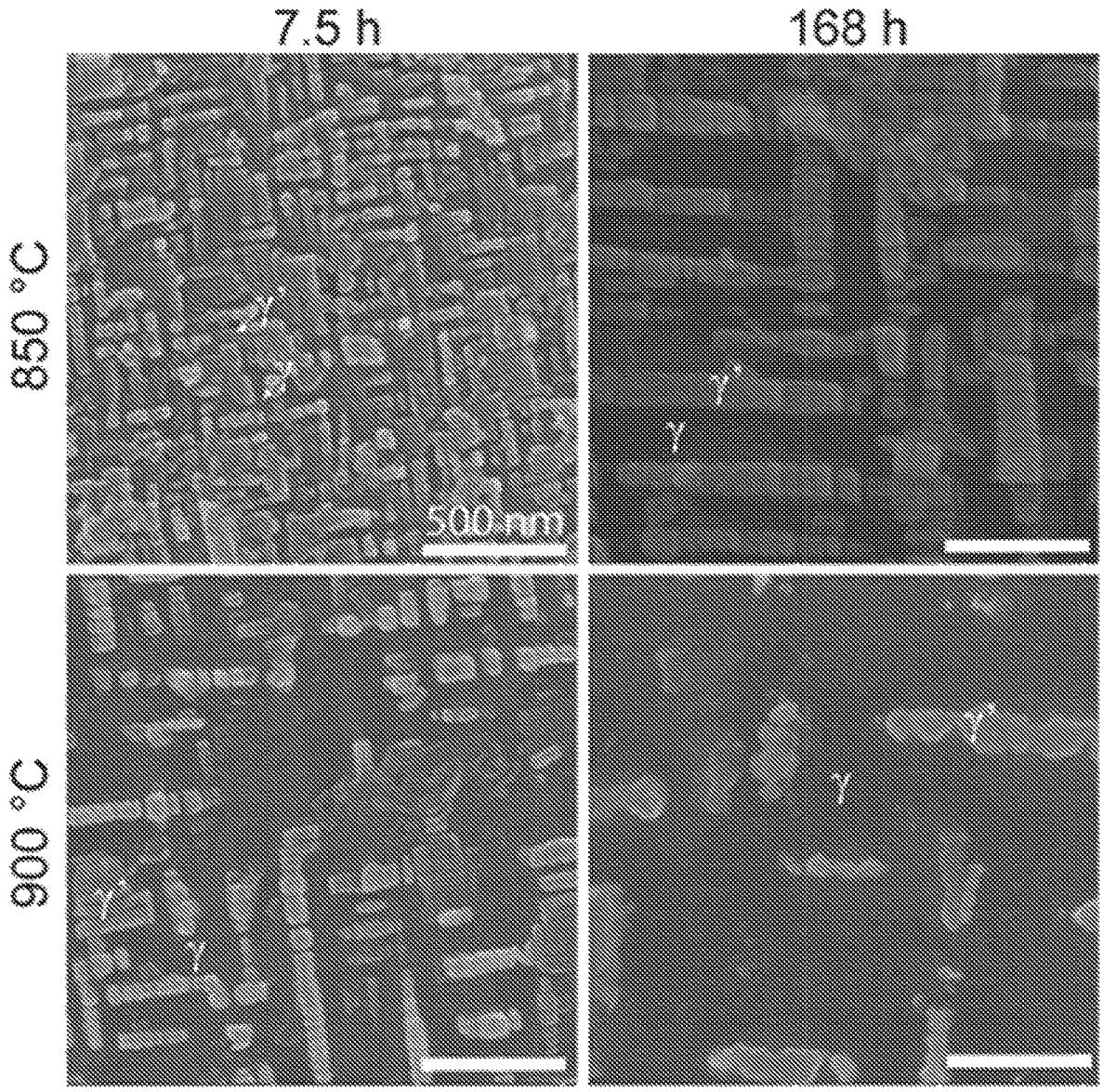
FIG. 37 presents SEM micrographs of Co-5Al-3Ta-3V-1Ti homogenized and then aged at 850 and 900° C. for 7.5 and 168 hours, according to embodiments of the invention. The γ-matrix is deep-etched to show the γ' phase.

To achieve a higher γ'-volume fraction, 1 at. % of Al in the first, quaternary alloy is replaced by 1 at. % Ti, leading to the second, quinary alloy, Co-5Al-3Ta-3V-1Ti. After solution heat-treatment at 1200° C. for 48 hours, the alloy shows a precipitate-free γ-phase. A two-phase γ+γ' microstructure is present after aging at 850 and 900° C. for 7.5 and 168 hours, as shown in FIG. 37. Similar to the first Co-6Al-3Ta-3V alloy, aging at 850° C. for 7.5 hours produces a high area fraction of γ'-precipitates with a cuboidal morphology, which grow and coarsen after aging for 168 hours. Aging at 900° C. for 7.5 hours produces a lower γ' area fraction, which is directly related to a lower volume fraction, when compared to 850° C. Again, after aging at 900° C. for 168 hours, the precipitates coarsen, coalesce and partially lose their cuboidal shape. Thus, replacing 1 at. % Al with 1 at. % Ti does not affect the γ+γ' microstructure of the alloy, at least for the relatively short aging times used here (FIG. 37). After 168 hours at 900° C., only γ'-precipitates are seen within the γ-matrix of both alloys, with coarsened γ'-precipitates present at the grain boundaries (FIG. 42 of supplemental information) but no other phases in grains or at grain boundaries. This is indication that both Ti and Al (the latter being necessary for oxidation resistance) serve as stabilizing alloying elements in this system, as seen previously in Ni- and Co-based superalloys [44]. Moreover, DFT calculations by Jin et al. demonstrate that Al plays a crucial role in making the $L1_2$-phase more stable than the competing $D0_{19}$ phase in Co—Al-M (M=Ti, V, Cr, Zr, Nb, Mo, Hf, Ta, W) alloys [68]. A previous study by Ruan et al. [21], after the discovery of γ'-precipitation in a Co-5Ti-15V alloy, also shows that Al additions improves the γ+γ' microstructure in the system: when 2 at. % Al was added, the volume fraction and solvus temperature of the γ'-phase were increased by 10% and 21° C., respectively [6]. The stabilizing effect of Ti has been shown in Co—Al—W-based superalloys [5] and in W-free Co—Al—Mo—Nb superalloys [17]. In the latter alloys, the γ'-phase was consumed via DP after 35 hours at 800° C., but it was stabilized by the additions of 2 at. % Ti for up to 100 hours at 950° C. [17].

Figure 43:
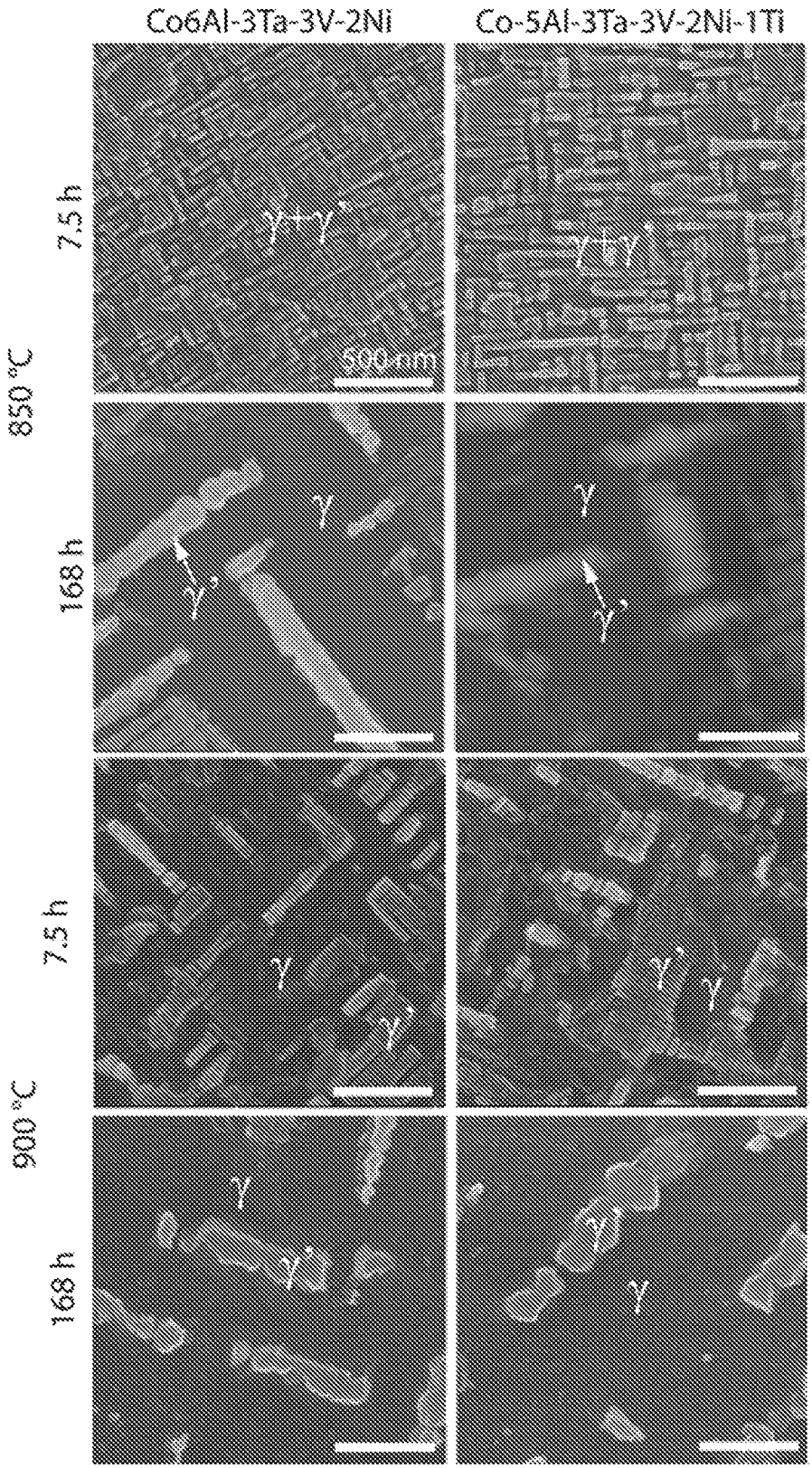
FIG. 43 presents SEM micrographs of Co-6Al-3Ta-3V-2Ni and Co-5Al-3Ta-3V-2Ni-1Ti (at. %) homogenized and aged at 850 and 900° C. for 7.5 and 168 hours, showing, deep etched microstructure, according to embodiments of the invention.
Figure 44:
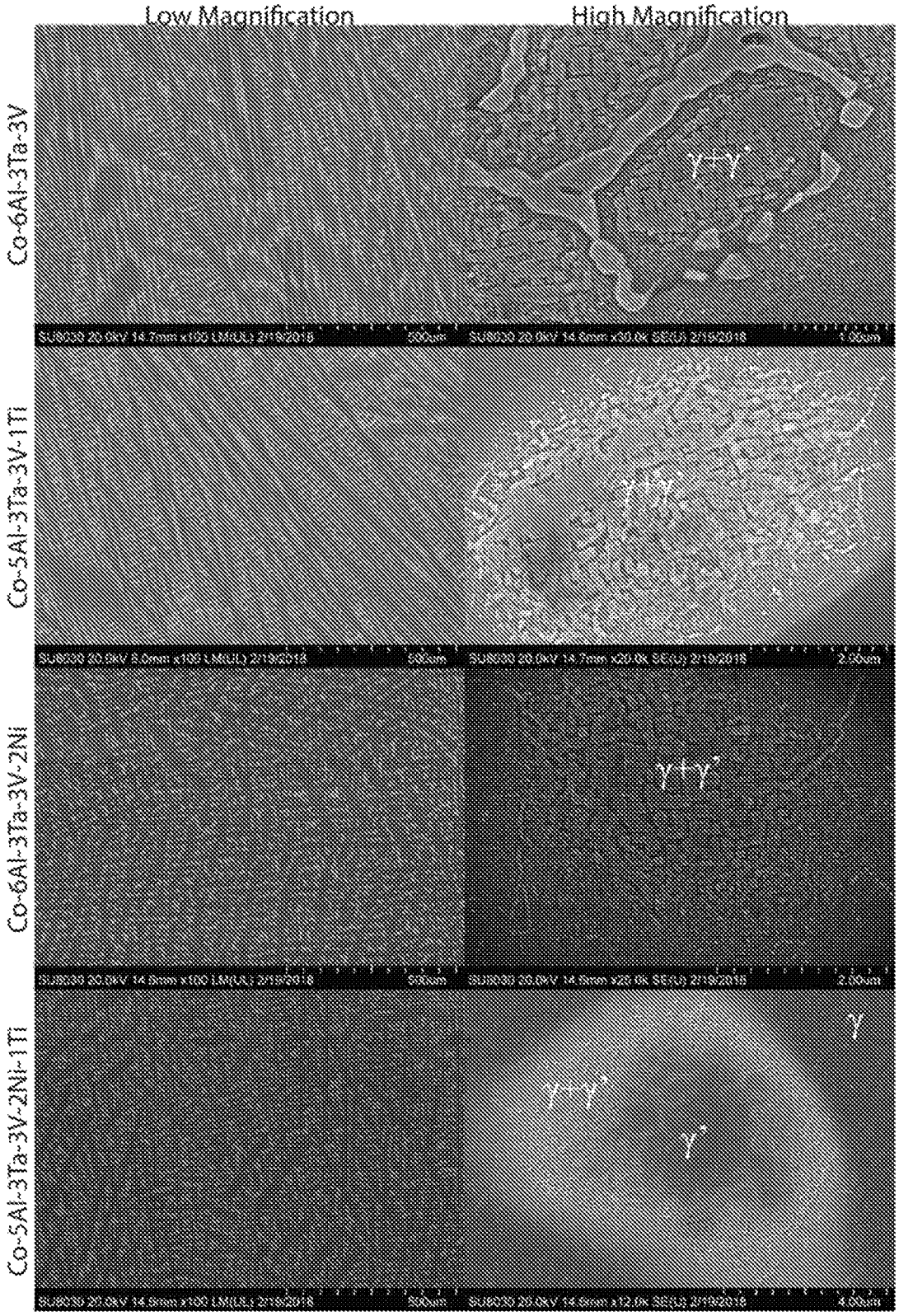
FIG. 44 presents SEM micrographs of Co-6Al-3Ta-3V(-2Ni) and Co-5Al-3Ta-3V-1Ti(-2Ni, at. %) as arc-melted before homogenization, showing a dendritic microstructure (top row, low magnification) with γ' precipitates in the interdendritic regions (bottom row, high magnification), according to embodiments of the invention.

Finally, in both the first and second alloys, 2 at. % Ni was added for potential improvements in the γ'-stability. These modified alloys, Co-2Ni-6Al-3Ta-3V and Co-2Ni-5Al-3Ta-3V-1Ti, were aged for the same temperatures and times (850 and 900° C. for 7.5 and 168 hours) and are shown in FIG. 43 in supplemental information. The microstructure in the Ni-bearing and the Ni-free alloys shows no distinguishable difference. Hence, Ni additions do not provide any detrimental changes in microstructure at low concentrations, opening the door to higher Ni substitutions of Co, described in the following section, and also providing both a reduction in alloy cost and an increase in the alloy design space (as Ni is known to widen the γ+γ' phase-field [3]). The alloys with 2 at. % Ni additions were also studied by SEM after arc-melting and homogenization at 1250° C. and are shown in FIG. 44 and FIG. 2. SEM micrographs of Co-6Al-3Ta-3V(-2Ni) and Co-5Al-3Ta-3V-1Ti(-2Ni, at. %) after solutionizing at 1250° C. for 48 hours showing a single-phase γ-matrix with twins. After arc-melting, a dendritic microstructure with coarse γ' precipitates in the interdendritic regions is seen. After homogenization, these primary γ' precipitates are fully dissolved and only the γ matrix is present, in a supersaturated state able to precipitate fine γ' precipitates upon subsequent aging.

Alloying Element Increases (Ni and Ti) and Additions (Cr and B): In a next series of alloys, the concentration of Ni was increased from 2 to 10 at. % and the Ti concentration was doubled from 1 to 2 at. %, with the aim to further raise γ'-stability and volume fraction, and to decrease density (for Ti additions). Also, B micro-additions (0.04 at. %) were made to achieve grain-boundary- and solid-solution strengthening. Finally, Cr was added to improve oxidation and corrosion resistance, and help decrease the alloy density. Because Cr is known to create additional undesirable phases (e.g., the $D0_{19}$ phase in Co-7Al-7W-(10, 13)Cr and μ (D85) phase in Co-7Al-7W-(21,17)Cr alloys [38]), two alloys were cast, one Cr-free and the other with 4 at. % Cr, with nominal compositions: Co-10Ni-5Al-xCr-3Ta-3V-2Ti-0.04B at. % (x=0 and 4, hereafter referred to as 0Cr- and 4Cr-alloys), corresponding to a wt. % composition of Co-9.8Ni-xCr-2.24Al-9.0Ta-2.5V-1.6Ti-0.007B (x=0 and 3.5).

Figure 38:
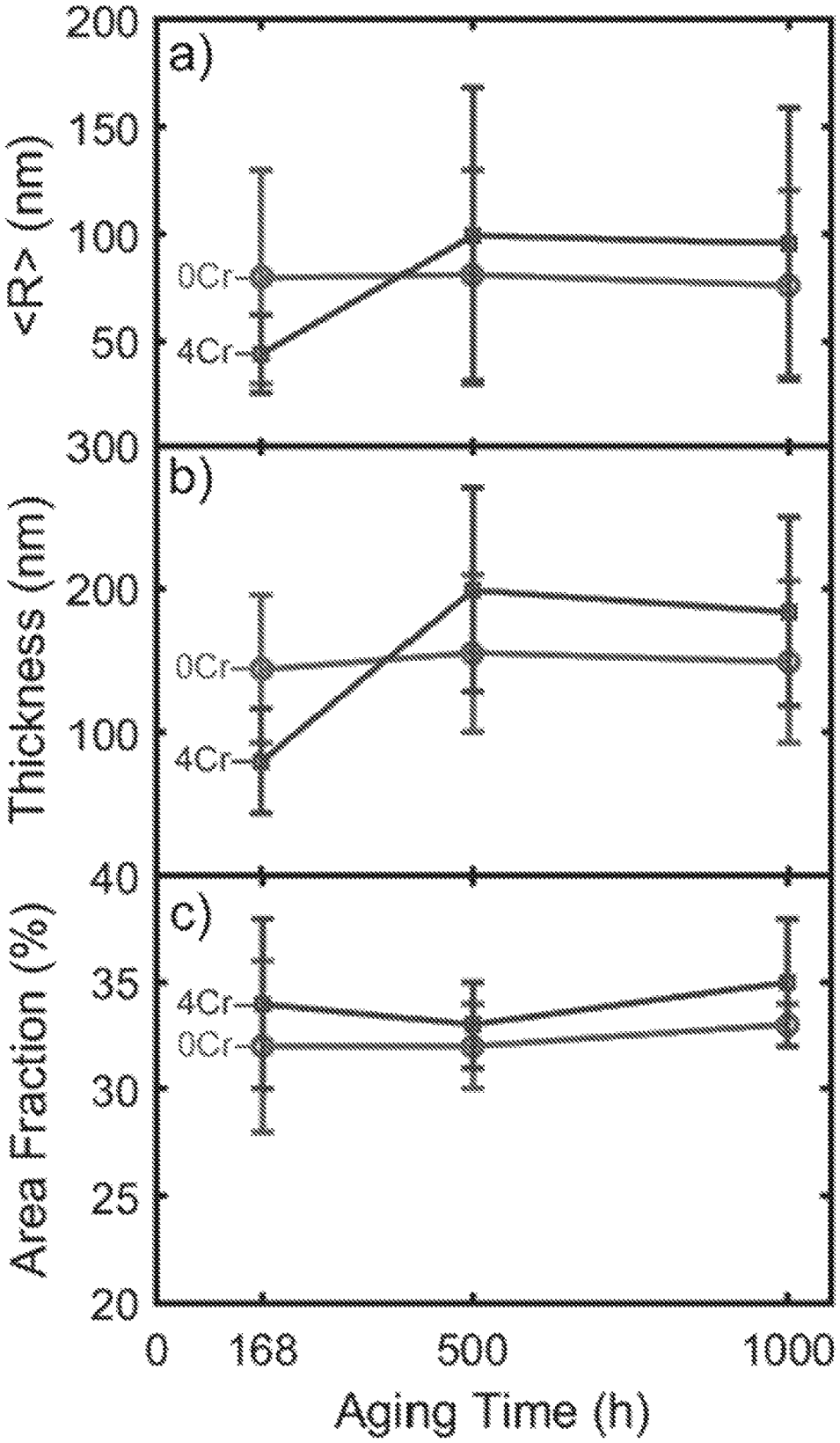
FIG. 38 shows plots of temporal evolution of γ' precipitate (portion a)) mean circular equivalent radius (portion b)) thickness, and (portion c)) volume fraction for Co-10Ni-5Al-3Ta-3V-2Ti-0.04B (0Cr) and Co-10Ni-5Al-4Cr-3Ta-3V-2Ti-0.04B (4Cr) alloys homogenized and then aged at 850° C., according to embodiments of the invention.
Figure 45:
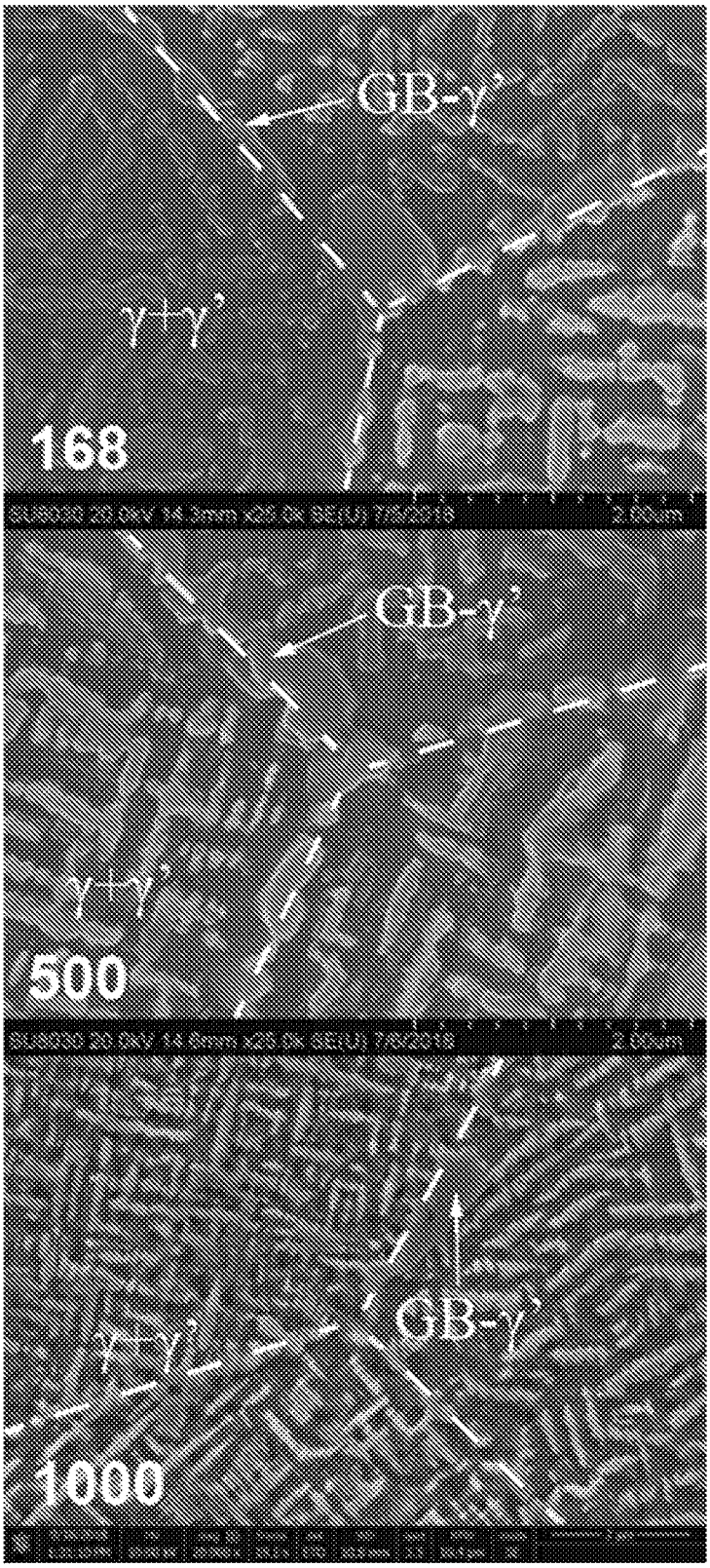
FIG. 45 presents SEM micrographs of deep-etched Co-10Ni-5Al-3Ta-3V-1Ti-0.04B (at. %) homogenized and aged at 850° C. for 168, 500, and 1000 hours, showing fine γ' precipitates within grains and coarser γ' precipitates at grain boundaries, according to embodiments of the invention.

FIG. 8 shows SEM micrographs of the 0Cr and 4Cr alloys aged at 850° C. for 0, 168, 500 and 1000 hours (0, 1, 3, and 6 weeks). After solution heat-treatment at 1200° C. for 48 hours and no aging, the microstructure in both 0Cr and 4Cr alloys is a single γ-phase (surface roughness in the micrographs of FIG. 8 is an artifact from polishing and etching). After 168 hours aging, a γ+γ' microstructure is present in both alloys, with no other phases visible. In the 0Cr alloy, the precipitates have lost their cuboidal shape and show coalescing with each other, forming plate-like γ' structures. The grain boundaries are decorated by coarsened γ' with no other phase present (as shown in FIG. 45 of supplemental information), as also seen in the prior Co-(0-2)Ni-(5-6)Al-3Ta-3V-(0-1)Ti alloys. In the 4Cr alloy, the γ' precipitates remain cuboidal with rounded corners after 168 hours aging. After 500 hours aging, the microstructures of the two alloys are undistinguishable: both show a γ+γ' microstructure with γ' precipitates which have lost their initial cuboidal shape, becoming more rounded or irregular and sometimes coalescing with neighboring precipitates. Finally, after 1000 hours of aging, no microstructure difference is again seen between 0Cr and 4Cr. FIG. 38 presents plots of the temporal evolution at 850° C. of the mean circular equivalent radius <R>, the precipitate thickness and the area fraction, respectively. Portions a) and b) of FIG. 38 show that, as aging time increases from 1 to 6 weeks, there is a weak increase in precipitate mean equivalent radius and thickness, with no effect of Cr content, within experimental error. FIG. 4*c* shows that the γ' area fraction stays constant for the 0Cr alloy at about 32%, and for the 4Cr alloy at about 34%. A summary of precipitate dimension and area fraction measurements is shown in Table 6.

TABLE 6

Summary of γ' precipitate area fractions (φ), equivalent radius (<R(t)>) and average thickness for various aging times at 850° C. for Co-10Ni-5Al-3Ta-3V-2Ti-0.04B (at. %) and Co-10Ni-5Al-4Cr-3Ta-3V-2Ti-0.04B alloys (labelled 0 Cr and 4 Cr).

| Alloy | Time (hours) | φ (%) | <R(t)> (nm) | Average Thickness (nm) |
|---|---|---|---|---|
| 0 Cr | 0 | — | — | — |
| | 168 | 32.0 ± 3.9 | 80.1 ± 49.5 | 144.0 ± 51.6 |
| | 500 | 32.5 ± 1.9 | 80.6 ± 46.4 | 155.0 ± 55.5 |
| | 1000 | 32.5 ± 0.9 | 75.9 ± 44.4 | 149.4 ± 55.8 |
| 4 Cr | 0 | — | — | — |
| | 168 | 33.9 ± 3.4 | 43.9 ± 18.2 | 79.7 ± 36.1 |
| | 500 | 33.4 ± 2.4 | 99.4 ± 69.3 | 199.0 ± 71.4 |
| | 1000 | 35.1 ± 3.4 | 96.0 ± 63.2 | 184.4 ± 65.8 |

Comparing the 0Cr and 4Cr alloys at short aging times, as shown in FIG. 38, it is apparent that the Cr-containing alloy shows a slightly higher volume fraction with somewhat finer γ' precipitates after 168 hours of aging at 850° C. Povstugar et al. [69] reported a similar increase in the γ' volume fraction in Cr-containing Co—Al—W alloys, with values going from about 38% in Cr-free Co-8.5Al-6W to about 57% with 4% Cr addition, to 64% with 8% Cr addition, upon aging for 200 hours at 900° C. In these Co—Al—W—Cr alloys, Cr partitions strongly to the γ-phase and the lattice misfit decreases from +0.43% for the ternary Co-9Al-9W alloy to +0.11% for a quinary alloy with 18% Ni and 8% Cr additions. Consistent with a lower lattice mismatch, the latter alloy showed coarser γ' precipitates with more rounded, irregular shapes [69]. Nithin et al. [24] and Pandey et al. [51] similarly reported that γ' precipitates become more rounded as Cr is added in W-free Co—Al—Mo—Ta-based alloys [51, 24]. In Co—Al—W alloys and in W-free Co—Al—Mo—Ta-based alloys, Cr replaces W and Mo atoms, respectively, from the B-sites of the $L1_2$-$AB_3$ structure, displacing W and Mo to the γ-matrix. This increases the lattice parameter of the γ-phase and decreases that of the γ'-phase, leading to an overall decrease in lattice misfit. By contrast, Cr can also replace Co in the A-sites of the $L1_2$-$AB_3$ structure which would then lead to an increase lattice parameter, given the bigger size of Cr atom compared to Co [51]. However, in Co—Al—W, excessive Cr additions lead to the formation of the μ-phase ($Co_7W_6$), as W atoms are replaced by Cr atoms in the $L1_2$-phase and rejected in the matrix, as seen by Yan et al. [38]. Similarly, the slight increase in γ'-volume fraction in our 4Cr alloy can be attributed to Cr replacing γ'-forming elements like Ta, V or Ti in the $L1_2$ phase: assuming the solubility in the γ-phase does not change (or decreases), this increase concentration of γ'-forming elements in the matrix leads to additional γ'-precipitates, as seen by Im et al. when they added 4% Cr to a Co-12Ti alloy [20, 54].

Previous research has shown that Cr additions to Co-based superalloys contribute to a decrease in γ/γ' lattice mismatch. As the lattice mismatch decreases, the shape of the coherent γ' precipitates evolves from cuboidal with sharp corners to cuboidal with rounded corners to spherical. Recent research by Zenk et al. [20, 65], has shown that, in Co-12Ti, a high misfit contributes to the formation of elongated γ' precipitates with an irregular, non-smooth interface with the γ-matrix. Cr additions decreases the lattice misfit resulting in cuboidal γ' precipitates with sharp corners and a smooth interface with the γ-matrix [20]. A similar effect is seen in our 0Cr and 4Cr alloys, with γ'-precipitates becoming more cuboidal in the latter alloy after aging for 168 hours at 850° C., as shown in FIG. 8, consistent with a decrease in the γ/γ' lattice misfit from a high positive misfit. However, x-ray diffraction and site occupancy studies are warranted to examine the effect of Cr on the γ/γ' lattice misfit.

B. Atom Probe Tomography (APT) Study

Figure 39B:
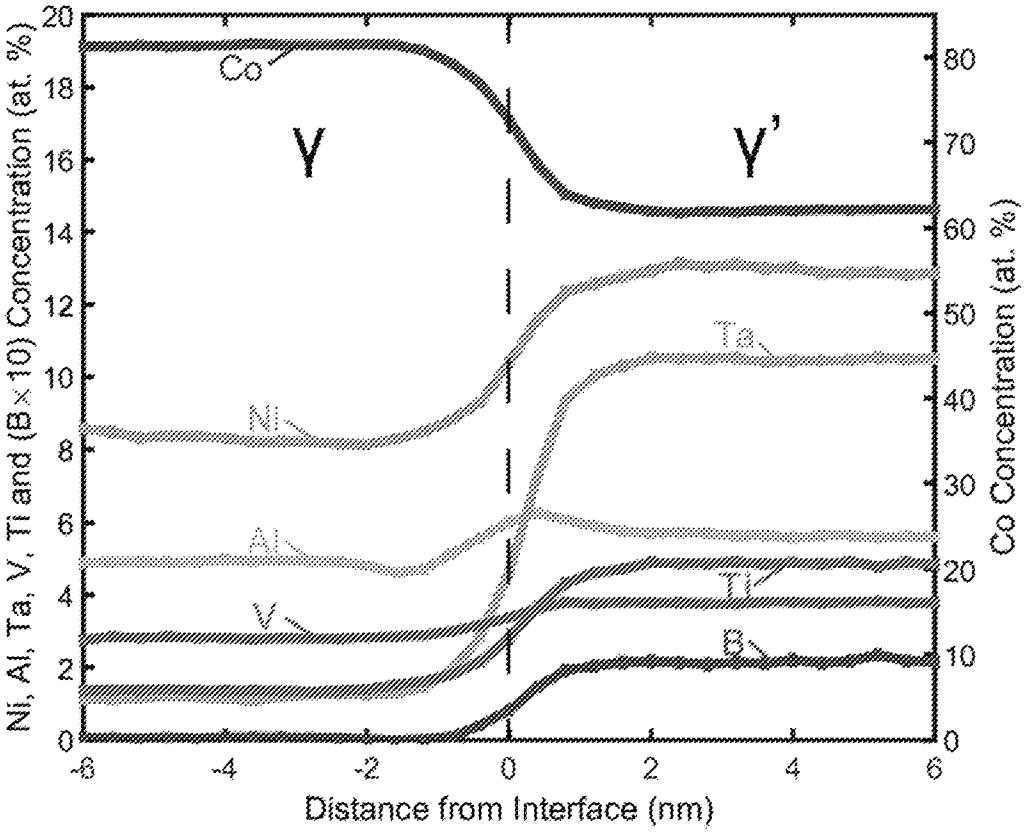
FIGS. 39A and 39B show respectively APT tip reconstruction showing γ/γ' microstructure in Co-10Ni-5Al-3Ta-3V-2Ti-0.04B (0Cr) aged at 850° C. for 24 hours, and proxigram showing elemental partitioning between γ and γ' phases, as well as slight interfacial segregation of Al, according to embodiments of the invention.
Figure 39A:
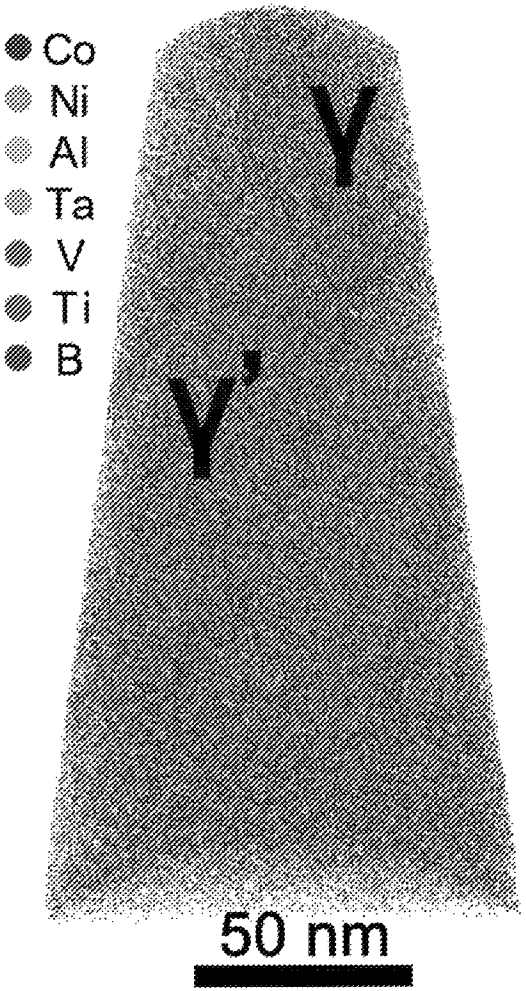

An APT volume reconstruction is shown in FIG. 39A for the Cr-free (0Cr) alloy (Co-10Ni-5Al-3Ta-3V-2Ti-0.04B) aged for 24 hours at 850° C. This APT volume includes about 110 million atoms and contains one full and four partial γ' precipitates. A proximity histogram, taking into consideration the global tip concentration (average of all phase and precipitates), is shown in FIG. 39B. All alloying elements, except for Co, partition to the γ'-phase, as expressed via the partitioning ratio $K_X^{\gamma'/\gamma}$), defined as the ratio of atomic concentrations of element X in the γ' and γ phases. In the 0Cr alloy, the elements showing the strongest partitioning are boron ($K_B^{\gamma'/\gamma}$=44), tantalum ($K_{Ta}^{\gamma'/\gamma}$=8.76) and titanium ($K_{Ti}^{\gamma'/\gamma}$=3.49). The other three alloying elements show relatively low partitioning to the γ' phase: nickel ($K_{Ni}^{\Gamma'/\gamma}$=1.56), vanadium ($K_V^{\Gamma'/\gamma}$=1.35) and aluminum ($K_{Al}^{\gamma'/\gamma}$=1.15). Our result are consistent with the Co-based superalloy literature where Ti and Ta show strong partitioning to the γ'-phase, while Ni and Al show very weak partitioning [5, 9, 30, 51, 53, 63, 69, 70]. In particular, the strong Ta and B partitioning in our alloy is similar to those found in Co-6Ta-6V ($K_{Ta}^{\gamma'/\gamma}$=8.54 in γ'-$Co_3(Ta_{0.76}V_{0.24})$) and in Co-9Al-9W-0.12B (where 0.012 at. % B is seen in the γ'-$Co_3$(Al,W) which would yield $K_B^{\gamma'/\gamma}$>12, given that the measure concentration of B in the γ-phase is below the sensitivity limit of 0.001 at. % [67]). In our alloy, Al is the only element showing atomic segregations at the γ-γ'-interface, as shown in FIG. 39B; segregation can be attributed to kinetic diffusion processes and unmet equilibrium at the relatively short aging time (24 hours) at 850° C. [18, 53].

As summarized in Table 7, the compositions of the γ- and γ'-phases are measured as Co-8.3Ni-4.9Al-1.2Ta-2.8V-1.4Ti-0B and Co-13Ni-10.5Ta-5.6Al-4.9Ti-3.8V-0.2B, respectively. The γ'-phase stoichiometry is then $(Co_{0.83}Ni_{0.17})_3(Ta_{0.42}Al_{0.23}Ti_{0.19}V_{0.15}B_{0.01})$, assuming that Ni and Co exclusively occupy the A-sublattice of γ'-$A_3B$ and that the other five elements exclusively occupy the B sublattice. For comparison, the γ'-phase composition in the ternary Co-6Ta-6V alloy is $Co_3(Ta_{0.76}V_{0.24})$ [61]. A similar Ta/V≈3 ratio thus exists in the γ'-phases of both alloys, indicating that Al and Ti, added in the present 0Cr alloy, show no strong preference for replacing either Ta or V in the ternary $Co_3(Ta_{0.76}V_{0.24})$ phase.

The γ' volume fraction for this alloy can be found based on elemental concentrations for each phase and bulk tip composition as measured by LEAP (Table 7), using the lever rule:

$$C_i^{\gamma'}\varphi+C_i^{\gamma}(1-\varphi)=C_i^{Bulk} \quad (1)$$

where φ is the γ' volume fraction and $C_i^{\gamma}$, $C_i^{\gamma'}$, and $C_i^{Bulk}$ are the concentrations of species i (i=Co, Ni, Al, Ta,V, Ti and B) in the γ-phase, γ'-phase and bulk tip, respectively. Rewriting Eq, (1), the γ' volume fraction is:

$$\varphi=(C_i^{Bulk}-C_i^{\gamma})/(C_i^{\gamma'}-C_i^{\gamma}) \quad (2)$$

Figure 46:
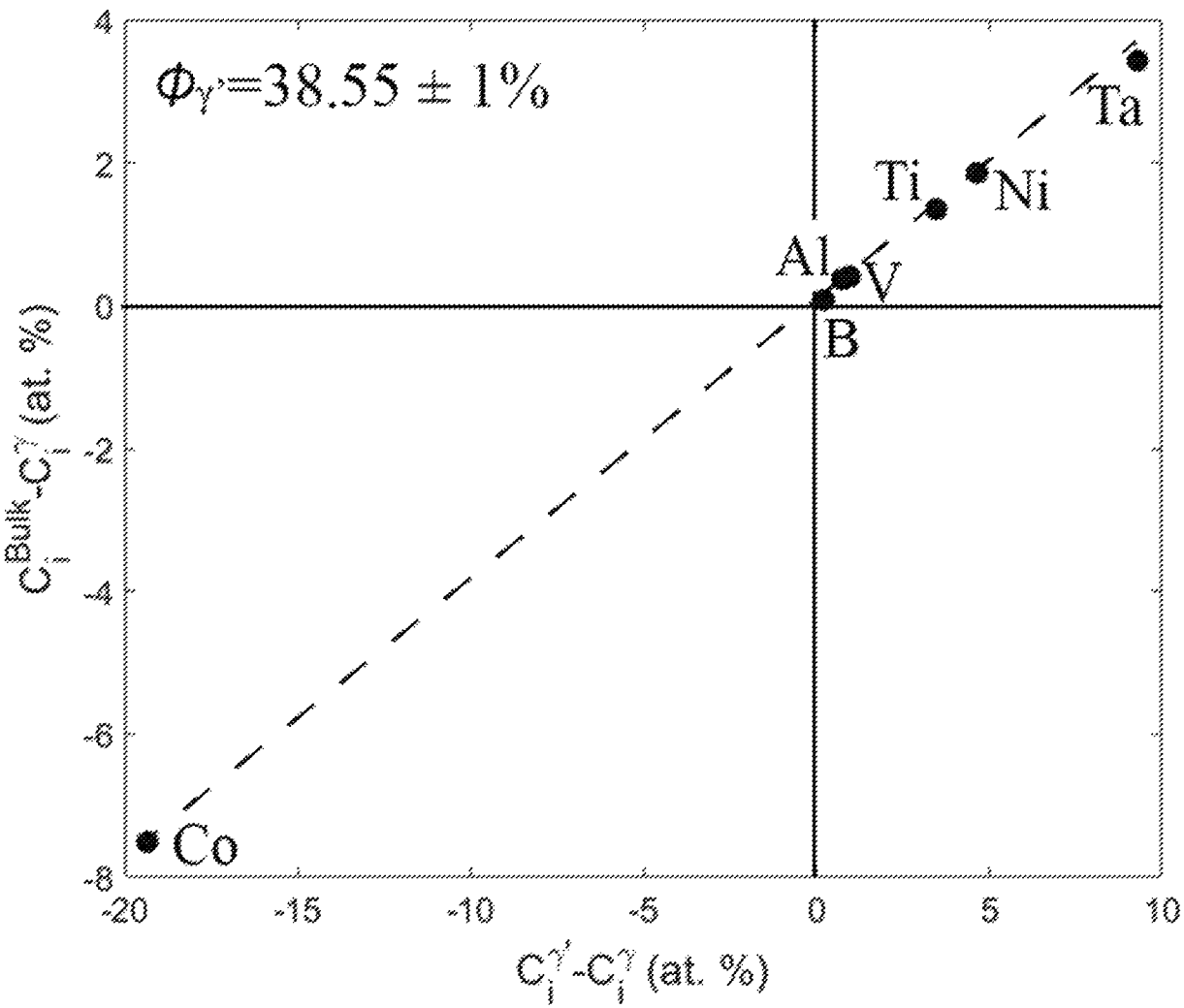
FIG. 46 shows Lever rule plot for a Co-10Ni-5Al-3Ta-3V-2Ti-0.04B alloy aged at 850° C. for 24 hours. The slope of the linear fit is equal to the γ' volume fraction (q), in this case 38%, according to embodiments of the invention.

Thus, the γ' volume fraction can be obtained by plotting ($C_i^{Bulk}-C_i^{\gamma}$) against ($C_i^{\gamma'}-C_i^{\gamma}$) for each element i and fitting a linear regression whose slope is equal to q. Using this approach, as shown in FIG. 46 of supplemental information, the γ' volume fraction, for the very small volume reconstructed by LEAP, is calculated to be 38.6±1.0%, which is similar to the values (about 33%) calculated with ImageJ from the SEM micrographs, over much larger areas and for longer aging times.

TABLE 7

Bulk concentration (EDS measurement), APT concentration for tip (volume, γ and γ' phases) and elemental partitioning coefficients ($K^{\gamma'/\gamma}$), as measured by APT for Co-10Ni-5Al-3Ta-3V-2Ti-0.04B after aging for 24 hours at 850° C.

| | Concentration (at. %) | | | | | |
|---|---|---|---|---|---|---|
| Element | Nominal | Bulk (EDS) | Tip (APT) | γ (APT) | γ' (APT) | $K^{\gamma'/\gamma}$ |
| Co | 77 | 76.2 | 73.88 | 81.38 | 62.04 | 0.76 |
| Ni | 10 | 9.6 | 10.19 | 8.32 | 12.97 | 1.56 |
| Al | 5 | 5.8 | 5.26 | 4.88 | 5.63 | 1.15 |
| Ta | 3 | 3.2 | 4.63 | 1.20 | 10.48 | 8.76 |

TABLE 7-continued

Bulk concentration (EDS measurement), APT concentration for tip (volume, γ and γ' phases) and elemental partitioning coefficients ($K^{\gamma'/\gamma}$), as measured by APT for Co-10Ni-5Al-3Ta-3V-2Ti-0.04B after aging for 24 hours at 850° C.

| | Concentration (at. %) | | | | | |
|---|---|---|---|---|---|---|
| Element | Nominal | Bulk (EDS) | Tip (APT) | γ (APT) | γ' (APT) | $K^{\gamma'/\gamma}$ |
| V | 3 | 2.9 | 3.23 | 2.82 | 3.79 | 1.35 |
| Ti | 2 | 2.4 | 2.74 | 1.39 | 4.86 | 3.49 |
| B | 0.04 | 0* | 0.088 | <0.005 | 0.22 | >44 |

*below EDS detection limit.

C. γ' Solvus Temperature and Mass Density

The solvus temperature of the 0Cr and 4Cr alloys was measured as 965° C. for both alloys, visible as a sharp exothermic peak in the DSC cooling curve, FIG. 40A. In FIG. 40B, the solvus temperature of our alloys are compared to those of ternary Co-9Al-9.8W and to six W-free Co-based superalloys: (i) ternary Co-5Ti-15V and Co-11Ti-15Cr [20], (ii) quaternary Co-10Al-5Mo-2Ta [18], (iii) quinary Co-30Ni-10Al-5Mo-2Nb and (iv) multinary Co-30Ni-10Al-5Mo-2Nb-2Ti (with 2 Ti added to the previous quinary alloy) and Co-30Ni-10Al-5Mo-2Ta-2Ti [18](with Nb in the previous alloy replaced by Ta). The 965° C. solvus temperature of our 0Cr and 4Cr alloys is higher than that of Co-10Al-5Mo-2Ta (928° C.) and close to those reported for Co-9Al-9.8W (990° C.) and Co-30Ni-10Al-5Mo-2Nb (990° C.) [19]; the two multinary alloys, each with 30% Ni, have significantly higher solvus temperatures (1030 and 1066° C.). In studies of Co-10Al-5Mo-2X alloy[17,18], the additions of 30 at. % Ni and 2 at. % Ti increased the solvus temperature by about 50° C. This suggest that, in our 0Cr and 4Cr alloys, doubling or tripling the Ni concentration (i.e., from 10 to 20 or 30 at. %) may increase the solvus temperatures well above 1000° C. The highest solvus in the above W-free alloys is seen for the ternary Co-5Ti-15V (1091° C.) and Co-11Ti-14Cr (1100° C.), which can be attributed to their very high Ti contents, consistent with the 1005° C. solvus temperature of binary Co-12Ti [54]. However, these ternary alloys are Al-free, unlike the other alloys listed above, and are thus not oxidation-resistant.

FIG. 40C compares the theoretical mass density of our 0Cr and 4Cr alloys (based on composition, density and atomic weight) with the theoretical mass density of the same seven above comparison alloys. The calculated theoretical density of the comparison alloys is somewhat different than the ones experimentally obtained and reported in the literature, but for consistency, these values can be compared here. Our alloys have significant lower densities than the W-bearing Co—Al—W ternary alloy, but higher densities (by 2.8 to 8.6%) than the six other W-free alloys. This is due to the presence of high-density Ta in our alloys, as well as their limited content in low-density Al.

D. Mechanical Properties

Figure 41A:
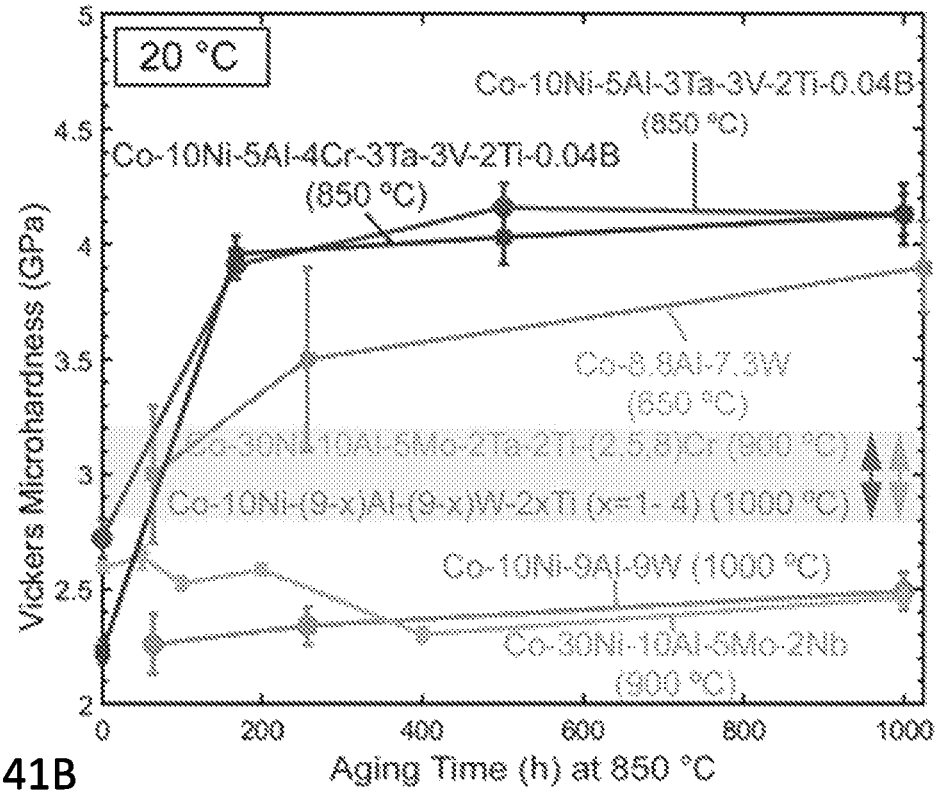
FIGS. 41A and 41B show respectively Vickers microhardness as a function of aging time for Co-10Ni-5Al-xCr-3Ta-3V-2Ti-0.04B (x=0 and 4), and minimum strain rate vs. compressive stress for Co-10Ni-5Al-3Ta-3V-2Ti-0.04B compared with different Co-based alloys crept at 850° C., according to embodiments of the invention.

Hardness at Ambient Temperature: FIG. 41A shows the temporal evolution of Vickers microhardness (measured at ambient temperature) for the 0Cr and 4Cr alloys aged for 0, 168, 500 and 1000 hours at 850° C. In the solutionized condition (0 h) where no γ' precipitate are present, the 4Cr alloy is harder than the 0Cr alloy (2.7 vs 2.2 GPa), consistent with solid-solution strengthening. In the aged state, the hardness increases sharply to about 4 GPa after aging for 168 hours for both alloys, as expected from the presence of the γ' precipitates. The hardness increases mildly (to about 4.1 GPa) after 500 and 1000 hours, independently of Cr content. This behavior is consistent with the minimal changes seen in the γ/γ′ microstructure as aging time progresses from 168 to 1000 hours in both 0Cr and 4Cr alloys, as shown in FIG. 38. For comparison purposes, the hardness evolution with aging at various temperatures (750-1000° C.) is also shown in FIG. 41A for W-bearing Co-superalloys (Co-8.8Al.7.3W [48], Co-10Ni-(9−x)Al-(9−x)W-(2x)Ti (x=0-4) [9]) and W-free Co-superalloys (Co-30Ni-10Al-5Mo-2Ta-2Ti-xCr (x=2, 5, 8) [51], and Co-30Ni-10Al-5Mo-2Nb [71]). Hardness values of aged 0Cr and 4Cr alloys are similar to that of Co—Al—W (about 4.0 GPa [7]) aged for 24 hours at 800° C. However, higher hardness is seen in in our alloys (0Cr and 4Cr) when compared to Co-8.8Al-7.3W at short aging times (3.5 MPa at 256 hours); after 1024 hours at 650° C., Co-8.8Al-7.3W shows a similar hardness (about 3.9 GPa) [48]. However, as shown in FIG. 41A, Co-10Ni-(9-x)Al-(9−x)W-(2x)Ti shows a lower hardness than our alloys by about 1 GPa [9]. Also as illustrated in FIG. 41A, the hardness of our 0Cr and 4Cr alloys is substantially higher than those of W-free superalloys: Co-30Ni-10Al-5Mo-2Nb (by about 1.5 GPa [71]) and Co—Ni—Al—Mo-2Ta-Ti-xCr (x=2, 5, 8) (by about 1 GPa [51]). High hardness in our alloys may be due to the strong partitioning of B to the γ-phase (FIG. 39B): boron is known to act as a potent γ′ solid-solution strengthener, as measured in Co-9Al-9W-0.04B alloys via nanoindentation tests [67].

Figure 41B:
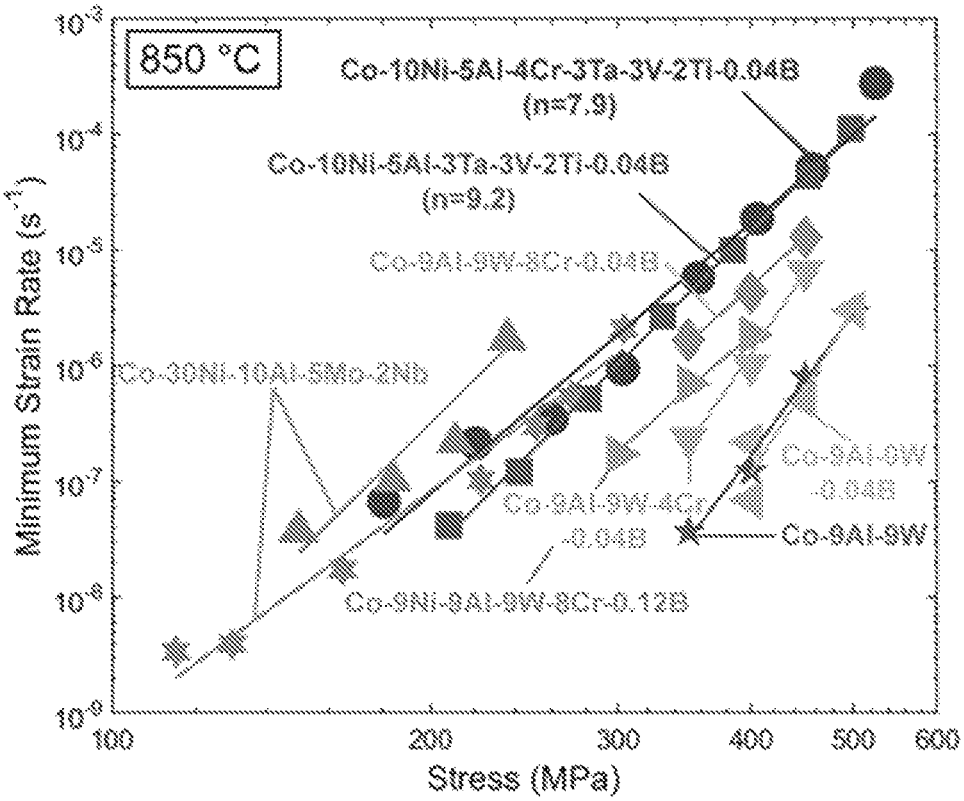

Creep properties at 850° C.: FIG. 41B shows the minimum creep strain rate ¿ as a function of compressive stress o for our 0Cr and 4Cr alloys (Co-10Ni-5Al-xCr-3Ta-3V-2Ti-0.04B (x=0 and 4)) tested at 850° C. An apparent stress exponent, n=9.2 for 0Cr and n=7.9 for 4Cr, is determined based on the power-law creep equation:

$$\dot{\varepsilon} = A\sigma^n \exp\left(\frac{-Q}{R_g T}\right) \tag{3}$$

where A is a constant, Q is the activation energy, $R_g$ is the ideal gas constant, and T is the absolute temperature. Also shown in FIG. 41B are creep results at 850° C. for various Co-based superalloys, which all show similar high values of stress exponents (n about 10) indicative of dislocation creep in the presence of shearable precipitates. The creep resistance of our alloys can be first compared with that of a W-free Co-superalloy (Co-30Ni-10Al-5Mo-2Nb) with somewhat higher concentration of refractory elements (7 at. % Mo+Nb vs. 6 at. % Ta+V) and the same γ′ volume fraction before creep (about 33-35%). Nevertheless, the present alloy shows the same or better creep resistance than Co-30Ni-10Al-5Mo-2Nb (data are shown for two separate samples, crept for different durations [71]), albeit with a 6% penalty in mass density (8.59 vs. 8.12 g/cm$^3$). Also shown in FIG. 41B are five W-bearing Co-based superalloys with higher refractory content (9 at. % W vs. 6 at. % Ta+V) and thus higher γ′ fraction: Co-9Al-9W (39% γ′) [69], Co-9Al-9W-0.04B (58% γ′) [37], Co-9Al-9W-4Cr-0.04B (58% γ′) [69], Co-9Al-9W-8Cr-0.04B (64% γ′) [69], and Co-9Ni-9Al-9W-8Cr-0.12B (64% γ′) [69]. Our W-free superalloys shows similar (for Co-9Al-9W-8Cr) or reduced creep resistance (for the other three W-containing alloys), but at a significantly lower density (8.59 vs. 9.22-9.36 g/cm$^3$) and γ′ volume fraction (33-35% vs. 39-64% γ′).

Interestingly, no significant difference in creep resistance is seen between our 0Cr and 4Cr alloys. This is contrary to what was reported by Povstugar et al. where adding 4 and 8 at. % Cr into the ternary Co-9Al-9W caused a dramatic increase in the steady-state strain rate, by about 1 and about 2 orders of magnitude, respectively. The results shown here are more similar to those reported by Chung et al. who studied Co-30Ni-11Al-2Ti-5.5W-2.5Ta-0.1B-xCr (x=0, 4, 8 and 12) alloys with very high (about 98%) γ′ fraction, where Cr additions had little effect on creep resistance. Similarly, a study by Ng et al. of Co-30Ni-7Al-4Ti-3Mo-2W-1Nb-1Ta-0.1B-xCr (x=0, 4, 8 and 12) alloys with 70-80% γ′ fraction shows that Cr does not affect the creep strength of the alloys in a significant matter. Thus, it is likely that Cr does not affect the shear resistance of the $L1_2$ precipitates of our 0Cr and 4Cr alloys.

Figure 47:
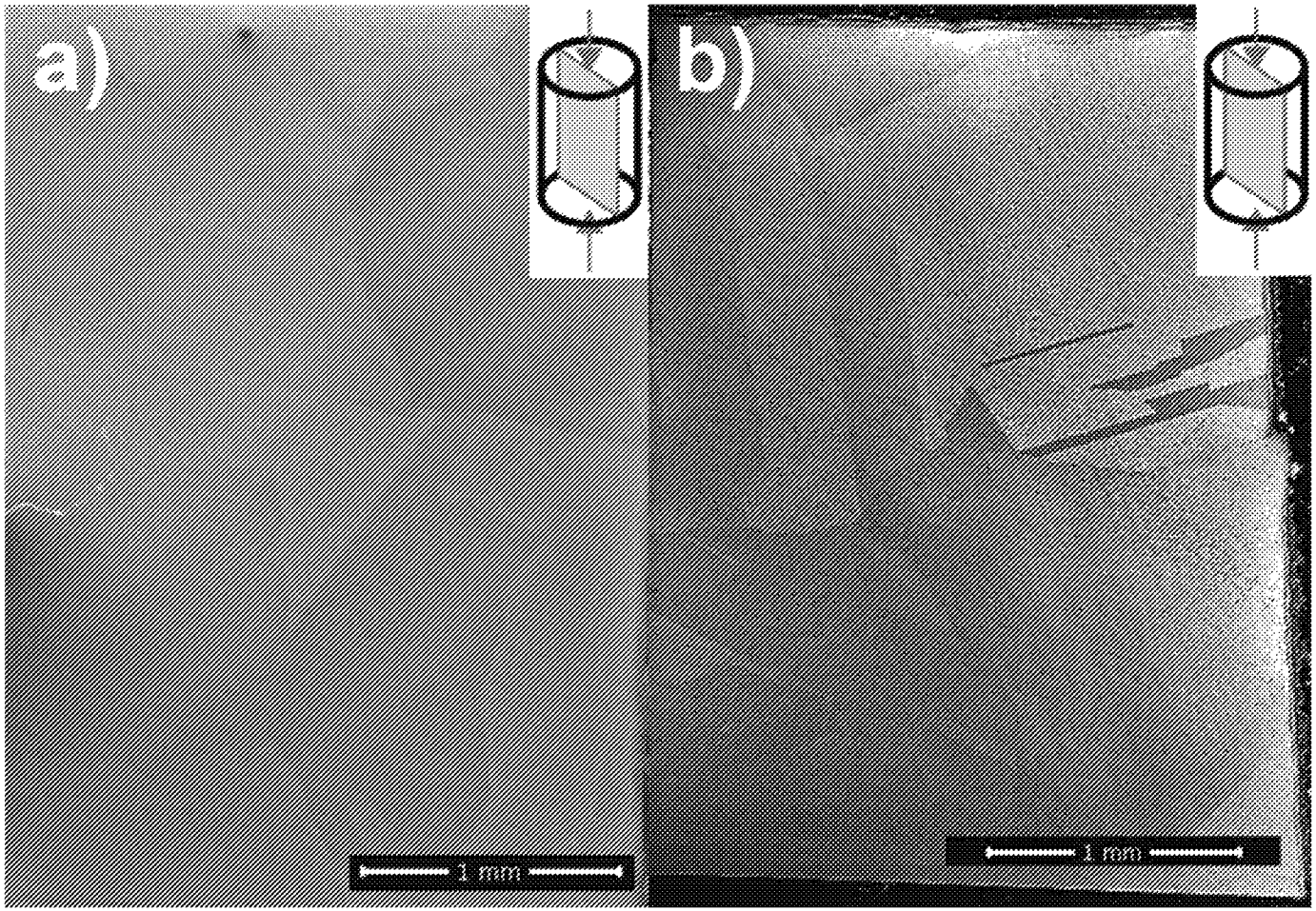
FIG. 47 presents Post-creep SEM micrographs of Co-10Ni-5Al-3Ta-3V-1Ti-0.04V (portion a)) and Co-10Ni-5Al-4Cr-3Ta-3V-1Ti-0.04V (portion b)) showing the grain distribution in the crept specimen, according to embodiments of the invention. The sample specimens were aged at 850° C. for 168 hours before being crept at 850° C. as a function of stress.
Figure 48:
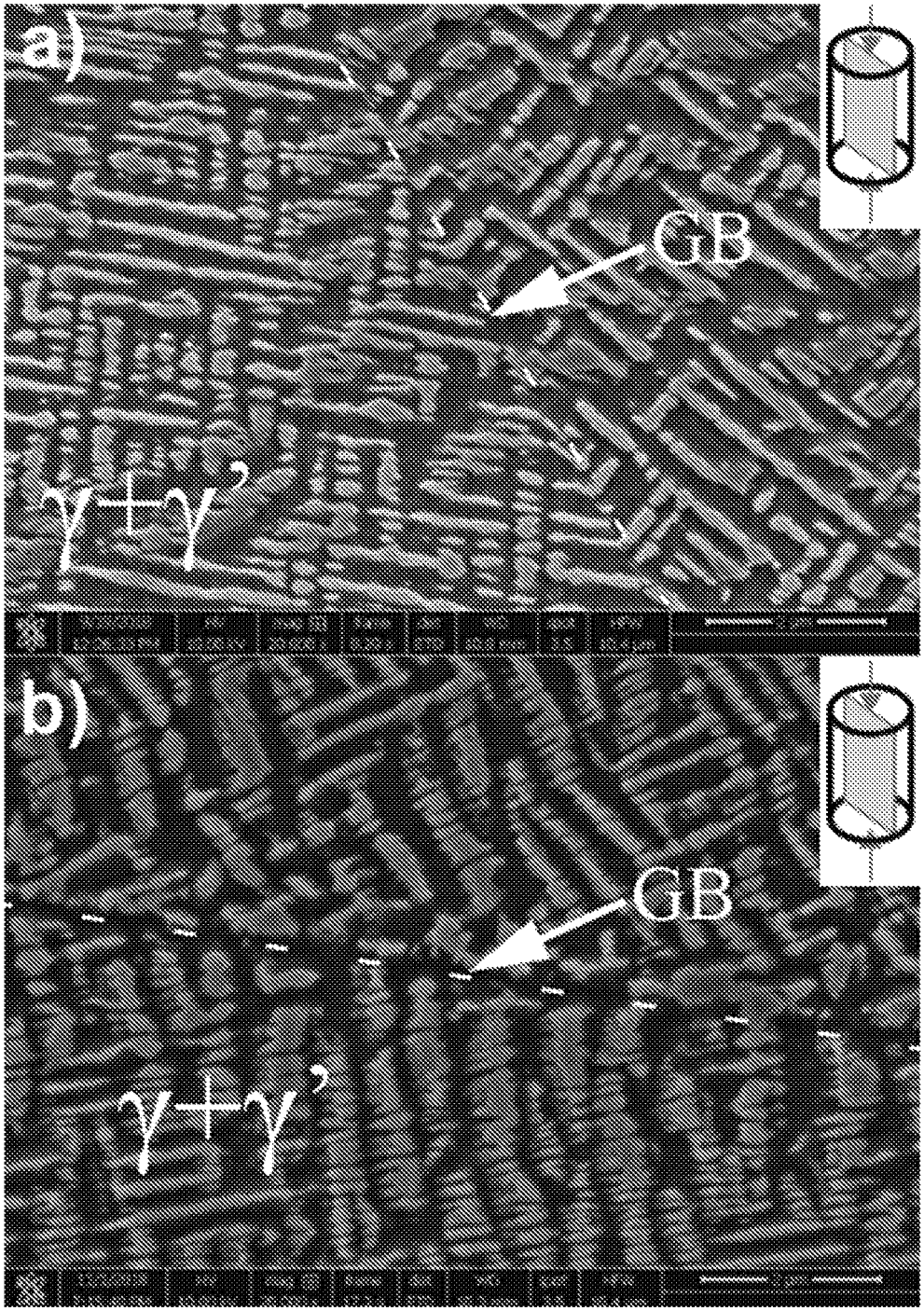
FIG. 48 presents Post-creep SEM micrographs of Co-10Ni-5Al-3Ta-3V-1Ti-0.04V (portion a)) and Co-10Ni-5Al-4Cr-3Ta-3V-1Ti-0.04V (portion b)) showing clean grain boundaries, according to embodiments of the invention. The sample specimens were aged at 850° C. for 168 hours before being crept at 850° C. as a function of stress.

The post-creep microstructure of our 0Cr and 4Cr alloys, after having accumulated about 10% strain during 154 and 44 hours of deformation, respectively, is shown in FIG. 10 in cross-sections parallel and perpendicular to the applied compressive load. The crept specimens cross-section (shown in FIG. 47 of supplemental information) reveals about 18 grains with an average grain size of about 0.87±0.46 mm for the 0 Cr alloy and about 11 grains with an average grain size of about 1.23±0.39 mm for the 4Cr alloy (measured with ImageJ). In the former cross-section shown in portions a) and c) of FIG. 10, horizontal rows of γ′ precipitates are partially coalesced into rafts oriented perpendicular to the applied stress, coexisting with vertical columns of unrafted, equiaxed γ′ precipitates. The grain boundaries of the crept specimens are devoid of precipitates (FIG. 48 of supplemental information): thus, the original grain-boundary γ′ precipitates (FIG. 45) dissolved during creep, and no other detrimental phases were precipitated. Future modifications of this alloy will increase the B content so as to precipitate stable borides at the grain boundaries, which are known to significantly increase creep resistance of Co-based superalloys [8, 37].

In the cross-sections shown in portions b) and f) of FIG. 10 perpendicular to the compressive stress, γ′ rafts are apparent in both directions. However, the extent of rafting is less pronounced than in other Co—Al—W-based alloys [70, 74-75] and W-free Co-30Ni-10Al-5Mo-2Nb [71] tested at 850-1050° C. where precipitates have completely coalesced into rafts with much higher aspect ratios. This mild rafting occurs in our 0Cr and 4Cr alloy in directions perpendicular to the applied compressive stress, which is indicative of a positive γ/γ′ lattice mismatch, as also reported in Co—Al—W based alloys [74-76] and in Co-30Ni-10Al-5Mo-2Nb [81]. By contrast, Ni-based superalloys exhibit rafting in directions parallel to the compressive applied load, due to their negative lattice misfit [77].

In sum, we report here the stabilization of the metastable γ-$Co_3(Ta_{0.76}V_{0.24})$ phase, recently found as precipitates in the Co-6Ta-6V (at. %) ternary alloy [61], and the development of a W- and Mo-free γ+γ′ superalloy with good coarsening- and creep resistance (as measured experimentally) and improved oxidation resistance (as expected from substantial Al and Cr contents). The following six alloys were developed, in order of complexity.

At first, the Co-6Ta-6V alloy is modified by replacing half its Ta and V with Al. The resulting Co-6Al-3Ta-3V alloy shows a γ+γ′ microstructure free of other phases, up to the longest aging time of 168 hours studied at 850 and 900° C. By contrast, the γ′ phase of the original ternary Co-6Ta-6V alloy was studied up to 64 hours at 900° C., when more than 50% of the γ phase had transformed into lamellar C36.

In a second alloy, 1% Al is replaced with 1% Ti. The resulting Co-5Al-3Ta-3V-1Ti alloy shows no difference in microstructure aging evolution, as compared to the first, Ti-free alloy, indicating that Ti can be added without destabilizing the γ' phase.

A third and fourth alloy are created by adding 2% Ni to the above compositions. They also show no difference in microstructure after aging at 850 and 900° C. for 168 hours, as compared to the first and second Ni-free alloys. This opens the door to Ni additions.

Based on the previous Ni and Ti additions, a fifth alloy is made by adding 10% Ni and 0.04% B to the above second alloy and by doubling its Ti concentration. This Co-10Ni-5Al-3Ta-3V-2Ti-0.04B alloy shows a stable γ-γ' microstructure up to 1000 hours (6 weeks) of aging at 850° C. No other phases are present in grains or at grain boundaries, which are decorated with coarsened γ' precipitates. This is a very significant improvement as compared to the original Co-6Ta-6V in which the metastable γ' phase transformed to C36 ($Co_3$(Ta,V)) after only about 2-16 hours of aging at 900° C.

For Co-10Ni-5Al-3Ta-3V-2Ti-0.04B aged for short times at 850° C. (24 hours), the composition of the cuboidal γ'-nanoprecipitates is measured by atom probe tomography as $(Co_{0.83}Ni_{0.17})_3(Ta_{0.42}Al_{0.23}\ Ti_{0.19}V_{0.15}B_{0.01})$; Al and Ti thus replace at the same rate both Ta and V in the ternary $Co_3(Ta_{0.76}V_{0.24})$.

The peak hardness of Co-10Ni-5Al-3Ta-3V-2Ti-0.04B (after 1-3 weeks at 850° C.) is greater than most W-free Co-based superalloys and some Co—Al—W-based superalloys. This may be due to strong B partitioning to the γ'-phase (and a concomitant lack of borides at the grain boundaries).

The creep resistance of Co-10Ni-5Al-3Ta-3V-2Ti-0.04B at 850° C., is higher than W-free Co-30Ni-10Al-5Mo-2Nb, and comparable to W-bearing Co-9Al-9W-8Cr alloys.

A 4% Cr addition (to improve oxidation resistance) leads to the sixth alloy. Co-10Ni-5Al-4Cr-3Ta-3V-2Ti-0.04B, which shows a slight increase in γ' volume fraction and a slight decrease in γ' size in the early stage (168 hours) of aging at 850° C. At longer aging time, the γ' precipitate fraction, size and shape are undistinguishable from to those of the non-Cr containing alloy, and so are the hardness evolution and the creep resistance at 850° C.

The foregoing description of the exemplary embodiments of the present invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

LIST OF REFERENCES

[1]. J. R. Davis, Nickel, Cobalt, and Their Alloys, ASM International, 2000.

[2]. H. Chinen, J. Sato, T. Omori, K. Oikawa, I. Ohnuma, R. Kainuma, K. Ishida, New ternary compound Co3(Ge, W) with L12 structure, Scr. Mater. 56 (2007) 141-143.

[3]. K. Shinagawa, T. Omori, J. Sato, K. Oikawa, I. Ohnuma, R. Kainuma, K. Ishida, Phase Equilibria and Microstructure on γ' Phase in Co—Ni—Al—W System, Mater. Trans. 49 (2008) 1474-1479.

[4]. L. Zhu, C. Wei, hours. Qi, L. Jiang, Z. Jin, J. C. Zhao, Experimental investigation of phase equilibria in the Co-rich part of the Co—Al—X (X=W, Mo, Nb, Ni, Ta) ternary systems using diffusion multiples, J. Alloys Compd. 691 (2017) 110-118.

[5]. A. Suzuki, hours. Inui, T. M. Pollock, $L1_2$-Strengthened Cobalt-Base Superalloys, Annu. Rev. Mater. Res. 45 (2015) 345-368.

[6]. J. J. Ruan, X. J. Liu, S. Y. Yang, W. W. Xu, T. Omori, T. Yang, B. Deng, hours. X. Jiang, C. P. Wang, R. Kainuma, K. Ishida, Novel Co—Ti—V-base superalloys reinforced by $L1_2$-ordered γ' phase, Intermetallics. 92 (2018) 126-132.

[7]. P. J. Bocchini, C. K. Sudbrack, D. J. Sauza, R. D. Noebe, D. N. Seidman, D. C. Dunand, Effect of tungsten concentration on microstructures of Co-10Ni-6Al-(0,2,4,6) W-6Ti (at %) cobalt-based superalloys, Mater. Sci. Eng. A. 700 (2017) 481-486.

[8]. P. J. Bocchini, C. K. Sudbrack, R. D. Noebe, D. C. Dunand, D. N. Seidman, Microstructural and creep properties of boron- and zirconium-containing cobalt-based superalloys, Mater. Sci. Eng. A. 682 (2017) 260-269.

[9]. P. J. Bocchini, C. K. Sudbrack, R. D. Noebe, D. C. Dunand, D. N. Seidman, Effects of titanium substitutions for aluminum and tungsten in Co-10Ni-9Al-9W (at %) superalloys, Mater. Sci. Eng. A. 705 (2017) 122-132.

[10]. J. Sato, Cobalt-Base High-Temperature Alloys, Science (80-). 312 (2006) 90-91.

[11]. P. J. Bocchini, E. A. Lass, K. W. Moon, M. E. Williams, C. E. Campbell, U. R. Kattner, D. C. Dunand, D. N. Seidman, Atom-probe tomographic study of γ/γ' interfaces and compositions in an aged Co—Al—W superalloy, Scr. Mater. 68 (2013) 563-566.

[12]. J. E. Saal, C. Wolverton, Thermodynamic stability of Co—Al—W L12 γ', Acta Mater. 61 (2013) 2330-2338.

[13]. M. Ooshima, K. Tanaka, N. L. Okamoto, K. Kishida, hours. Inui, Effects of quaternary alloying elements on the γ' solvus temperature of Co—Al—W based alloys with fcc/L12 two-phase microstructures, J. Alloys Compd. 508 (2010) 71-78.

[14]. T. Omori, K. Oikawa, J. Sato, I. Ohnuma, U. R. Kattner, R. Kainuma, K. Ishida, Partition behavior of alloying elements and phase transformation temperatures in Co—Al—W-base quaternary systems, Intermetallics. 32 (2013) 274-283.

[15]. D. J. Sauza, P. J. Bocchini, D. C. Dunand, D. N. Seidman, Influence of ruthenium on microstructural evolution in a model Co—Al—W superalloy, Acta Mater. 117 (2016) 135-145.

[16]. S. K. Makineni, B. Nithin, K. Chattopadhyay, A new tungsten-free γ-γ' Co—Al—Mo—Nb-based superalloy, Scr. Mater. 98 (2015) 36-39.

[17]. S. K. Makineni, B. Nithin, D. Palanisamy, K. Chattopadhyay, Phase evolution and crystallography of precipitates during decomposition of new "tungsten-free" Co(Ni)—Mo—Al—Nb γ-γ' superalloys at elevated temperatures, J. Mater. Sci. 51 (2016) 7843-7860.

[18]. S. K. Makineni, A. Samanta, T. Rojhirunsakool, T. Alam, B. Nithin, A. K. Singh, R. Banerjee, K. Chattopadhyay, A new class of high strength high temperature Cobalt based γ-γ' Co—Mo—Al alloys stabilized with Ta addition, Acta Mater. 97 (2015) 29-40.

[19]. S. K. Makineni, B. Nithin, K. Chattopadhyay, Synthesis of a new tungsten-free γ-γ' Cobalt-based superalloy by tuning alloying additions, Acta Mater. 85 (2015) 85-94.

[20]. C. H. Zenk, I. Povstugar, R. Li, F. Rinaldi, S. Neumeier, D. Raabe, M. Göken, A novel type of Co—Ti—Cr-base γ/γ' superalloys with low mass density, Acta Mater. 135 (2017) 244-251.

[21]. J. J. Ruan, C. P. Wang, C. C. Zhao, S. Y. Yang, T. Yang, X. J. Liu, Experimental investigation of phase equilibria and microstructure in the Co—Ti—V ternary system, Intermetallics. 49 (2014) 121-131.

[22]. S. Kirklin, J. E. Saal, V. I. Hegde, C. Wolverton, High-throughput computational search for strengthening precipitates in alloys, Acta Mater. 102 (2016) 125-135.

[23]. C. Nyshadham, C. Oses, J. E. Hansen, I. Takeuchi, S. Curtarolo, G. L. W. Hart, A computational high-throughput search for new ternary superalloys, Acta Mater. 122 (2017) 438-447.

[24]. B. Nithin, A. Samanta, S. K. Makineni, T. Alam, P. Pandey, A. K. Singh, R. Banerjee, K. Chattopadhyay, Effect of Cr addition on γ-γ' cobalt-based Co—Mo—Al—Ta class of superalloys: a combined experimental and computational study, J. Mater. Sci. 52 (2017) 11036-11047.

[25]. J. J. Ruan, C. P. Wang, S. Y. Yang, T. Omori, T. Yang, Y. Kimura, X. J. Liu, R. Kainuma, K. Ishida, Experimental investigations of microstructures and phase equilibria in the Co—V—Ta ternary system, J. Alloys Compd. 664 (2016) 141-148.

[26]. C. P. Wang, S. Yang, S. Y. Yang, D. Wang, J. J. Ruan, J. Li, X. J. Liu, Experimental Investigation of the Phase Equilibria in the Co—Nb—V Ternary System, J. Phase Equilibria Diffus. 36 (2015) 592-598.

[27]. K. Shinagawa, hours. Chinen, T. Omori, K. Oikawa, I. Ohnuma, K. Ishida, R. Kainuma, Phase equilibria and thermodynamic calculation of the Co—Ta binary system, Intermetallics. 49 (2014) 87-97.

[28]. P. A. Carvalho, P. M. Bronsveld, B. J. Kooi, J. T. M. De Hosson, On the fcc→D0 19 transformation in Co—W alloys, Acta Mater. 50 (2002) 4511-4526.

[29]. D. J. Sauza, P. J. Bocchini, D. C. Dunand, D. N. Seidman, Influence of ruthenium on microstructural evolution in a model [Formula presented] superalloy, Acta Mater. 117 (2016) 135-145.

[30]. S. Meher, L. J. Carroll, T. M. Pollock, M. C. Carroll, Solute partitioning in multicomponent γ/γ' Co—Ni-base superalloys with near-zero lattice misfit, Scr. Mater. 113 (2016) 185-189.

[31]. L. Nagel, B. Fultz, Phase Equilibria of $Co_3V$, J. Phase Equilibria. 18 (1997) 21-23.

[32]. E. A. Lass, M. E. Williams, C. E. Campbell, K.-W. Moon, U. R. Kattner, γ' Phase Stability and Phase Equilibrium in Ternary Co—Al—W at 900° C., J. Phase Equilibria Diffus. 35 (2014) 711-723.

[33]. S. Lee, K. Lee, T. Chuang, Discontinuous coarsening of discontinuous precipitates in a Co-6 at. % Mo alloy, Mater. Sci. Eng. A. 251 (1998) 135-141.

[34]. V. Ramaswamy, E. P. Butler, P. R. Swann, Direct observation of discontinuous precipitation in Al-28 at % Zn, J. Microsc. 97 (1973) 259-268.

[35]. E. P. Butler, V. Ramaswamy, P. R. Swann, In Situ Observation of Cellular Precipitation in an Al-28 at % Zn Alloy By High Voltage Electron Microscopy, Acta Metall. 21 (1973) 517-524.

[36]. K. N. Braszczyńska-Malik, Discontinuous and continuous precipitation in magnesium-aluminium type alloys, J. Alloys Compd. 477 (2009) 870-876.

[37]. A. Bauer, S. Neumeier, F. Pyczak, M. Goken, Creep Strength and Microstructure of Polycrystalline Gamma Prime-Strengthened Cobalt-Base Superalloys, Superalloys 2012. (2012) 695-703.

[38]. H. Y. Yan, V. A. Vorontsov, D. Dye, Alloying effects in polycrystalline γ' strengthened Co—Al—W base alloys, Intermetallics. 48 (2014) 44-53.

[39]. J. D. Nystrom, T. M. Pollock, W. H. Murphy, A. Garg, Discontinuous cellular precipitation in a high-refractory nickel-base superalloy, Metall. Mater. Trans. A. 28 (1997) 2443-2452.

[40]. D. Turnbull, Theory of cellular precipitation, Acta Metall. 3 (1955) 55-63. doi: 10.1016/0001-6160(55)90012-2.

[41]. F. Stein, D. Jiang, M. Palm, G. Sauthoff, D. Grüner, G. Kreiner, Experimental reinvestigation of the Co—Nb phase diagram, Intermetallics. 16 (2008) 785-792.

[42]. H. Okamoto, Co—Nb (Cobalt-Niobium), J. Phase Equilibria. 21 (2000).

[43]. S. Kobayashi, Y. Tsukamoto, T. Takasugi, hours. Chinen, T. Omori, K. Ishida, S. Zaefferer, Determination of phase equilibria in the Co-rich Co—Al—W ternary system with a diffusion-couple technique, Intermetallics. 17 (2009) 1085-1089.

[44]. R. C. Reed, The superalloys: fundamentals and applications, Cambridge University Press, 2006.

[45]. W. Huang, Y. A. Chang, A thermodynamic analysis of the NilAl system, Intermetallics. 6 (1998) 487-498.

[46]. M. Durand-Charre, J. H. Davidson, The microstructure of superalloys, Routledge, 1998.

[47]. C. T. Sims, N. S. Stoloff, W. C. Hagel, Superalloys II: High-Temperature Materials for Aerospace and Industrial Power, in: Superalloys II, 1987: p. 615.

[48]. P. J. Bocchini, C. K. Sudbrack, R. D. Noebe, D. N. Seidman, Temporal Evolution of a Model Co—Al—W Superalloy Aged at 650° C. and 750° C., Acta Mater. 159 (2018) 197-208.

[49]. T. M. Pollock, S. Tin, Nickel-Based Superalloys for Advanced Turbine Engines: Chemistry, Microstructure and Properties, J. Propuls. Power. 22 (2006) 361-374.

[50]. K. E. Yoon, R. D. Noebe, D. N. Seidman, Effects of rhenium addition on the temporal evolution of the nanostructure and chemistry of a model Ni—Cr—Al superalloy. I: Experimental observations, Acta Mater. 55 (2007) 1145-1157.

[51]. P. Pandey, S. K. Makineni, A. Samanta, A. Sharma, S. M. Das, B. Nithin, C. Srivastava, A. K. Singh, D. Raabe, B. Gault, K. Chattopadhyay, Elemental site occupancy in the L12 A3B ordered intermetallic phase in Co-based superalloys and its influence on the microstructure, Acta Mater. (2018).

[52]. A. Tomaszewska, T. Mikuszewski, G. Moskal, D. Migas, Primary microstructure, microsegregation and precipitates characterization of an as-cast new type γ-γ' Co—Al—Mo—Nb cobalt-based superalloy, J. Alloys Compd. 750 (2018) 741-749.

[53]. E. A. Lass, D. J. Sauza, D. C. Dunand, D. N. Seidman, Multicomponent γ'-strengthened Co-based superalloys with increased solvus temperatures and reduced mass densities, Acta Mater. 147 (2018) 284-295.

[54]. H. J. Im, S. K. Makineni, B. Gault, F. Stein, D. Raabe, P. P. Choi, Elemental partitioning and site-occupancy in γ/γ' forming Co—Ti—Mo and Co—Ti—Cr alloys, Scr. Mater. 154 (2018) 159-162.

[55]. X. P. Tan, J. L. Liu, T. Jin, X. F. Sun, Z. Q. Hu, Influence of Cr addition on microstructure of a 5%

Re-containing single crystal nickel-based superalloy, Trans. Nonferrous Met. Soc. China (English Ed. 21 (2011) 1004-1008.

[56]. N. S. Patel, V. Pavlík, M. Boča, High-Temperature Corrosion Behavior of Superalloys in Molten Salts-A Review, Crit. Rev. Solid State Mater. Sci. 42 (2017) 83-97.

[57]. W. W. Xu, S. L. Shang, C. P. Wang, T. Q. Gang, Y. F. Huang, L. J. Chen, X. J. Liu, Z. K. Liu, Accelerating exploitation of Co—Al-based superalloys from theoretical study, Mater. Des. 142 (2018) 139-148.

[58]. W. Y. Wang, F. Xue, Y. Zhang, S. L. Shang, Y. Wang, K. A. Darling, L. J. Kecskes, J. Li, X. Hui, Q. Feng, Z. K. Liu, Atomic and electronic basis for solutes strengthened (010) anti-phase boundary of $L12Co_3$(Al, TM): A comprehensive first-principles study, Acta Mater. 145 (2018) 30-40.

[59]. J. J. Ruan, C. P. Wang, S. Y. Yang, T. Omori, T. Yang, Y. Kimura, X. J. Liu, R. Kainuma, K. Ishida, Experimental investigations of microstructures and phase equilibria in the Co—V—Ta ternary system, J. Alloys Compd. 664 (2016) 141-148.

[60]. C. P. Wang, S. Yang, S. Y. Yang, D. Wang, J. J. Ruan, J. Li, X. J. Liu, Experimental Investigation of the Phase Equilibria in the Co—Nb—V Ternary System, J. Phase Equilibria Diffus. 36 (2015) 592-598.

[61]. F. L. Reyes Tirado, J. Perrin Toinin, D. C. Dunand, γ+γ' microstructures in the Co—Ta—V and Co—Nb—V ternary systems, Acta Mater. 151 (2018) 137-148.

[62]. L. Wang, M. Oehring, Y. Liu, U. Lorenz, F. Pyczak, Site occupancy of alloying elements in the L12 structure determined by channeling enhanced microanalysis in γ/γ' Co-9Al-9W-2X alloys, Acta Mater. 162 (2019) 176-188.

[63]. I. Povstugar, P.-P. Choi, S. Neumeier, A. Bauer, C. H. Zenk, M. Göken, D. Raabe, Elemental partitioning and mechanical properties of Ti- and Ta-containing Co—Al—W-base superalloys studied by atom probe tomography and nanoindentation, Acta Mater. 78 (2014) 78-85.

[64]. F. Xue, hours. J. Zhou, X. F. Ding. M. L. Wang, Q. Feng. Improved high temperature γ' stability of Co—Al—W-base alloys containing Ti and Ta, Mater. Lett. 112 (2013) 215-218.

[65]. C. H. Zenk, S. Neumeier, hours. J. Stone, M. Göken, Mechanical properties and lattice misfit of γ/γ' strengthened Co-base superalloys in the Co—W—Al—Ti quaternary system, Intermetallics. 55 (2014) 28-39. doi: 10.1016/J.INTERMET.2014.07.006.

[66]. S. Meher, hours.-Y. Yan, S. Nag. D. Dye, R. Banerjee, Solute partitioning and site preference in γ/γ' cobalt-base alloys, Scr. Mater. 67 (2012) 850-853.

[67]. M. Kolb, L. P. Freund, F. Fischer, I. Povstugar, S. K. Makineni, B. Gault, D. Raabe, J. Müller, E. Spiecker, S. Neumeier, M. Göken, On the grain boundary strengthening effect of boron in γ/γ' Cobalt-base superalloys, Acta Mater. 145 (2018) 247-254.

[68]. M. Jin, N. Miao, W. Zhao, J. Zhou, Q. Du, Z. Sun, Structural stability and mechanical properties of $Co_3$(Al, M) (M=Ti, V, Cr, Zr, Nb, Mo, Hf, Ta, W) compounds, Comput. Mater. Sci. 148 (2018) 27-37. doi: 10.1016/J.COMMATSCI.2018.02.015.

[69]. I. Povstugar, C. H. Zenk, R. Li, P.-P. Choi, S. Neumeier, O. Dolotko, M. Hoelzel, M. Göken, D. Raabe, Elemental partitioning, lattice misfit and creep behaviour of Cr containing γ' strengthened Co base superalloys, Mater. Sci. Technol. 32 (2016) 220-225.

[70]. M. Kolb, C. H. Zenk, A. Kirzinger, I. Povstugar, D. Raabe, S. Neumeier, M. Göken, Influence of rhenium on c9-strengthened cobalt-base superalloys, (2018).

[71]. Q. Liu, J. Coakley, D. N. Seidman, D. C. Dunand, Precipitate Evolution and Creep Behavior of a W-Free Co-based Superalloy, Metall. Mater. Trans. A. 47 (2016) 6090-6096.

[72]. D.-W. Chung, J. Perrin Toinin, E. A. Lass, D. N. Seidman, D. C. Dunand, Effects of Cr on the properties of multicomponent cobalt-based superalloys with ultra high γ' volume fraction, Prep. (2018).

[73]. D. S. Ng, D.-W. Chung, J. Perrin Toinin, E. A. Lass, D. N. Seidman, D. C. Dunand, Effects of Cr on microstructure, elemental partitioning, and creep behavior in reduced mass density multicomponent Co-based superalloys, Prep. (2018).

[74]. Y. Li, F. Pyczak, J. Paul, M. Oehring, U. Lorenz, Z. Yao, Y. Ning, Rafting of γ' precipitates in a Co-9Al-9W superalloy during compressive creep, Mater. Sci. Eng. A. 719 (2018) 43-48.

[75]. F. Pyczak, A. Bauer, M. Göken, S. Neumeier, U. Lorenz, M. Oehring, N. Schell, A. Schreyer, A. Stark, F. Symanzik, Plastic deformation mechanisms in a crept L12 hardened Co-base superalloy, Mater. Sci. Eng. A. 571 (2013) 13-18.

[76]. Y. Li, F. Pyczak, J. Paul, M. Oehring, U. Lorenz, Z. Yao, Microstructure evolution in L12 hardened Co-base superalloys during creep, J. Mater. Res. 32 (2017) 4522-4530.

[77]. T. Murakumo, T. Kobayashi, Y. Koizumi, hours. Harada, Creep behaviour of Ni-base single-crystal superalloys with various γ' volume fraction, Acta Mater. 52 (2004) 3737-3744.

What is claimed is:

1. A cobalt based superalloy, comprising:

a nominal composition comprising at least cobalt (Co), aluminum (Al), Z and vanadium (V), Z being at least one of tantalum (Ta) and niobium (Nb), processed such that the superalloy comprises γ and γ' phases with stable γ+γ' microstructures, wherein the superalloy is a molybdenum-free cobalt based superalloy.

2. The superalloy of claim 1, wherein the nominal composition comprises one of Co-$a_1$Ni-$b_1$Al-$c_1$Ti-$d_1$Ta-$f_1$V-$g_1$B-$h_1$Cr, wherein $a_1$ is in a range of about 0-40 at. %, $b_1$ is in a range of about 2.5-10 at. %, $c_1$ is in a range of about 0-4 at. %, $d_1$ is in a range of about 2-4 at. %, $f_1$ is in a range of about 1.5-6 at. %, $g_1$ is in a range of about 0-1 at. %, $h_1$ is in a range of about 0-20 at. %, and Co is in balance;

Co-$a_2$Ni-$b_2$Al-$c_2$Ti-$e_2$Nb-$f_2$V-$g_2$B-$h_2$Cr, wherein $a_2$ is in a range of about 0-40 at. %, $b_2$ is in a range of about 2.5-10 at. %, $c_2$ is in a range of about 0-4 at. %, $e_2$ is in a range of about 2-4 at. %, $f_2$ is in a range of about 1.5-6 at. %, $g_2$ is in a range of about 0-1 at. %, $h_2$ is in a range of about 0-20 at. %, and Co is in balance; and Co-$a_3$Ni-$b_3$Al-$c_3$Ti-$d_3$Ta-$e_3$Nb-$f_3$V-$g_3$B-$h_3$Cr, wherein $a_3$ is in a range of about 0-40 at. %, $b_3$ is in a range of about 2.5-10 at. %, $c_3$ is in a range of about 0-4 at. %, $d_3$ is in a range of about 2-4 at. %, $e_3$ is in a range of about 2-4 at. %, $f_3$ is in a range of about 1.5-6 at. %, $g_3$ is in a range of about 0-1 at. %, $h_3$ is in a range of about 0-20 at. %, and Co is in balance.

3. The superalloy of claim 2, wherein the nominal composition comprises one of Co-5Al-1Ti-3Ta-3V;

Co-6Al-3Ta-3V;

Co-2.5Ni-5Al-1Ti-3Ta-3V;
Co-2.5Ni-6Al-3Ta-3V;
Co-10Ni-5Al-2Ti-3Ta-3V-0.04B;
Co-10Ni-5Al-2Ti-3Ta-3V-0.04B-5Cr;
Co-6Al-3Nb-3V;
Co-5Al-1Ti-3Nb-3V;
Co-10Ni-5Al-2Ti-3Nb-3V-0.04B;
Co-10Ni-5Al-2Ti-3Nb-3V-0.04B-4Cr;
Co-10Ni-5Al-2Ti-3Nb-3V-0.04B-8Cr;
Co-10Ni-5Al-2Ti-3Nb-3V-0.04B-10Cr;
Co-10Ni-7.5Al-3Ti-4.5Nb-4.5V-0.04B-4Cr;
Co-10Ni-5Al-2Ti-1.5Ta-1.5Nb-3V-0.04B-4Cr; and
Co-20Ni-5Al-2Ti-1.5Ta-1.5Nb-3V-0.04B-4Cr.

4. The superalloy of claim 3, wherein the nominal composition comprises Co-10Ni-5Al-2Ti-3Ta-3V-0.04B, and the γ'-precipitates have a composition of $(Co_{0.83}\ Ni_{0.17})_3$ $(Ta_{0.42}\ Al_{0.23}\ Ti_{0.19}V_{0.15}B_{0.01})$.

5. The superalloy of claim 1, wherein the nominal composition further comprises one or more of C, O, Mn, Y, Fe, Si, B, Zr, Hf, Ru and Re.

6. The superalloy of claim 1, wherein the γ+γ' microstructures are stable up to 1500 hours at a temperature of about 600-1100° C.

7. The superalloy of claim 1, wherein the γ' phase is presented near grain boundaries, with or without carbide and/or borides phases.

8. The superalloy of claim 1, wherein less than 5 vol. % of other deleterious phases or no other deleterious phases other than the γ, γ' carbide and/or borides phases are formed in the superalloy.

9. The superalloy of claim 1, being a tungsten-free cobalt based superalloy.

* * * * *